US011566315B2

(12) United States Patent
Miono et al.

(10) Patent No.: US 11,566,315 B2
(45) Date of Patent: Jan. 31, 2023

(54) HOT-DIP PLATING METHOD

(71) Applicant: NIPPON STEEL CORPORATION, Tokyo (JP)

(72) Inventors: Tadaaki Miono, Tokyo (JP); Shinichi Kamoshida, Tokyo (JP); Shinichi Koga, Tokyo (JP); Yasunori Hattori, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/288,519

(22) PCT Filed: Nov. 6, 2019

(86) PCT No.: PCT/JP2019/043454

§ 371 (c)(1),
(2) Date: Apr. 24, 2021

(87) PCT Pub. No.: WO2020/095939

PCT Pub. Date: May 14, 2020

(65) Prior Publication Data

US 2021/0388477 A1 Dec. 16, 2021

(30) Foreign Application Priority Data

Nov. 6, 2018 (JP) ..... JP2018-209243
Aug. 20, 2019 (JP) ..... JP2019-150571

(51) Int. Cl.
*C23C 2/02* (2006.01)
*C23C 2/32* (2006.01)

(52) U.S. Cl.
CPC . *C23C 2/32* (2013.01); *C23C 2/02* (2013.01)

(58) Field of Classification Search
None
See application file for complete search history.

(56) References Cited

U.S. PATENT DOCUMENTS 2,895,845 A * 7/1959 Jones ..... C23C 2/32
427/601

FOREIGN PATENT DOCUMENTS

CN 1132266 A 10/1996
JP 55-100969 A 8/1980
(Continued)

OTHER PUBLICATIONS

Komarov et al. Characterization of acoustic cavitation in water and molten aluminum alloy. Ultrasonics Sonochemistry. vol. 20, Issue 2, Mar. 2013, pp. 754-761 (Year: 2013).*
(Continued)

*Primary Examiner* — David P Turocy
(74) *Attorney, Agent, or Firm* — Renner, Otto, Boisselle & Sklar, LLP

(57) ABSTRACT

Provided is a hot-dip plating method that achieves good plating wettability between a metal material and a hot-dip plating bath and that makes it possible to reduce the amount of consumed energy as compared to conventional techniques. In a plating step included in the hot-dip plating method, vibration is applied to a hot-dip plating bath such that the ratio of the average sound pressure level (excluding noise) over ranges each lying between sound pressure peaks at harmonic frequencies of a fundamental frequency to the average sound pressure level (excluding noise) over the measured frequency range in an acoustic spectrum is greater than 0.2.

6 Claims, 12 Drawing Sheets

(56) References Cited

FOREIGN PATENT DOCUMENTS

| | | | |
|---|---|---|---|
| JP | 59-145771 | A | 8/1984 |
| JP | 02-125850 | A | 5/1990 |
| JP | 2-282456 | A | 11/1990 |
| JP | 3-229849 | A | 10/1991 |
| JP | 7-316770 | A | 12/1995 |
| JP | 2000-064020 | A | 2/2000 |
| JP | 2001303224 | A | 10/2001 |

OTHER PUBLICATIONS

Tzanakis et al. Characterisation of the ultrasonic acoustic spectrum and pressure field in aluminium melt with an advanced cavitometer. Journal of Materials Processing Technology, vol. 229, Mar. 2016, pp. 582-586 (Year: 2016).*

International Search Report for corresponding Application No. PCT/JP2019/043454, dated Dec. 17, 2019.

International Preliminary Report on Patentability for corresponding Application No. PCT/JP2019/043454, dated Jul. 27, 2020.

* cited by examiner

HOT-DIP PLATING METHOD

TECHNICAL FIELD

The present invention relates to a hot-dip plating method for plating a metal material by hot-dip plating. In particular, the present invention relates to a hot-dip plating method for plating a steel material by hot-dip plating.

BACKGROUND ART

Methods currently used to produce hot-dip plated products (such methods are "hot-dip plating methods") are roughly categorized into continuous hot-dip plating and dip plating. The following description will discuss a hot-dip plating method for plating a steel material, which is a typical example of a metal material, by hot-dipping plating.

A continuous hot-dip plating method is a method of plating a coiled steel material (metal strip) by continuously passing (dipping and passing) the steel material through a hot-dip plating bath. A dip plating method is so-called "dip plating", which achieves plating by allowing flux to attach to a pre-molded steel material and then dipping the steel material in a hot-dip plating bath.

Equipment for use in the continuous hot-dip plating method (such equipment is referred to as "continuous hot-dip plating equipment") typically includes pre-treatment equipment, a reducing/heating furnace, a hot-dip plating bath section (molten metal pot), and post-treatment equipment. In the pre-treatment equipment, rolling oil and contaminants are removed from the steel material. In the reducing/heating furnace, a steel material is heated in an atmosphere containing $H_2$, thereby reducing Fe oxides present at the surface of the steel material. In the hot-dip plating bath section, the steel material, which has been treated in the reducing/heating furnace, is dipped in and passed through a hot-dip plating bath while the steel material is kept in a reducing atmosphere or in an atmosphere that prevents the reoxidation of the surface of the steel material, thereby plating the steel material by hot-clip plating. In the post-treatment equipment, the hot-dip plated steel sheet is subjected to various treatments, depending on the purpose of use.

On the other hand, equipment for use in the dip plating (such equipment is referred to as "dip plating equipment") includes degreasing equipment for removing oil and contaminants from a pre-molded steel material, pickling equipment for removing Fe oxide layers (called rust or mill scale), flux equipment for allowing flux to attach to the pickled steel material, and a hot-dip plating bath section for plating the steel material by hot-dip plating after the flux is dried. In some cases, the dip plating equipment further includes post-treatment equipment similarly to the continuous hot-dip plating equipment, as necessary. The flux is used to achieve good reactivity between the steel material and the hot-dip plating bath.

Conventional hot-dip plating methods can have the following issue: plating defects (called holiday or pinhole) occur in the surface of a hot-dip plated product (half-finished product). A plating defect means an area of the surface of the steel material where the molten metal is not attached to the steel material and therefore there is no plating metal. There are various kinds of possible causes for plating defects, and measures have been taken for a long time to address this issue. For example, the following technique is proposed as one of the measures: in a continuous hot-dip plating method, after a heating treatment (reduction treatment), a metal strip is subjected to hot-dip plating while receiving ultrasonic vibration (see Patent Literatures 1 and 2). Also with regard to dip plating, the following technique is proposed: for addressing the issue that a holiday results from burnt deposit (exposure of alloy layer), dip plating is carried out using ultrasonic waves (see Patent Literature 3).

Generally, in a continuous hot-dip plating method, prior to dipping a metal strip in the molten metal pot, a treatment to anneal the material for the metal strip itself and a treatment to reduce the oxide film on the surface of the metal strip are carried out in the reducing/heating furnace. In the reducing/heating furnace, the metal strip is subjected to a heat treatment in, for example, an atmosphere containing a mixture of nitrogen and hydrogen, for reduction of the oxide film. In the heat treatment, the temperature for heating the metal strip is set according to the purpose of use of a plated product, and the metal strip is heated to at least a temperature equal to or higher than the temperature of the hot-dip plating bath for achieving good reactivity between the metal strip and the hot-dip plating bath.

Because the oxide film on the surface of the metal strip is removed via the treatments in the reducing/heating furnace, the reactivity between the metal strip and the hot-dip plating bath the hot-dip plating bath improves. This makes it possible to stably produce hot-dip plated metal strips.

CITATION LIST

Patent Literature

[Patent Literature 1]
Japanese Patent Application Publication, Tokukaihei, No. 2-125850
[Patent Literature 2]
Japanese Patent Application Publication, Tokukaihei, No. 2-282456
[Patent Literature 3]
Japanese Patent Application Publication, Tokukai, No, 2000-064020

SUMMARY OF INVENTION

Technical Problem

However, plating defects may occur in the surface of plated products, depending on the components of the metal material or various factors such as production conditions. This applies not only to cases in which continuous hot-dip plating is carried out but also to cases in which dip plating is carried out to produce plated products.

Furthermore, in recent years, there have been increasing demands for (i) saving energy in the hot-dip plating method and (ii) clean work environments where workers carry out hot-dip plating operations.

The reducing/heating furnace of the continuous hot-dip plating equipment requires a huge amount of heat, and consumes huge amounts of nitrogen and hydrogen used as atmospheric gas. This also applies to the techniques disclosed in Patent Literatures 1 and 2. For the conventional continuous hot-dip plating method, it is not easy to reduce the amount of consumed energy while satisfying the requirements for hot-dip plated products (such as lesser plating defects).

Furthermore, dip plating equipment typically includes flux equipment for achieving good platability. In such a case, there are the following issues in terms of work environment. Specifically, there are the following issues, for example: (i)

chlorides (including $ZnCl_2$, $NH_4Cl$, etc.) which are main components of flux need to be handled and when the metal material after the flux has been dried is dipped in a hot-dip plating bath, huge amounts of smoke and odor are issued. With the dip plating equipment, it is difficult to improve the work environment while satisfying the requirements for hot-dip plated products.

An aspect of the present invention was made in view of the above-described conventional issues, and an object thereof is to provide a hot-dip plating method that achieves good plating wettability between a metal material and a hot-dip plating bath and that makes it possible to reduce the amount of consumed energy and improve work environments as compared to conventional techniques.

Solution to Problem

In order to attain the above object, a hot-dip plating method in accordance with an aspect of the present invention includes a plating step, the plating step including causing a metal material to advance into a plating bath which is a molten metal and allowing the metal material to be coated with the molten metal while applying vibration to the plating bath while the metal material is in contact with the molten metal, in which a fundamental frequency, and in the plating step, the vibration is applied such that an acoustic spectrum measured in the plating bath satisfies a relationship represented by the following expression (1):

$$(IB-NB)/(IA-NA)>0.2, \quad (1)$$

where

IA is an average sound pressure level over an entire measured frequency range,

IB is an average sound pressure level over specific frequency ranges including a range lying between a sound pressure peak at the fundamental frequency and a sound pressure peak at a second-harmonic frequency and (ii) each range lying between sound pressure peaks at adjacent ones of a plurality of harmonic frequencies, NA is an average sound pressure level over the entire measured frequency range when the vibration is not applied, and NB is an average sound pressure level over the specific frequency ranges defined for the IB when the vibration is not applied.

In the present specification, the ratio in intensity represented by (IB−NB)/(IA−NA) as described above may be referred to as "characteristic intensity ratio". The inventors of the present invention have found that the platability for a metal material improves when hot-dip plating is carried out under the conditions in which the characteristic intensity ratio is greater than 0.2.

Advantageous Effects of Invention

An aspect of the present invention makes it possible to provide a hot-dip plating method that achieves good plating wettability between a metal material and a hot-dip plating bath and that makes it possible to reduce the amount of consumed energy and improve work environments as compared to conventional techniques.

Figure 4:
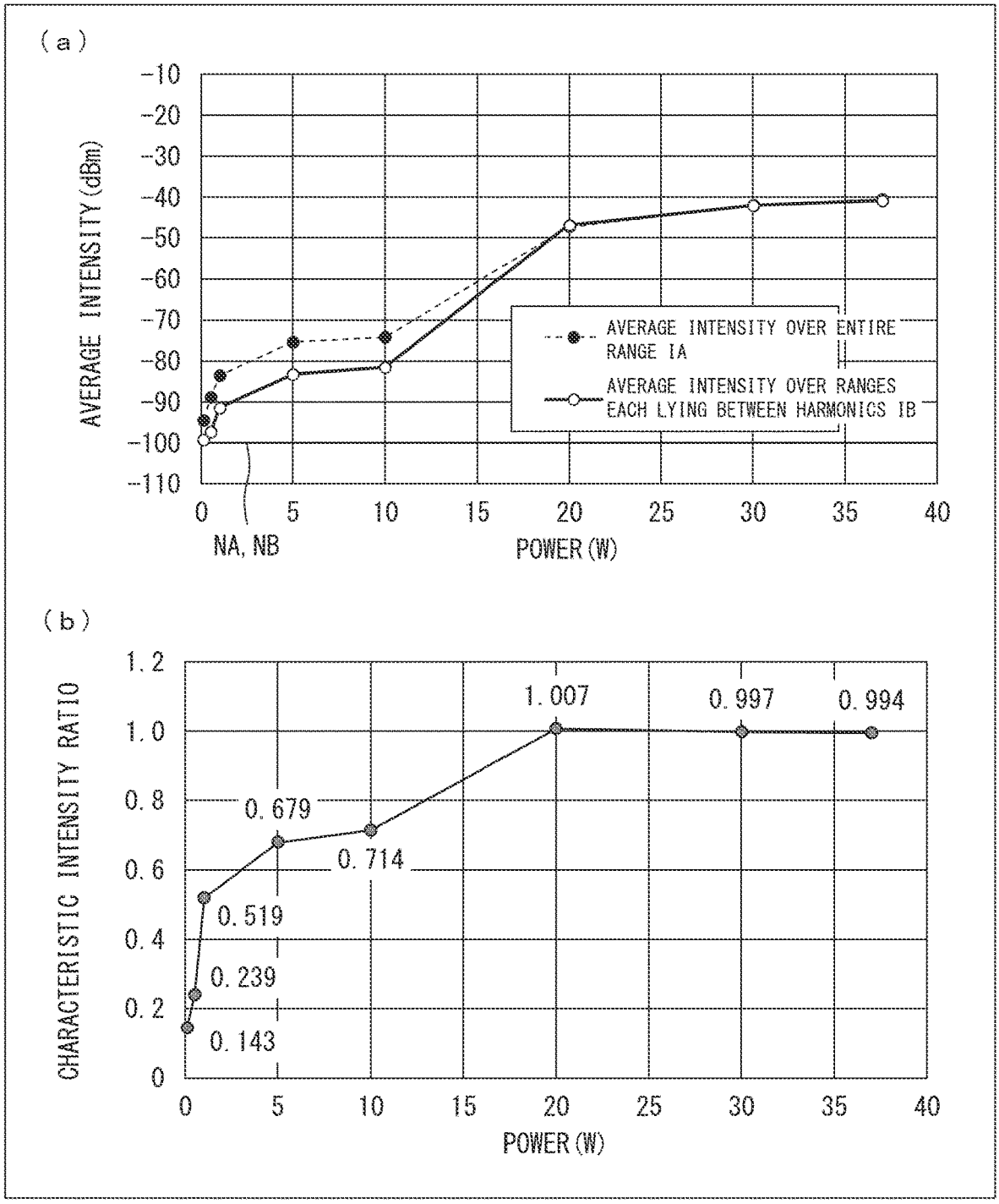

(a) of FIG. 4 is a chart showing the effects of ultrasonic power on the average intensity over the entire measured frequency range of an acoustic spectrum and between-harmonics average intensity. (h) of FIG. 4 is a chart showing the effects of ultrasonic power on the ratio of the between-harmonics average intensity to the average intensity over the entire measured frequency range of the acoustic spectrum.

Figure 5:
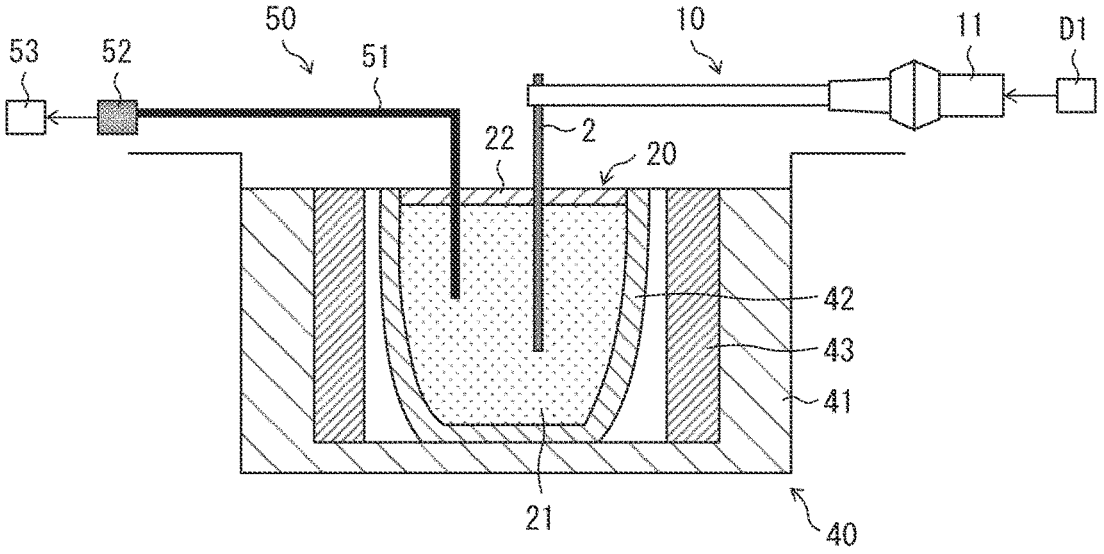

FIG. 5 schematically illustrates an example of a hot-dip plating apparatus which carries out a hot-dip plating method in accordance with Example 1 of the present invention.

Figure 6:
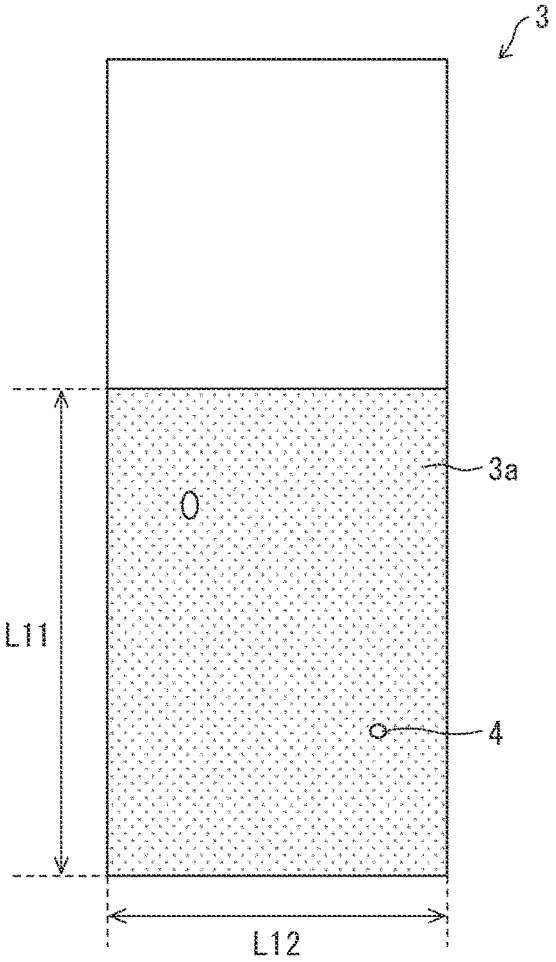

FIG. 6 is a side view illustrating how a plated sample material looks like.

Figure 7:
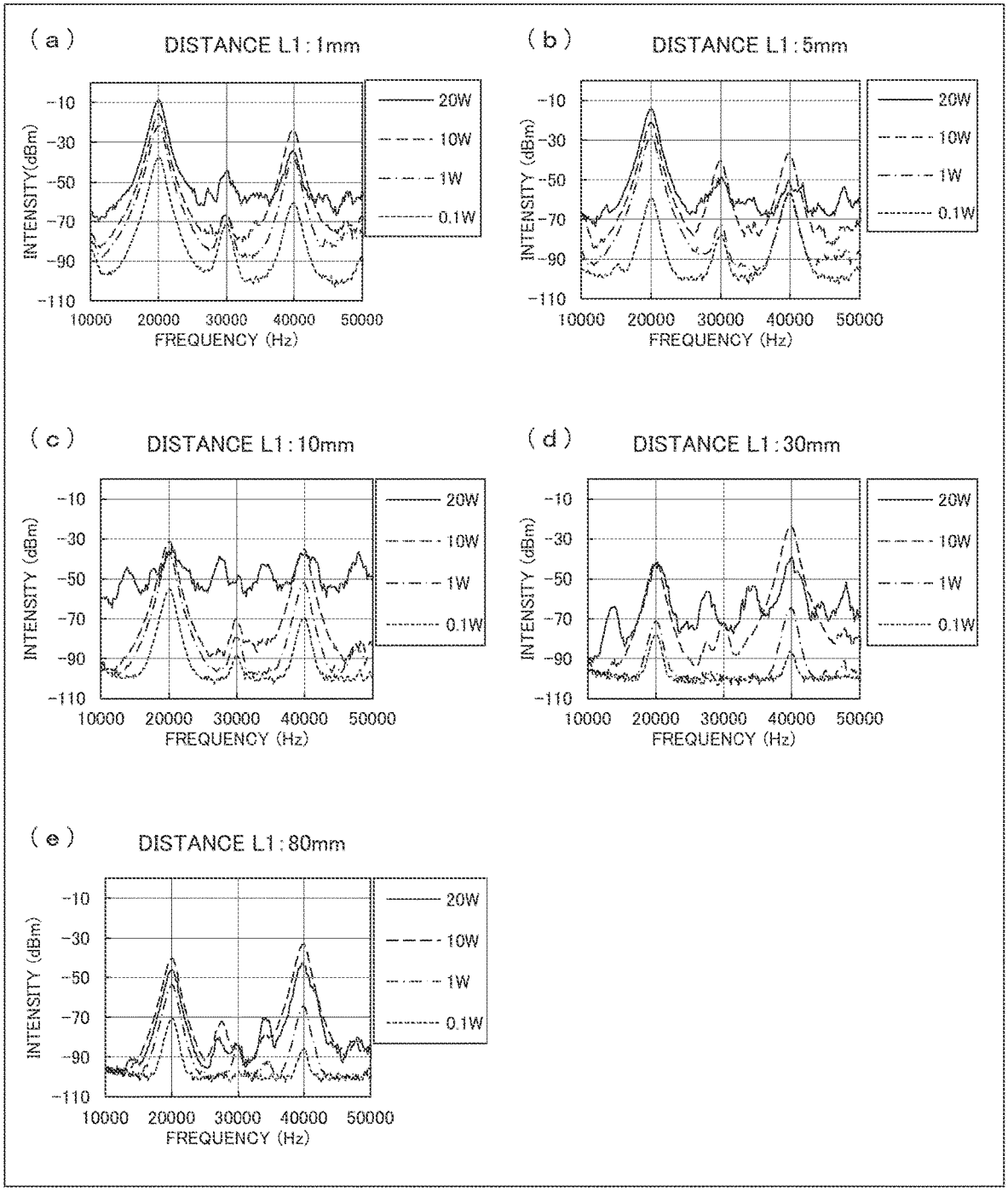

FIG. 7 shows charts of acoustic spectra measured while varying the power of an ultrasonic transducer. The distance between the tip of a waveguide probe and a steel sheet is different among the charts. (a) of FIG. 7 shows a case in which the distance is 1 mm, (b) of FIG. 7 shows a case in which the distance is 5 mm, (c) of FIG. 7 shows a case in which the distance is 10 mm, (d) of FIG. 7 shows a case in which the distance is 30 mm, and (e) of FIG. 7 shows a case in which the distance is 80 mm.

Figure 8:
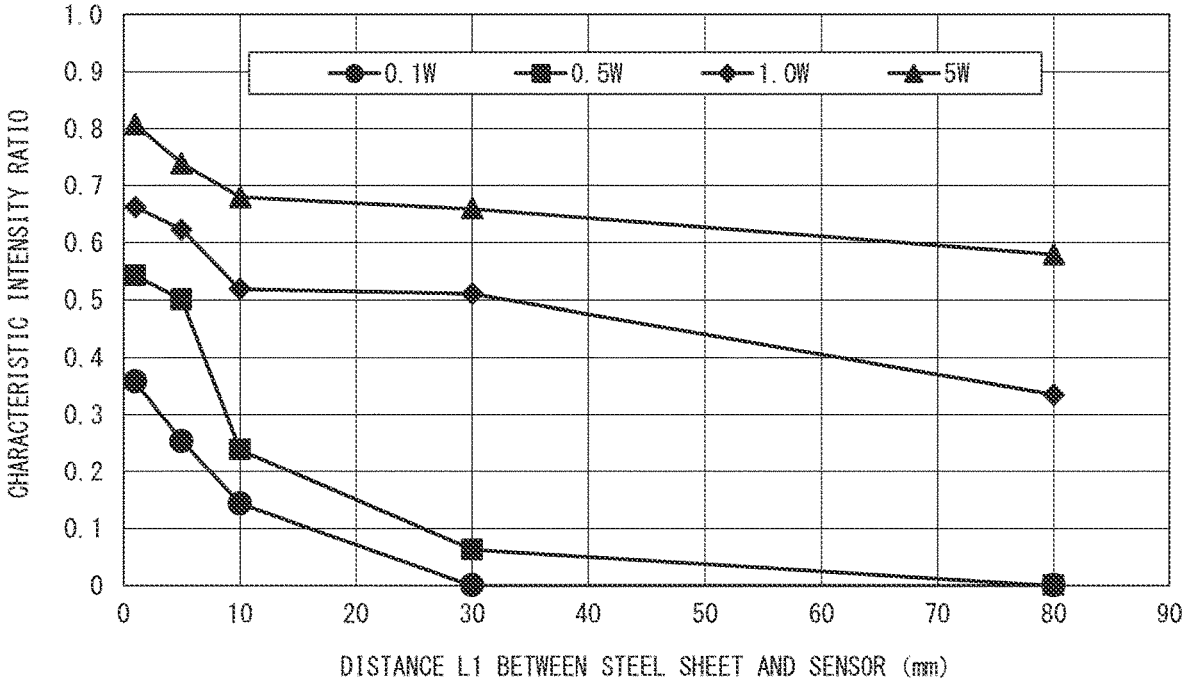

FIG. 8 is a chart showing the relationship between the distance and the characteristic intensity ratio.

Figure 9:
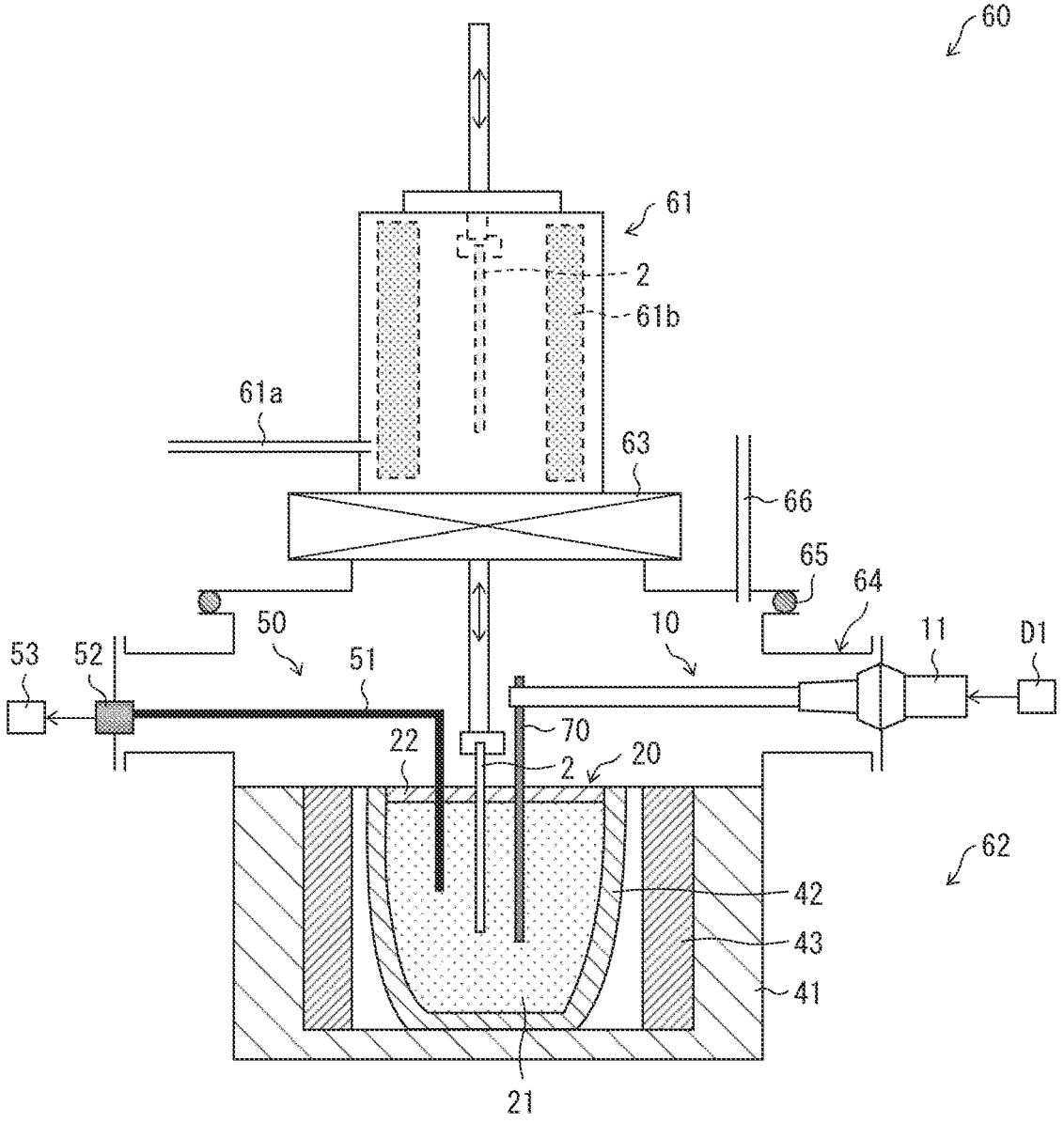

FIG. 9 schematically illustrates an example of a hot-dip plating apparatus which carries out a hot-dip plating method in accordance with Embodiment 3 of the present invention.

Figure 10:
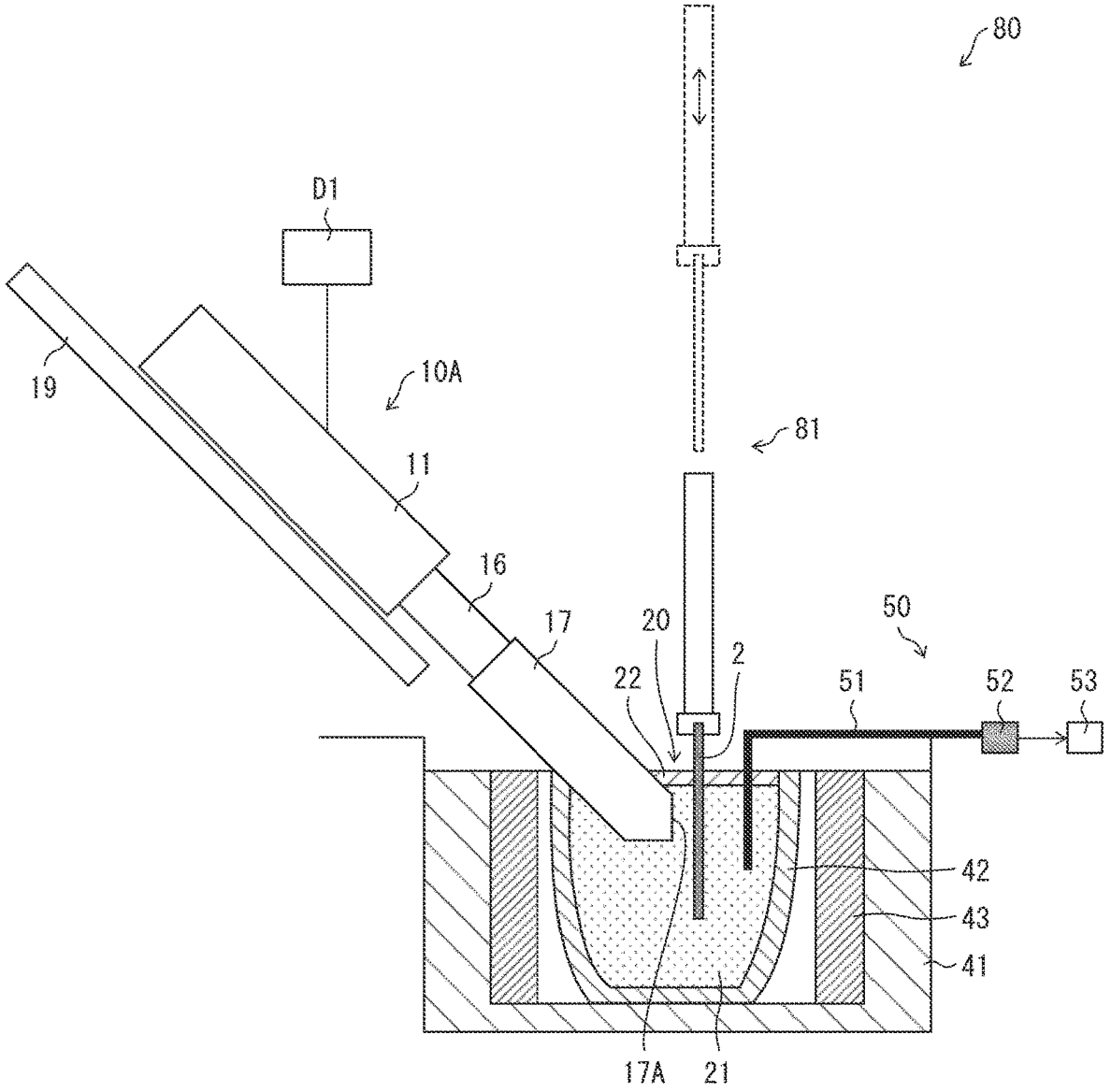

FIG. 10 schematically illustrates an example of a hot-dip plating apparatus which carries out a hot-dip plating method in accordance with Embodiment 5 of the present invention.

Figure 11:
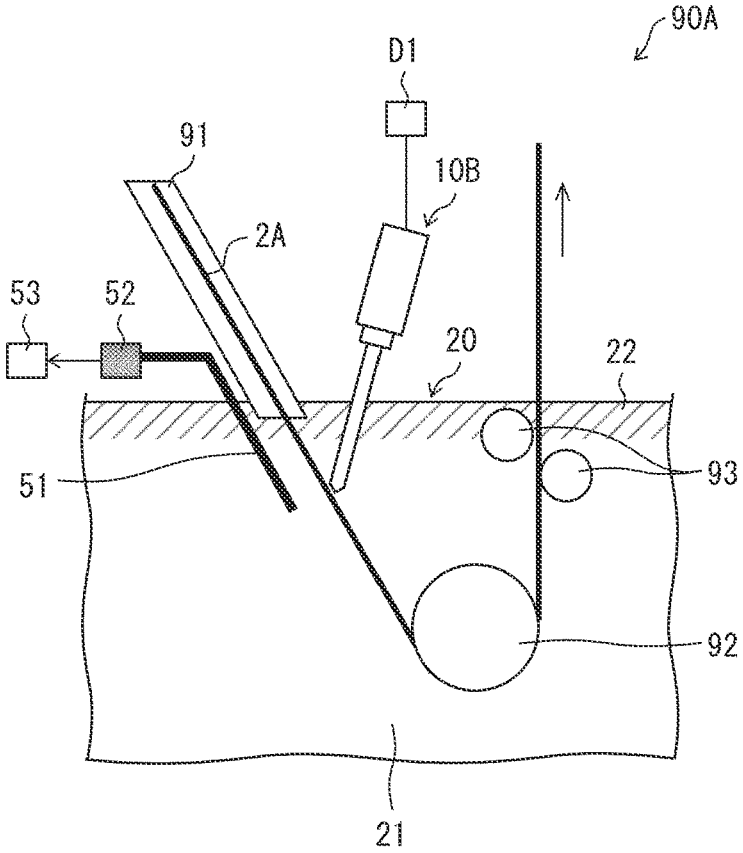

FIG. 11 schematically illustrates an example of hot-dip plating equipment which carries out a hot-dip plating method in accordance with Embodiment 6 of the present invention.

Figure 12:
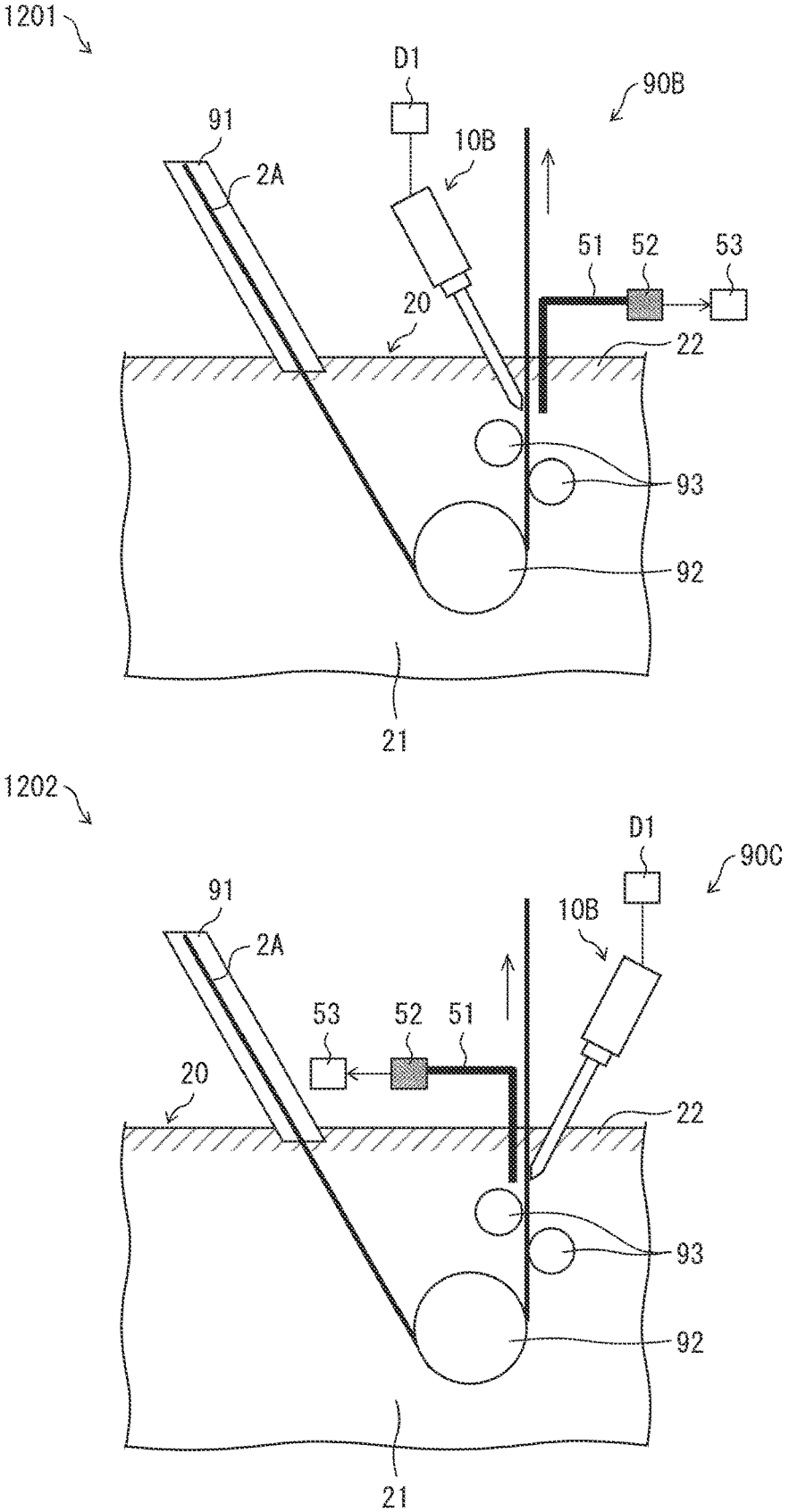

FIG. 12 schematically illustrates variations of the hot-dip plating equipment.

Figure 13:
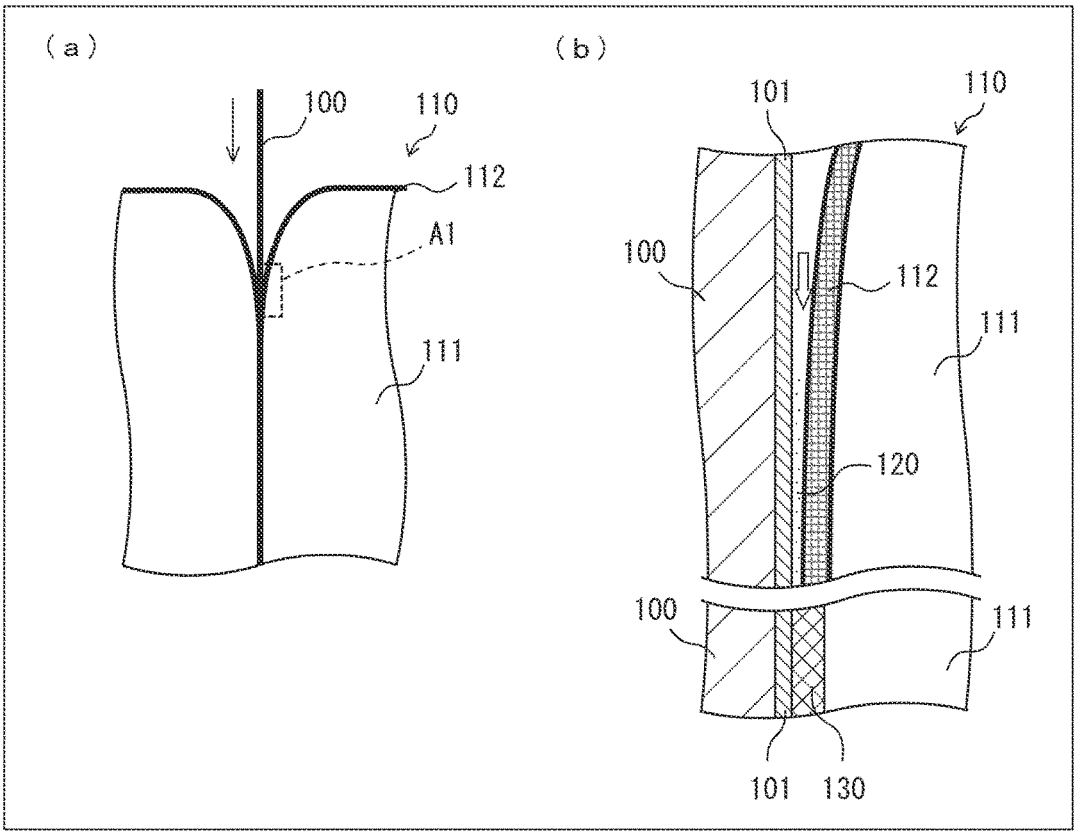

(a) of FIG. 13 schematically illustrates the manner in which a steel sheet is caused to advance into a hot-dip plating bath in an air atmosphere. (b) of FIG. 13 is a partial enlarged view schematically illustrating area (A1) shown in (a) of FIG. 13.

Figure 14:
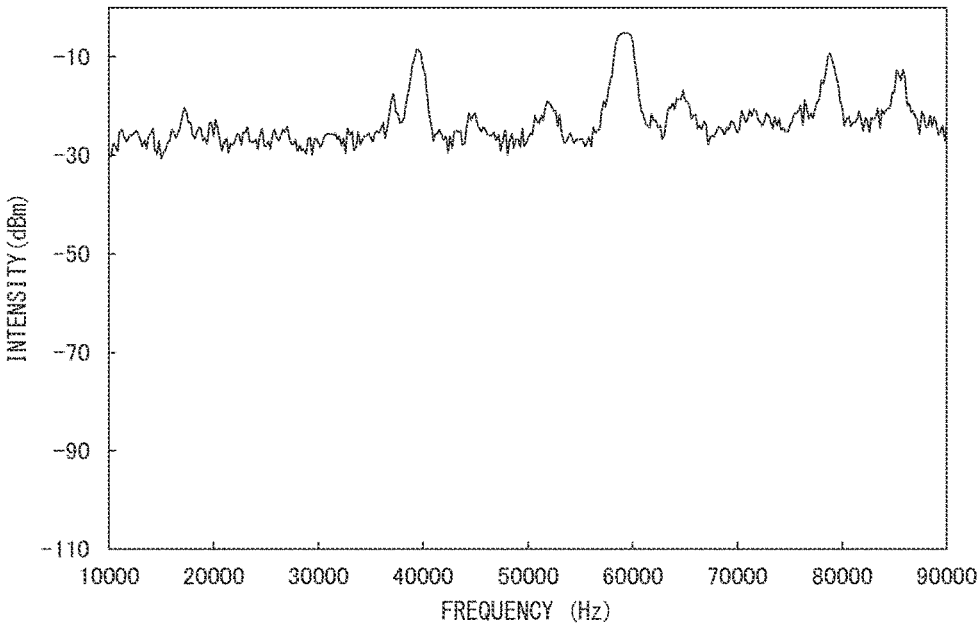

FIG. 14 is an acoustic spectrum that is observed in a case where vibration is applied to a hot-dip plating bath with use of an ultrasonic transducer with a power of 380 W.

DESCRIPTION OF EMBODIMENTS

The following description will discuss embodiments of the present invention with reference to the drawings. Note that the following descriptions are for better understanding the gist of the present invention, and are not intended to limit the scope of the present invention, unless otherwise specified. Furthermore, "A to B" in the present application indicates "not less than A and not more than B". The shapes and dimensions of elements illustrated in the drawings of the present application do not necessarily agree with the actual shapes and dimensions, but have been changed as appropriate for clarity and conciseness of the drawings.

Definitions of Terms

In the present specification, various types of metals in a molten state (molten metals) which are components of a hot-dip plating bath may be referred to as "hot-dip plating bath metals". Furthermore, in the present specification, the material and shape of a steel material which is to be subjected to hot-dip plating using a hot-dip plating bath are not particularly limited, unless specifically noted. Furthermore, the "steel sheet" may be read as "steel strip", unless any problem arises.

Note that the "platability" with regard to a hot-dip plating method generally means both (i) the plating wettability between a metal material and a hot-dip plating bath and (ii) the adhesiveness between the metal material and a plating on the surface of the metal material; however, in the present specification, the term "platability" is used to mean plating wettability.

OVERVIEW OF FINDING CONCERNING THE INVENTION

Generally, when (i) a steel sheet (steel strip) not subjected to a reduction treatment is caused to advance into a hot-dip plating bath or (ii) a steel sheet is caused to advance into a hot-dip plating bath in an air atmosphere (having high oxygen concentration) without using a snout, the reaction between the steel sheet and the hot-dip plating bath metal is inhibited, and good platability cannot be achieved. A reason therefor is described below in detail with reference to FIG. 13. (a) of FIG. 13 schematically illustrates the manner in which a steel sheet is caused to advance into a hot-dip plating bath in an air atmosphere. (b) of FIG. 13 is a partial enlarged view schematically illustrating area (A1) shown in (a) of FIG. 13.

As illustrated in (a) of FIG. 13, a steel sheet 100, which has not been subjected to a reduction treatment, is caused to advance in to a hot-dip plating bath 110 in an air atmosphere. The steel sheet 100 has an oxide film formed on its surface. Furthermore, there is a bath surface oxide 112 at the boundary between a hot-dip plating bath metal 111 in the hot-dip plating bath 110 and the atmosphere (atmospheric air) outside the hot-dip plating bath 110 (i.e., at the surface of the hot-dip plating bath 110).

As illustrated in (b) of FIG. 13, the steel sheet 100 advances into the hot-dip plating bath 110 such that (i) the bath surface oxide 112 is wrapped around the steel sheet 100 and (ii) the steel sheet 100 traps a trapped air layer 120 formed from atmospheric gas (air) at the surface of the hot-dip plating bath 110. As a result, in the hot-dip plating bath 110, a reaction inhibiting part 130 is formed between the hot-dip plating bath metal 111 and the oxide film 101 of the steel sheet 100. The reaction inhibiting part 130 is formed of the bath surface oxide 112 and the trapped air layer 120 in a composite manner. Because the oxide film 101 and the reaction inhibiting part 130 inhibit the reaction between the steel sheet 100 and the hot-dip plating bath metal 111, plating defects (such as pinhole or holiday) readily occur in the surface of a plated product withdrawn from the hot-dip plating bath 110.

Therefore, in the hot-dip plating methods of the conventional techniques, as described earlier, an oxide film on the surface of a steel sheet is reduced with use of a heating furnace, and then the steel sheet is caused to advance into a hot-dip plating bath through a snout in which a reducing atmosphere is maintained (for example, see Patent Literatures 1 and 2). In such a case, when the steel sheet advances into the hot-dip plating bath, the reaction between the steel sheet and the hot-dip plating bath metal quickly proceeds.

The inventors of the present invention conducted diligent study concerning a hot-dip plating method that is capable of reducing the amount of consumed energy via a novel method differing from the foregoing conventional techniques. As a result, the inventors novelly found that, if vibration with specific conditions is applied to a hot-dip plating bath when a steel material is caused to advance into the hot-dip plating bath, a vibration-induced activation effect results from the application of such vibration, making it possible to increase the reactivity between the steel material and the hot-dip plating bath metal. According to this finding, even in cases where a steel material at room temperature is caused to advance into a hot-dip plating bath in an air atmosphere, the platability for the steel material can be increased. This is a phenomenon that was not at all expected in the conventional techniques, as is apparent from the fact that the conventional hot-dip plating equipment is configured such that the reducing/heating furnace is provided upstream of the hot-dip plating section.

The difference between the finding made by the inventors and the conventional techniques is discussed below in more detail. Specifically, there has been a proposal of a technique to apply vibration with high sound pressure to a hot-dip plating bath with use of a high-power (e.g., on the order of several hundreds of watts) ultrasonic transducer. In such a case, for example, an acoustic spectrum as shown in FIG. 14 (white noise-like spectrum with no or few characteristic peaks) is observed. FIG. 14 is an acoustic spectrum that is observed in a case where vibration is applied to a hot-dip plating bath with use of an ultrasonic transducer with a power of 380 W. In this kind of technique, a "cavitation" effect resulting from high-power ultrasonic irradiation of the hot-dip plating bath is used to physically destroy the oxide film on the surface of the steel sheet (or oxide film remaining on the surface of the steel sheet after subjected to the reduction treatment), thereby improving the platability for the steel sheet.

In contrast, the inventors of the present invention have found that, even in cases where a low-power ultrasonic transducer is used, the vibration-induced activation effect of the present invention is achieved and the platability for steel sheets improves effectively. In such cases, characteristic peaks are observed in the acoustic spectrum (which will be described later in detail). The following are the thoughts of the inventors of the present invention concerning the vibration-induced activation effect that is exhibited even at low sound pressure levels, which is different from the conventional technique.

Specifically, the following mechanism is inferred, although this has not been elucidated. Even in cases where low sound pressure is applied to a hot-dip plating bath, a molten metal for plating is subjected to pressure and vibrates due to acoustic waves, and the pressure and vibration cause bubbles in the plating bath. It is inferred that, then, when these bubbles collapse because of the pressure and vibration, shock waves are generated outward from the bubbles. It is also inferred that, because of the pressure and vibration, bubbles expand and shrink repeatedly, and that, because of the expansion and shrinkage, local flows of the molten metal for plating occur around the bubbles. Because of the effects of the shock waves and the local flows etc. based on acoustic energy, mass transfer is accelerated at the interface between the steel material and the plating bath, resulting in effects such as a reduction in thickness of a boundary layer or an increase in mass transfer rate. This achieves plating wettability between the steel material and the hot-dip plating bath.

Note that it is considered that also in conventional techniques (in cases where vibration with high sound pressure is applied to the hot-dip plating bath), the phenomenon that the mass transfer at the interface between the steel material and the hot-dip plating bath is accelerated occurs. However, according to the finding in the present invention, it was found that the vibration with high sound pressure does not need to be applied to the hot-dip plating bath, and low-energy vibration will suffice, provided that the vibration-induced activation effect that achieves the plating wettability between the steel material and the hot-dip plating bath occurs. Furthermore, the conventional techniques, in which vibration with high sound pressure is applied to the plating bath, are disadvantageous in the following aspect.

Specifically, the following issue arises: in cases where vibration with high sound pressure is applied to the hot-dip plating bath, the cavitation effect occurs concurrently with shock waves and local flows, which allows the steel material to quickly dissolve into the hot-dip plating bath, and a corrosion phenomenon, i.e., so-called erosion, is likely to occur. This means that, in cases where the steel material is a steel sheet, the thickness of the steel sheet after hot-dip plating is smaller than that before causing the steel sheet to advance into the hot-dip plating bath. Therefore, there is a concern that is difficult to ensure the thickness of the hot-dip plated steel sheet product. There is also the following concern: the reaction in which the steel material dissolves in the hot-dip plating bath means that the concentrations of the components of the steel material such as iron (Fe) in the hot-dip plating bath increase and, as a result, this is likely to lead to the occurrence of dross. Furthermore, for example, a member (ultrasonic horn) dipped in the bath for application of vibration with high sound pressure to the hot-dip plating bath is prone to erosion, and maintenance of such members is troublesome.

The following description schematically discusses a hot-dip plating method in accordance with an embodiment of the present invention based on the finding made by the inventors of the present invention (such a method hereinafter may be simply referred to as "present hot-dip plating method"). Specifically, the present hot-dip plating method involves applying vibration with low sound pressure to the interior portion of the hot-dip plating bath by (i) applying ultrasonic vibration to the steel material or (ii) applying ultrasonic vibration to the interior portion of the hot-dip plating bath with use of, for example, a vibrating plate. Furthermore, an acoustic measuring instrument dipped in the hot-dip plating bath is used to measure an acoustic spectrum. In the present hot-dip plating method, the ultrasonic vibration is applied to the hot-dip plating bath such that the acoustic spectrum satisfies predetermined conditions. The ultrasonic vibration applied to the steel material or the vibrating plate causes a vibration-induced activation effect in the hot-dip plating bath. The predetermined conditions are defined in order to indirectly specify the degree of intensity of the vibration-induced activation effect by use of the acoustic spectrum in the hot-dip plating bath, for the vibration-induced activation effect of a certain level or more to occur.

Embodiment 1

The following description will discuss an embodiment of the present invention in detail.

In Embodiment 1, descriptions are given to a hot-dip plating method in which a sheet-shaped steel material (steel sheet), which is a kind of metal material, is used and in which the steel sheet is dipped in a hot-dip plating bath and then withdrawn, thereby plating the steel sheet by hot-dip plating (such a method is so-called dip plating). In the hot-dip plating method in accordance with Embodiment 1, the dip plating is carried out in an air atmosphere. Note that the hot-dip plating method in accordance with an aspect of the present invention is not limited to such an embodiment. The present hot-dip plating method can be applied to, for example, various types of metal materials to be typically plated by hot-dip plating. The present hot-dip plating method can also be applied to a continuous hot-dip plating method in which a steel strip is used as a steel material and plated continuously by hot-dip plating. The present hot-dip plating method can also be applied to cases in which a steel wire is used as a steel material and subjected to dip plating or continuous hot-dip plating.

(Steel Sheet)

A steel sheet for use in the hot-dip plating method in accordance with Embodiment 1 may be selected as appropriate from known steel sheets according to the purpose of use. Examples of the type of steel that is a component of the steel sheet include carbon steel (common steel, high strength steel (high-Si high-Mn steel)), stainless steel, and the like. The thickness of the steel sheet is not particularly limited, and can be, for example, 0.2 mm to 6.0 mm. The shape of the steel sheet is not particularly limited, and can be, for example, a rectangle. A steel sheet typically used in hot-dip plating can be used in the hot-dip plating method in accordance with Embodiment 1.

The steel sheet does not need to undergo reduction/heating treatment etc. prior to a hot-dip plating treatment. Therefore, at the point in time in which the steel sheet is introduced into the hot-dip plating bath, the steel sheet may have an oxide film on its surface. The thickness of the oxide film, which can vary depending on the type of steel which is a component of the steel sheet, is about several tens of nanometers to several hundreds of nanometers, for example.

In the hot-dip plating method in accordance with Embodiment 1, the temperature of the steel sheet before advancing into the hot-dip plating bath may be room temperature. In other words, the temperature of the steel sheet can be, for example, room temperature to 70° C.

In the hot-dip plating method in accordance with Embodiment 1, the steel sheet does not need to undergo a flux treatment or the like prior to the hot-dip plating treatment. However, the steel sheet may undergo a heat treatment, a reduction treatment, a flux treatment, and/or the like prior to the hot-dip plating treatment, as needed.

(Hot-Dip Plating Bath)

Any of known hot-dip plating baths can be used as the hot-dip plating bath in accordance with Embodiment 1. Examples of the hot-dip plating bath include zinc(Zn)-based plating baths, Zn-aluminum (Al)-based plating baths, Zn—Al-magnesium (Mg)-based plating baths, Zn—Al—Mg-silicon (Si)-based plating baths, Al-based plating baths, Al—Si-based plating baths, Zn—Al—Si-based plating baths, Zn—Al—Si—Mg-based plating baths, tin (Sn)—Zn-based plating baths, and the like.

The temperature of the hot-dip plating bath in the present hot-dip plating method may be similar to the temperature of the hot-dip plating bath used in a known hot-dip plating method.

(Hot-Dip Plating Apparatus)

Figure 1:
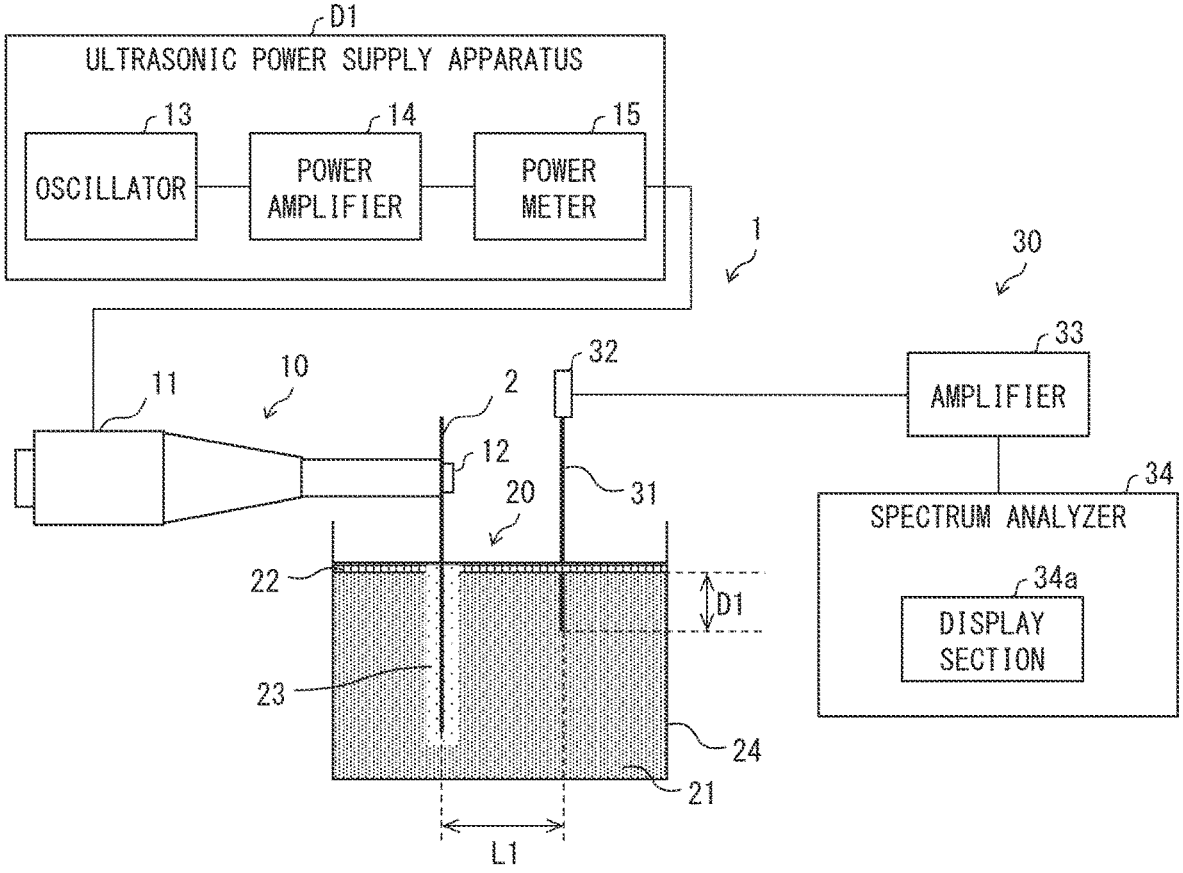
FIG. 1 schematically illustrates an example of a hot-dip plating apparatus which carries out a hot-dip plating method in accordance with Embodiment 1 of the present invention.
Figure 2:
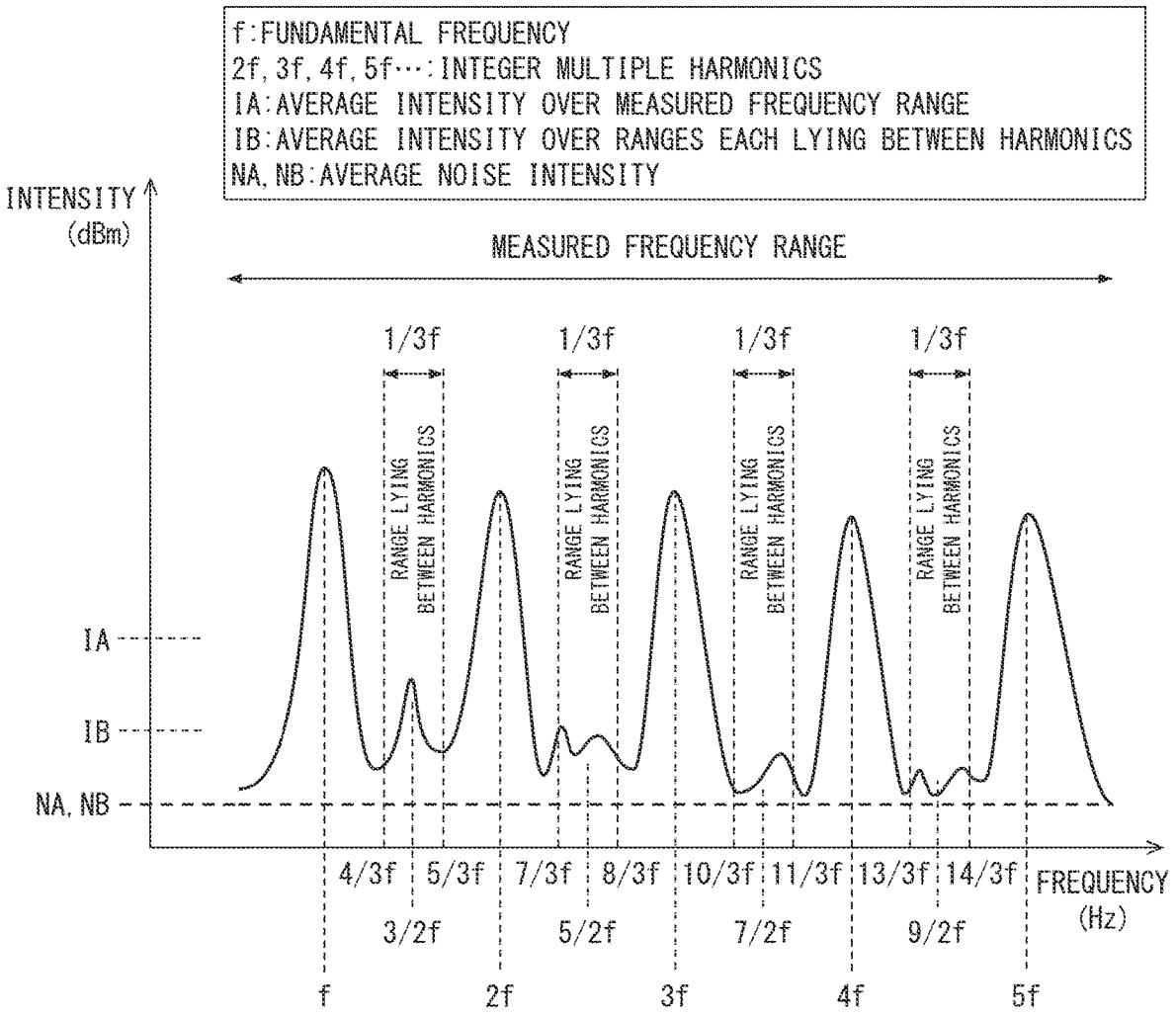
FIG. 2 is a chart showing an example of an acoustic spectrum measured by a spectrum analyzer included in the hot-dip plating apparatus.

The following description will discuss a hot-dip plating apparatus 1 which carries out a hot-dip plating method in accordance with Embodiment 1, with reference to FIGS. 1 and 2. Note that the hot-dip plating apparatus 1 is an example, and an apparatus that carries out the present hot-dip plating method is not particularly limited. FIG. 1 schematically illustrates the hot-dip plating apparatus 1 which carries out the hot-dip plating method in accordance with Embodiment 1.

As illustrated in FIG. 1, the hot-dip plating apparatus 1 includes an ultrasonic horn (vibration generator) 10, an ultrasonic power supply apparatus D1, a hot-dip plating bath 20, and a measuring unit 30. The ultrasonic horn 10 includes an ultrasonic transducer 11. The ultrasonic horn 10 has a steel sheet 2 fixed with a bolt 12 to the tip thereof.

The ultrasonic power supply apparatus D1 includes an oscillator 13, a power amplifier 14, and a power meter 15. The oscillator 13 emits an alternating-current signal at an arbitrary frequency, and the power amplifier 14 amplifies the alternating-current signal to generate an ultrasonic signal. The ultrasonic horn 10 receives the ultrasonic signal which is supplied through the power meter 15. This allows the ultrasonic transducer 11 to carry out ultrasonic vibration. The vibration of the ultrasonic transducer 11 causes the steel sheet 2, which is connected to the ultrasonic horn 10, to vibrate.

The vibration of the steel sheet 2 causes the vibration-induced activation effect in the hot-dip plating bath 20, resulting in the generation of a vibration-induced activated area 23 in the vicinity of the steel sheet 2 within the hot-dip plating bath 20. The hot-dip plating bath 20 is contained in a pot 24, and includes a hot-dip plating bath metal 21 and a bath surface oxide 22. The vibration-induced activated area 23 is generated both in the hot-dip plating bath metal 21 and the bath surface oxide 22 of the hot-dip plating bath 20.

The hot-dip plating bath 20 has a waveguide probe 31 inserted therein. One end of the waveguide probe 31 is located at an appropriate position in the hot-dip plating bath 20 such that the waveguide probe 31 is capable of acquiring the frequency of the vibration of the hot-dip plating bath metal 21, and the other end of the waveguide probe 31 is connected to a vibration sensor 32. The vibration sensor 32 serves to convert the vibration of the waveguide probe 31 into an electrical signal with use of a piezoelectric element. The electrical signal transmitted from the vibration sensor 32 is amplified through an amplifier 33, and then transferred to a spectrum analyzer 34. The spectrum analyzer 34 includes a display section 34*a*. Although a case where the spectrum analyzer 34 includes the display section 34*a* is discussed in Embodiment 1, the display section 34*a* may be replaced by an external device connected to the spectrum analyzer 34.

In a case where dip plating is carried out with respect to the steel sheet 2 under the conditions in which, for example, the frequency of the ultrasonic transducer 11 is set to 20 kHz, the power of the ultrasonic transducer 11 is set to low power, and vibration with low sound pressure is applied to the interior portion of the hot-dip plating bath 20, the display section 34*a* typically displays an acoustic spectrum as shown in FIG. 2. It is noted here that the distance L1 between the waveguide probe 31 and the steel sheet 2 is 10 mm and the depth D1 at which the tip of the waveguide probe 31 is located (the distance between the tip and the surface of the hot-dip plating bath 20) is 30 mm. FIG. 2 is a chart showing an example of an acoustic spectrum measured by the spectrum analyzer 34 included in the hot-dip plating apparatus 1. In the chart of FIG. 2, the horizontal axis represents frequency, and the vertical axis represents power measured by the spectrum analyzer 34. The unit of the power, dBm (more accurately, dBmW; decibel-milliwatt), is power in the unit of decibel relative to 1 mW. Such a power can be used as an indicator that indicates the intensity of an acoustic spectrum. The level of the intensity of the acoustic spectrum (vertical axis in FIG. 2) corresponds to the level of sound pressure in the hot-dip plating bath 20. Therefore, a peak of the intensity in the acoustic spectrum corresponds to a peak of sound pressure.

As shown in FIG. 2 the following peaks mainly appear in the acoustic spectrum: a peak representing a fundamental tone (frequency: 20 kHz) corresponding to the foregoing vibration applied to the hot-dip plating bath 20; and peaks representing overtones (harmonics) (integer multiples of the fundamental tone). Note here that the frequency of the fundamental tone is referred to as "fundamental frequency f", and that the range (width) of frequencies within which the acoustic spectrum was measured is referred to as "measured frequency range". Also note that, with regard to (i) the frequency at the midpoint between the fundamental frequency f and an adjacent integer multiple of the fundamental frequency (integer multiple of the fundamental frequency: 2f) and (ii) the frequencies each located at the midpoint between two adjacent integer multiples of the fundamental frequency f (adjacent ones of the integer multiples of the fundamental frequency: 3f, 4f, and 5f) (such frequencies at midpoints are, specifically, 3/2f, 5/2f, 7/2f, and 9/2f), a range centered on the frequency at the midpoint and having a predetermined width is referred to as a "between-harmonics range" (specific frequency range). Note that, in the present specification, the range centered on the frequency at the midpoint between the fundamental frequency f and the second harmonic frequency 2f and having a predetermined width is also referred to as a "between-harmonics range", for convenience of description.

In Embodiment 1, the predetermined width of the between-harmonics range is the range centered on the frequency at the midpoint and having a width of ⅓f. Note, however, that the predetermined width is not limited to such, provided that the predetermined width is set appropriately such that: the between-harmonics range is a frequency range lying between adjacent ones of the main peaks in the acoustic spectrum (the peak at the fundamental frequency and peaks at the harmonic frequencies).

In a case where vibration with low sound pressure (for example, power of 10 W) is applied to the interior portion of the hot-dip plating bath 20, a peak appears in the acoustic spectrum also in a between-harmonics range (for example, the range centered on the 3/2 harmonic of the fundamental tone (30 kHz in this case) and having a width of ⅓f) (see FIG. 2). Furthermore, as the power of the ultrasonic transducer 11 increases, the intensity in the between-harmonics ranges also increases (see FIG. 3, which will be discussed later). A reason for such an increase in intensity is unknown; however, for example, the reason may be that that bubbles form and disappear because of the vibration of the hot-dip plating bath 20.

Even when vibration is applied to the steel sheet 2 with use of the ultrasonic horn 10, it is not easy to evaluate what sort of vibration is occurring in the hot-dip plating bath metal 21 because of the applied vibration, that is, it is not easy to evaluate the level of the activity of the vibration-induced activated area 23 in the vicinity of the steel sheet 2. This is because, for example, the viscosity, vapor pressure, density, rate of vibration transfer, acoustic impedance, and the like of the hot-dip plating bath metal 21 vary depending on the composition, temperature, and the like of the hot-dip plating bath 20, for example. That is, the manner in which the vibration of the steel sheet 2 is transferred to the hot-dip plating bath metal 21 is affected by various factors, and therefore it is difficult to evaluate and control the range, the degree of activity, and the like of the vibration-induced activated area 23 based only on the power level of the ultrasonic transducer 11.

Figure 3:
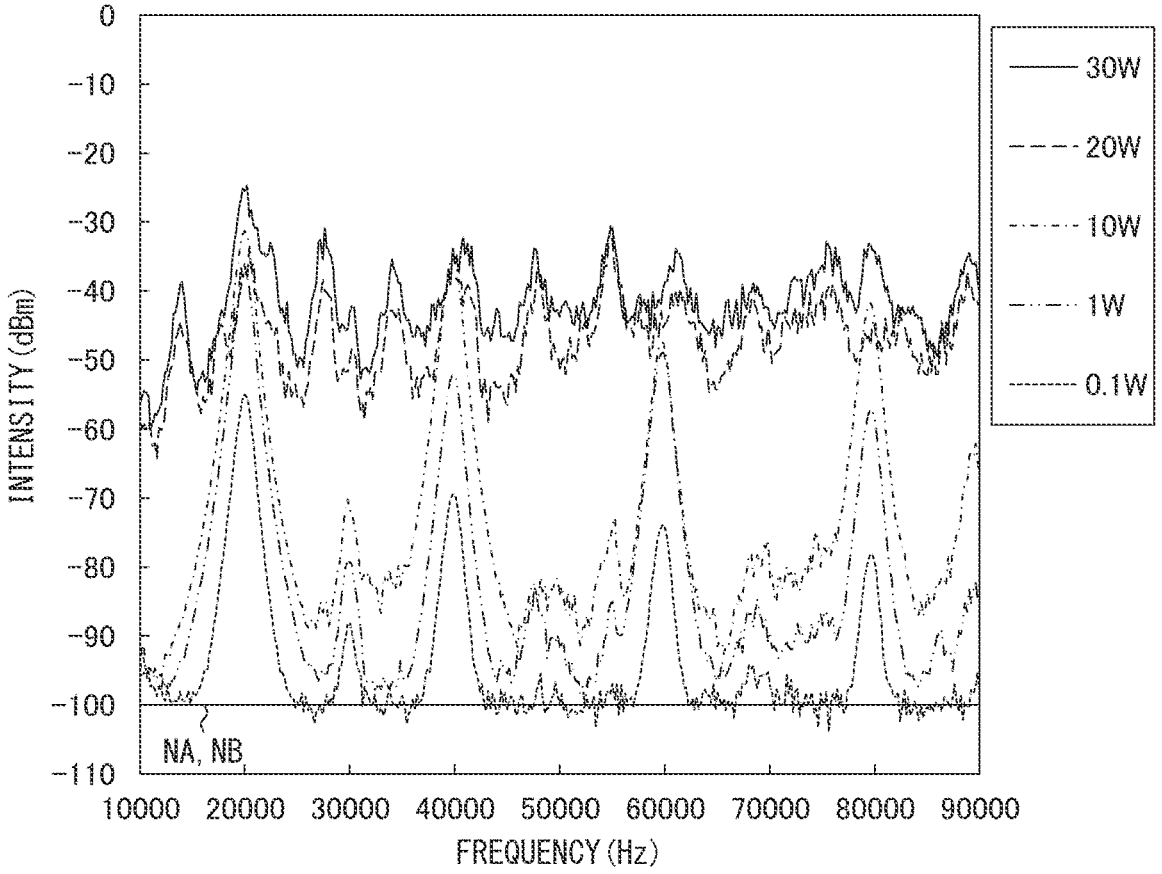
FIG. 3 is a chart showing an example of an acoustic spectrum measured by the spectrum analyzer when ultrasonic power is varied.

In view of this, the inventors of the present invention focused on the ratio between the spectral intensity in the between-harmonics ranges of the acoustic spectrum and the spectral intensity in the entire acoustic spectrum. This is discussed below with reference to FIG. 3. FIG. 3 is a chart showing an example of an acoustic spectrum measured by the spectrum analyzer included in the hot-dip plating apparatus 1 when ultrasonic power is varied. In FIG. 3, the horizontal axis represents frequency (Hz), and the vertical axis represents intensity (dBm). The results shown in FIG. 3 are those obtained when the fundamental frequency was 20 kHz and the ultrasonic power was varied within the range of 0.1 W to 30 W.

As shown in FIG. 3, in a case where the power of the ultrasonic transducer 11 was varied within the range of 0.1 W to 30 W, the intensity of the acoustic spectrum increased to a greater extent throughout the entire frequency range when the power was higher. The intensity of the acoustic spectrum measured by the spectrum analyzer when no vibration is applied to the hot-dip plating bath 20 (the power of the ultrasonic transducer 11 is 0 W) can be regarded as noise. In this measurement system, the level (noise level) when no ultrasonic vibration was applied was −100 dBm.

At each power level, the peak at the fundamental frequency (20 kHz) and the peaks at the harmonic frequencies remarkably appear in the acoustic spectrum measured by the spectrum analyzer, and, also in ranges lying between these peaks (between-harmonics ranges), there are increases and decreases in power level. In the between-harmonics ranges, there are some peaks with relatively small intensity, and the frequencies of these peaks changed variously depending on the power. The inventors of the present invention have found that there is a relationship between the intensity (increase and decrease in intensity) in the between-harmonics ranges and the platability for a steel sheet dipped in the hot-dip plating bath 20. The details are as follows. Note that, in the present specification, the average intensity over the between-harmonics ranges may be referred to as "between-harmonics average intensity".

(a) of FIG. 4 is a chart showing the effects of the ultrasonic power on the average intensity over the entire measured frequency range of the acoustic spectrum and the between-harmonics average intensity. In (a) of FIG. 4, the horizontal axis represents ultrasonic power, and the vertical axis represents average intensity. As shown in (a) of FIG. 4, when the ultrasonic power is equal to or less than 10 W, the between-harmonics average intensity is less than the average intensity over the entire measured frequency range. However, when the ultrasonic power is equal to or more than 20 W, the average intensity over the entire measured frequency range and the between-harmonics average intensity are substantially equal in level.

For more accurate evaluation of the average intensity over the entire measured frequency range and the between-harmonics average intensity, evaluation was carried out using the noise level as a reference. Specifically, the evaluation was carried out such that the average intensity over the entire measured frequency range and the between-harmonics average intensity were evaluated in terms of the ratio of signal intensity to noise level. Then, the relationship between the power and such a ratio between the average intensities relative to noise level was summarized. The results are discussed below with reference to (b) of FIG. 4.

(b) of FIG. 4 is a chart showing the effects of the ultrasonic power on the ratio of the between-harmonics average intensity (relative to noise) to the average intensity over the entire measured frequency range of the acoustic spectrum (relative to noise). In (b) of FIG. 4, the horizontal axis represents ultrasonic power, and the vertical axis represents the ratio between intensities. In the present specification, the ratio between intensities (expression (1) which will be discussed later) may be referred to as "characteristic intensity ratio".

As shown in (b) of FIG. 4, as the ultrasonic power increased from 0.1 W to 20 W, the characteristic intensity ratio increased. When the ultrasonic power was equal to or greater than 20 W, the characteristic intensity ratio was about 1 and substantially constant.

The inventors of the present invention subjected the steel sheet 2 to hot-dip plating with use of the hot-dip plating apparatus 1 while varying the ultrasonic power. As a result, the inventors of the present invention found that, when hot-dip plating is carried out under the conditions in which the characteristic intensity ratio is greater than 0.2, the platability for the steel sheet 2 improves. That is, it is possible to improve the reactivity between the surface of the steel sheet 2 and the hot-clip plating bath metal 21 by applying vibration to the interior portion of the hot-dip plating bath 20 such that the above conditions are satisfied. Specifically, it is possible to obtain a hot-dip plated product in which the rate of holidays in the surface thereof is less than 10%.

The above finding can be summarized as follows.

Specifically, a hot-dip plating method in accordance with an aspect of the present invention includes a plating step including: causing a steel material to advance into a plating bath which is a molten metal; and allowing the steel material to be coated with the molten metal while applying vibration to the plating bath while the steel material is in contact with the molten metal. The frequency of the vibration applied to the plating bath is a fundamental frequency. In the plating step, the vibration is applied such that an acoustic spectrum measured in the plating bath satisfies the relationship represented by the following expression (1):

$$(IB-NB)/(IA-NA)>0.2, \quad (1)$$

where

IA is the average sound pressure level over the entire measured frequency range, IB is the average sound pressure level over specific frequency ranges including (i) a range lying between a sound pressure peak at a fundamental frequency and a sound pressure peak at a second-harmonic frequency and (ii) each range lying between sound pressure peaks at adjacent ones of integer (integer of 2 or more) multiples of the fundamental frequency, NA is the average sound pressure level over the entire measured frequency range when the vibration is not applied, and NB is the average sound pressure level over the specific frequency ranges defined for the IB when the vibration is not applied.

(Vibration Frequency, Power)

In the foregoing example, the ultrasonic horn 10 applies vibration at a frequency of 20 kHz to the steel sheet 2 using the vibration of the ultrasonic transducer 11. However, this does not imply any limitation. For example, the ultrasonic horn 10 may apply vibration at a frequency of 15 kHz to 150 kHz to the steel sheet 2. The intensity of vibration applied by the ultrasonic horn 10 to the steel sheet 2 (power of the ultrasonic transducer 11) need only be set such that an acoustic spectrum satisfying the relationship of the foregoing expression (1) is generated in the hot-dip plating bath. For example, it is only necessary to study, in advance, what degree of power of the ultrasonic transducer 11 causes an acoustic spectrum satisfying the relationship of the expression (1) to be generated in the hot-dip plating bath, for various factors concerning the steel sheet and the hot-dip plating bath 20 etc.

Advantageous Effects

As has been described, in a hot-dip plating method in accordance with an aspect of the present invention, vibration that satisfies certain conditions (satisfies the relationship of the expression (1)) is applied to the steel sheet 2 while the steel sheet 2 and the hot-dip plating bath 20 are in contact with each other. With this, the bath surface oxide 22 and atmospheric air trapped in the hot-dip plating bath 20 are dispersed in the bath. That is, the reaction inhibiting part is dispersed in the bath. Furthermore, the following effects are brought about, for example: mass transfer is accelerated at the interface between the steel sheet 2 and the hot-dip plating bath 20 and the thickness of the boundary layer decreases or the mass transfer rate increases. This achieves plating wettability between the steel sheet 2 and the hot-dip plating bath 20. Therefore, the reaction between the hot-dip plating bath metal 21 and the steel sheet 2 proceeds smoothly. As result, even in cases where the steel sheet 2 not subjected to a heat treatment (reduction treatment) beforehand is used, it is possible to achieve good platability for the steel sheet 2. This makes it possible to provide a hot-dip plating method that achieves good plating wettability between the hot-dip plating bath metal 21 and the steel sheet 2 and that makes it possible to reduce the amount of consumed energy as compared to conventional techniques.

Furthermore, the hot-dip plating method in accordance with an aspect of the present invention eliminates the need for a flux treatment. This makes it possible to reduce running costs and improve work environments.

Moreover, when newly introducing hot-dip plating equipment, the hot-dip plating method in accordance with an aspect of the present invention eliminates the need for the cost and materials for the installment of a heating furnace, and thus possible to reduce introduction costs. Furthermore, since the heating furnace is long, it is also possible to reduce the total length of the hot-dip plating equipment because the installation of the heating furnace is not necessary.

(Pre-Treatment)

In the hot-dip plating method in accordance with Embodiment 1, a heat treatment and/or a reduction treatment, prior to the hot-dip plating treatment (plating step), can be omitted. In the hot-dip plating method in accordance with Embodiment 1, a lesser degree of heat treatment and a lesser degree of reduction treatment than conventional techniques may be carried out with respect to the steel sheet 2 prior to the plating step. In such a case, it is possible to reduce the amount of energy consumed in the treatments.

Note that the steel sheet 2 may be subjected to pre-treatment(s) prior to the hot-dip plating treatment. For example, a reduction treatment may be carried out as a pre-treatment prior to the plating step. The steel sheet 2 may be subjected to a degreasing treatment and/or a pickling treatment, according to need. In the present hot-dip plating method, a degreasing treatment and a pickling treatment may be carried out with respect to the steel sheet 2 as pre-treatments prior to the coting step, and at least a degreasing treatment is particularly preferably carried out. A pickling treatment may be carried out subsequent to the degreasing treatment.

(Other Features)

In a hot-dip plating method in accordance with an aspect of the present invention, the measured frequency range may include the fundamental frequency and have a frequency range that is equal to or greater than four times the fundamental frequency. For example, the measured frequency range may be a range of 10 kHz to 90 kHz, inclusive.

The range lying between peaks, i.e., the specific frequency range, may be a frequency range centered on the frequency $(n+(1/2))f$ (n is a natural number) and having a width of $(1/3)f$, where f is the fundamental frequency.

In the plating step, the vibration may be applied to the interior portion of the plating bath with use of a vibration generator (ultrasonic horn 10) and the power of the vibration generator may be not less than 0.5 W. In the present hot-dip plating method, the power of the vibration generator may be not less than 0.5 W and not more than 30 W, and the frequency of the vibration applied to the hot-dip plating bath 20 through the steel sheet 2 may be not lower than 15 kHz and not higher than 150 kHz. The vibration generator may apply vibration at a frequency of not lower than 15 kHz and not higher than 1.50 kHz to the hot-dip plating bath 20, and the power may be not less than 1 W and not more than 30 W or may be not less than 5 W and not more than 30 W.

In the plating step, the time for which the vibration is applied to the interior portion of the plating bath using the vibration generator may be not less than 2 seconds and not more than 90 seconds. In the plating step, the temperature of the steel sheet 2 immediately before dipped in the hot-dip plating bath 20 ((such a temperature is "inlet temperature") may be room temperature, for example, may be not higher than 100° C. or may be not higher than 50° C.

In the plating step, a vibration sensing unit (such as the vibration sensor 32, the amplifier 33, the spectrum analyzer 34) is used to measure the acoustic spectrum in the plating bath. The distance between the location where the vibration is sensed in the plating bath and the steel sheet 2 may be not less than 1 mm and not more than 10 mm. The distance is measured before the ultrasonic horn 10 starts vibrating, under the conditions in which the steel sheet 2 is clipped in the hot-dip plating bath 20.

Example 1

The following description will discuss an example of the hot-dip plating method in accordance with Embodiment 1 of the present invention.

In Example 1, a hot-dip plating apparatus illustrated in FIG. 5 was used as an apparatus that carries out the hot-dip plating method in accordance with Embodiment 1 of the present invention. FIG. 5 schematically illustrates an example of a hot-dip plating apparatus used in cases where a hot-dip plating method in accordance with an aspect of the present invention is employed in dip plating in an air atmosphere.

As illustrated in FIG. 5, a hot-dip plating apparatus 40 includes a crucible furnace 41 and a carbon crucible 42 contained in the crucible furnace 41, and heats the carbon crucible 42 by causing resistance heating to occur in a heating zone 43. The carbon crucible 42 contains a hot-dip plating bath metal 21 therein, and there is a bath surface oxide 22 on the surface of the hot-dip plating bath metal 21. In the hot-dip plating apparatus 40, the surface of the hot-dip plating bath metal 21 is in an air atmosphere.

The hot-dip plating apparatus 40 includes an ultrasonic horn 10, and the ultrasonic horn 10 has a steel sheet 2 fixed at the tip thereof, as with the foregoing hot-dip plating apparatus 1 (see FIG. 1). An ultrasonic transducer 11 of the ultrasonic horn 10 receives an ultrasonic signal supplied from an ultrasonic power supply apparatus D1 (including oscillator 13, power amplifier 14, and power meter 15), and applies vibration to the steel sheet 2 at a power level set by the ultrasonic power supply apparatus D1.

TABLE 1

| Steel sheet | Steel type | Components (mass %) C | Si | Mn | P | S |
|---|---|---|---|---|---|---|
| A | Weakly deoxidized steel | 0.033 | <0.01 | 0.23 | <0.01 | 0.013 |
| B | High-Si, High-Mn alloy steel | 0.11 | 1.48 | 1.33 | 0.014 | 0.001 |

TABLE 2

| Steel sheet | Steel type | Components (mass %) C | Si | Mn | P | S | Cr | Ti | Al | Ni | Nb | Mo |
|---|---|---|---|---|---|---|---|---|---|---|---|---|
| C | SUS430 | 0.062 | 0.11 | 0.25 | 0.010 | 0.006 | 16.19 | — | 0.004 | — | — | — |
| D | SUS, high-Al steel | 0.010 | 0.33 | 0.20 | 0.032 | tr. | 18.03 | 0.15 | 3.080 | 0.25 | — | — |
| E | SUS, high-Cr steel | 0.004 | 0.16 | 0.15 | 0.030 | 0.001 | 22.14 | 0.15 | 0.057 | — | 0.21 | 1.16 |
| F | SUS, high-Si steel | 0.010 | 0.90 | 1.10 | — | — | 14.00 | 0.20 | — | — | — | — |

A commercial bolt-clamped Langevin type transducer can be used as the ultrasonic transducer 11. An aluminum ultrasonic horn, a titanium ultrasonic horn, a ceramic ultrasonic horn, or the like can be used as the ultrasonic horn 10.

The hot-dip plating apparatus 40 further includes, as a measuring unit 50 that measures an acoustic spectrum (corresponding to the measuring unit 30 of FIG. 1), a waveguide probe 51, an acoustic emission sensor (hereinafter may be referred to as "AE sensor") 52, and a measuring section 53. The measuring section 53 includes a spectrum analyzer and an amplifier. One end of a waveguide probe 51 is dipped in the hot-dip plating bath metal 21, and the other end is connected to the AE sensor 52.

Specifically, pieces of equipment used in the hot-dip plating apparatus 40 in accordance with Example 1 are as follows.

(Ultrasonic Vibration Supply System)

Ultrasonic transducer 11: bolt-clamped Langevin type transducer manufactured by HONDA ELECTRONICS Co., LTD.

Ultrasonic horn 10: material is <Aluminum alloy A2024A>

Oscillator 13: 33220A manufactured by Agilent Technologies Japan, Ltd.

Power amplifier 14: M-2141 manufactured by MESS-TEK Co., Ltd.

Power meter 15: PW-3335 manufactured by HIOKI E. E. CORPORATION (Ultrasonic Vibration Measuring System)

Waveguide probe 51: Material is <SUS430>, φ6 mm×300 mm.

AE sensor 52: AE-900M manufactured by N F Corporation

Amplifier: AE9922 manufactured by N F Corporation

Spectrum analyzer: E4408B manufactured by Agilent Technologies Japan, Ltd.

Furthermore, in Example 1, carbon steel (steel type A or steel type B) shown in the following Table 1 or stainless steel (any of steel type C to steel type F) shown in the following Table 2 was used as the steel sheet 2 (substrate to be plated, hereinafter "substrate"). The steel types A to F are all annealed materials.

Note that, in Table 2, the "-" symbols indicate that component analysis was not carried out, and the "tr." indicates that the quantity was less than the minimum detectable quantity.

Example 1-1: Zn—Al—Mg-Based Hot-Dip Plating Bath Type was Used

Each of the steel sheets A to F shown in Tables 1 and 2 was subjected to alkaline degreasing and a pickling treatment using 10% hydrochloric acid, as pre-treatments. Dip plating was carried out in the following manner: each of the steel sheets after the pre-treatments was attached to the tip of the ultrasonic horn 10, dipped in a Zn—Al—Mg-based hot-dip plating bath to a depth of 60 mm (in other words, the dimension, along the depth direction of the plating bath, of a part of the steel sheet which part was dipped in the bath was 60 mm), and kept in the bath for 100 seconds. In cases where vibration was applied to the steel sheet, the application of vibration was started 10 seconds after the start of dipping of the steel sheet attached to the tip of the ultrasonic horn 10 in the hot-dip plating bath, and the application of vibration was continued for 90 seconds.

The composition of the hot-dip plating bath was as follows: 6 mass % of Al, 3 mass % of Mg, and 0.025 mass % of Si, with the balance being Zn. The temperature of the hot-dip plating bath was 380° C. to 550° C., and, in cases where vibration was applied to the interior portion of the hot-dip plating bath, the fundamental frequency and the power of the ultrasonic transducer 11 were varied. As Comparative Examples, dip plating was carried out without applying vibration to the interior portion of the hot-dip plating bath.

Evaluation of platability was carried out in the following manner using the samples after subjected to dip plating as sample materials. FIG. 6 is a side view illustrating how a plated sample material 3 looks like. As illustrated in FIG. 6, the plated sample material 3 has a plated area 3*a* which has been subjected to hot-dip plating. In a part of the plated area 3*a*, a holiday 4, which has no plating, can exist.

For example, assume that the dimension along the depth direction of a part of the sample material 3 which part was dipped in the hot-dip plating bath is L11, and that the width of the sample material 3 is L12. In such a case, on the sheet surfaces (both surfaces) shown in FIG. 6, the ideal area a of the plated area is L11×L12×2. Furthermore, the area β of the holiday(s) 4 is measured with use of a known area measuring means. The area β of the holiday(s) 4 is the sum of measured area(s) of holiday(s) 4 on the both plated surfaces (both sheet surfaces) of the sample material 3. Then, calculation was carried out using (β/a)×100 to obtain the holiday rate. The platability for the sample material 3 was evaluated on the basis of the following criteria, and those evaluated as "Fair" or better were regarded as acceptable.

Excellent: holiday rate is 0%

Good: holiday rate is more than 0% and less than 1%

Fair: holiday rate is not less than 1% and less than 10%

Poor: holiday rate is not less than 10% and less than 80%

Very poor: holiday rate is not less than 80%

The results of the test are collectively shown in Table 3. In Table 3, the "substrate" is a steel sheet, and "whether substrate was heated or not" means whether the steel sheet was heated prior to hot-dip plating or not. The "inlet temperature" means the temperature of the steel sheet at the point in time in which the steel sheet was introduced into the hot-dip plating bath. The "acoustic intensity" (relative to noise) in Table 3 is determined using IA−NA, the "average intensity over ranges each lying between integer multiple harmonics" (i.e., between-harmonics average intensity relative to noise) is determined using IB−NB, and the "ratio of the average intensity over ranges each lying between integer multiple harmonics to the acoustic intensity" (characteristic intensity ratio) is determined using (IB−NB)/(IA−NA) (the symbols are as defined earlier with respect to the expression (1)). The above matters apply also to the following descriptions in the present specification.

TABLE 3

| No. | Thickness of sheet (mm) | Substrate | Plating bath type | Plating bath atmosphere | Whether substrate was heated or not | Inlet temperature | Plating bath temperature (° C.) | Frequency (kHz) | Power (W) |
|---|---|---|---|---|---|---|---|---|---|
| 1 | 0.8 | A | Zn—Al—Mg base | Atmospheric air | Not | Room temperature | 450 | 15 | 0.5 |
| 2 | 0.8 | A | | | | | | 15 | 1 |
| 3 | 0.8 | A | | | | | | 15 | 5 |
| 4 | 0.8 | A | | | | | | 15 | 10 |
| 5 | 0.8 | A | | | | | | 15 | 20 |
| 6 | 0.8 | A | | | | | | 15 | 30 |
| 7 | 0.8 | A | | | | | 380 | 15 | 20 |
| 8 | 0.8 | A | | | | | 400 | 15 | 20 |
| 9 | 0.8 | A | | | | | 500 | 15 | 20 |
| 10 | 0.8 | A | | | | | 550 | 15 | 20 |
| 11 | 0.8 | A | | | | | 450 | 20 | 20 |
| 12 | 0.8 | A | | | | | | 30 | 20 |
| 13 | 0.8 | A | | | | | | 40 | 20 |
| 14 | 0.8 | A | | | | | | 70 | 20 |
| 15 | 0.8 | A | | | | | | 108 | 20 |
| 16 | 1.4 | A | | | | | | 15 | 20 |
| 17 | 1.4 | B | | | | | | 15 | 20 |
| 18 | 0.8 | C | | | | | | 15 | 20 |
| 19 | 1.0 | D | | | | | | 15 | 20 |
| 20 | 1.0 | E | | | | | | 15 | 20 |
| 21 | 1.1 | F | | | | | | 15 | 20 |
| 22 | 0.8 | A | Zn—Al—Mg base | Atmospheric air | Not | Room temperature | 450 | 15 | 0.05 |
| 23 | 0.8 | A | | | | | | 15 | 0.1 |
| 24 | 0.8 | A | | | | | | 15 | 0.3 |
| 25 | 0.8 | A | | | | | | No vibration application | |
| 26 | 1.4 | B | | | | | | | |
| 27 | 0.8 | C | | | | | | | |
| 28 | 1.0 | D | | | | | | | |
| 29 | 1.0 | E | | | | | | | |
| 30 | 1.1 | F | | | | | | | |

| | Acoustic spectrum in bath | | | | |
|---|---|---|---|---|---|
| No. | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 1 | 11.2 | 3.1 | 0.28 | Fair | Examples |
| 2 | 15.8 | 8.8 | 0.56 | Good | |
| 3 | 28.3 | 18.0 | 0.64 | Excellent | |
| 4 | 25.8 | 18.4 | 0.71 | Excellent | |
| 5 | 56.3 | 54.9 | 0.98 | Excellent | |
| 6 | 57.9 | 56.9 | 0.98 | Excellent | |
| 7 | 56.3 | 54.9 | 0.98 | Excellent | |
| 8 | 54.9 | 54.0 | 0.98 | Excellent | |
| 9 | 57.9 | 56.9 | 0.98 | Excellent | |
| 10 | 57.3 | 56.9 | 0.99 | Excellent | |
| 11 | 53.2 | 52.8 | 0.99 | Excellent | |
| 12 | 55.2 | 54.3 | 0.98 | Excellent | |
| 13 | 57.5 | 56.3 | 0.98 | Excellent | |

TABLE 3-continued

| | | | | | |
|---|---|---|---|---|---|
| 14 | 54.9 | 53.3 | 0.97 | Excellent | |
| 15 | 56.4 | 55.4 | 0.98 | Excellent | |
| 16 | 53.2 | 52.9 | 0.99 | Excellent | |
| 17 | 54.5 | 54.0 | 0.99 | Excellent | |
| 18 | 57.8 | 56.9 | 0.98 | Excellent | |
| 19 | 57.8 | 56.9 | 0.98 | Excellent | |
| 20 | 56.3 | 54.7 | 0.97 | Excellent | |
| 21 | 56.4 | 54.2 | 0.96 | Excellent | |
| 22 | 3.1 | 0.2 | 0.06 | Poor | Comparative |
| 23 | 4.4 | 0.5 | 0.11 | Poor | Examples |
| 24 | 9.2 | 1.5 | 0.16 | Poor | |
| 25 | — | — | — | Very poor | |
| 26 | — | — | — | Very poor | |
| 27 | — | — | — | Very poor | |
| 28 | — | — | — | Very poor | |
| 29 | — | — | — | Very poor | |
| 30 | — | — | — | Very poor | |

As shown in Nos. 1 to 21 of Table 3, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate was less than 10%. In examples shown in Nos. 3 to 21 in which the power was 5 W to 20 W, the holiday rate of the plated product was 0%.

In contrast, in cases where the vibration applied to the interior portion of the hot-dip plating bath was too weak (sound pressure level was too low), an acoustic spectrum within the scope of the present invention was not measured in the hot-dip plating bath, and, as shown in Nos. No. 22 to 24 of Table 3, the holiday rate of the plated product was 10% or more. Furthermore, in cases where hot-dip plating was carried out without applying vibration to the interior portion of the hot-dip plating bath, the holiday rate of the plated product was 80% or more as shown in Nos. 25 to 30 of Table 3.

Example 1-2: Al—Si-Based Hot-Dip Plating Bath Type was Used

An Al-9mass % Si-2mass % Fe-based plating bath was used as a hot-dip plating bath, and each of the steel sheets shown in Tables 1 and 2 was subjected to dip plating. The temperature of the hot-dip plating bath was 630° C. to 700° C., the time for which the steel sheet was dipped in the hot-dip plating bath was 12 seconds, and, in cases where the steel sheet was vibrated, the application of vibration was started 10 seconds after the start of dipping of the steel sheet in the hot-dip plating bath, and the application of vibration was continued for 2 seconds. In cases where the steel sheet was vibrated, the fundamental frequency was 15 kHz, and the power of the ultrasonic transducer 11 was set to 10 W or varied within the range of 0.05 W to 0.3 W. Except for those described above, Example 1-2 was carried out in the same manner as Example 1-1. The results of the test are collectively shown in Table 4.

TABLE 4

| No. | Thickness of sheet (mm) | Substrate | Plating bath type | Plating bath atmosphere | Whether substrate was heated or not | Inlet temperature | Plating bath temperature (° C.) | Frequency (kHz) | Power (W) |
|---|---|---|---|---|---|---|---|---|---|
| 41 | 0.8 | A | Al—9%Si | Atmospheric | Not | Room | 630 | 15 | 10 |
| 42 | 0.8 | A | base | air | | temperature | 660 | 15 | 10 |
| 43 | 0.8 | A | | | | | 700 | 15 | 10 |
| 44 | 1.4 | B | | | | | 660 | 15 | 10 |
| 45 | 0.8 | C | | | | | | 15 | 10 |
| 46 | 1.0 | D | | | | | | 15 | 10 |
| 47 | 1.0 | E | | | | | | 15 | 10 |
| 48 | 1.1 | F | | | | | | 15 | 10 |
| 49 | 0.8 | A | Al—9%Si | Atmospheric | Not | Room | 660 | 15 | 0.05 |
| 50 | 0.8 | A | base | air | | temperature | | 15 | 0.1 |
| 51 | 0.8 | A | | | | | | 15 | 0.3 |
| 52 | 0.8 | A | | | | | | No vibration | |
| 53 | 1.4 | B | | | | | | application | |
| 54 | 0.8 | C | | | | | | | |
| 55 | 1.0 | D | | | | | | | |
| 56 | 1.0 | E | | | | | | | |
| 57 | 1.1 | F | | | | | | | |

TABLE 4-continued

| No. | Acoustic spectrum in bath: Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
|---|---|---|---|---|---|
| 41 | 25.0 | 13.1 | 0.52 | Excellent | Examples |
| 42 | 25.1 | 13.2 | 0.53 | Excellent | |
| 43 | 26.7 | 15.1 | 0.57 | Excellent | |
| 44 | 26.1 | 15.2 | 0.58 | Excellent | |
| 45 | 25.5 | 15.5 | 0.61 | Excellent | |
| 46 | 24.4 | 13.3 | 0.55 | Excellent | |
| 47 | 25.3 | 15.1 | 0.60 | Excellent | |
| 48 | 24.9 | 14.1 | 0.57 | Excellent | |
| 49 | 3.0 | 0.2 | 0.07 | Poor | Comparative |
| 50 | 4.9 | 0.3 | 0.06 | Poor | Examples |
| 51 | 8.9 | 1.1 | 0.12 | Poor | |
| 52 | — | — | — | Very poor | |
| 53 | — | — | — | Very poor | |
| 54 | — | — | — | Very poor | |
| 55 | — | — | — | Very poor | |
| 56 | — | — | — | Very poor | |
| 57 | — | — | — | Very poor | |

As shown in Nos. 41 to 48 of Table 4, in cases where a steel sheet was subjected to clip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was 0%.

In contrast, in cases where the vibration applied to the interior portion of the hot-dip plating bath was too weak (sound pressure level was too low), an acoustic spectrum within the scope of the present invention was not measured in the hot-dip plating bath, and, as shown in Nos. 49 to 51 of Table 4, the holiday rate of the plated product was 10% or more. Furthermore, in cases where hot-dip plating was carried out without applying vibration to the interior portion of the hot-dip plating bath, the holiday rate of the plated product was 80% or more as shown in Nos. 52 to 57 of Table 4.

Example 1-3: Various Hot-Dip Plating Bath Types were Used

Each of various hot-dip plating baths, shown in Example 2 (Example 2-3) of Embodiment 3, was used as a hot-dip plating bath, and each of the steel sheets A to F shown in Tables 1 and 2 was subjected to dip plating. The compositions of hot-dip plating baths M1 to M10 are shown in Table 8 of Example 2, and the composition of a hot-dip plating bath M12 is shown in Table 9 of Example 2. The plating bath type M11 is an Al-2mass % Fe-based plating bath, and the temperature of the bath is 700° C. (the plating bath type M11 had no Si added thereto, differently from the Al-9mass % Si-2mass % Fe-based plating bath used in the test shown in Table 4).

The time for which the steel sheet was dipped the hot-dip plating bath was 12 seconds, and, in cases where the steel sheet was vibrated, the application of vibration was started 10 seconds after the start of dipping of the steel sheet in the hot-dip plating bath, and the application of vibration was continued for 2 seconds.

In Examples in Example 1-3, vibration was applied to the interior portion of the hot-dip plating bath under the conditions in which the fundamental frequency and the power of the ultrasonic transducer 11 were constant, i.e., the fundamental frequency was set to 15 kHz and the power of the ultrasonic transducer 11 was set to 20 W. In Comparative Examples, dip plating was carried out without applying vibration to the interior portion of the hot-clip plating bath. In Examples and Comparative Examples, the steel sheets A to F used had a thickness of 0.8 mm.

Example 1-3 was carried out in the same manner as Example 1-1, except for the above matters. The results of the test are collectively shown in Table 5.

TABLE 5

| No. | Thickness of sheet (mm) | Substrate | Plating bath type | Plating bath atmosphere | Whether substrate was heated or not | Inlet temperature | Plating bath temperature (° C.) | Frequency (kHz) | Power (W) |
|---|---|---|---|---|---|---|---|---|---|
| 231 | 0.8 | A | M1 | Atmospheric air | Not | Room temperature | 430 | 15 | 20 |
| 232 | | | M2 | | | | 430 | | |
| 233 | | | M3 | | | | 430 | | |
| 234 | | | M4 | | | | 430 | | |
| 235 | | | M5 | | | | 450 | | |
| 236 | | | M6 | | | | 450 | | |
| 237 | | | M7 | | | | 470 | | |
| 238 | | | M8 | | | | 660 | | |
| 239 | | | M9 | | | | 660 | | |

TABLE 5-continued

| | | | | | | | | | |
|---|---|---|---|---|---|---|---|---|---|
| 240 | | | M10 | | | | 660 | | |
| 241 | | | M11 | | | | 700 | | |
| 242 | | | M12 | | | | 280 | | |
| 243 | 0.8 | B | M1 | Atmospheric air | Not | Room temperature | 430 | 15 | 20 |
| 244 | | | M2 | | | | 430 | | |
| 245 | | | M3 | | | | 430 | | |
| 246 | | | M4 | | | | 430 | | |
| 247 | | | M5 | | | | 450 | | |
| 248 | | | M6 | | | | 450 | | |
| 249 | | | M7 | | | | 470 | | |
| 250 | | | M8 | | | | 660 | | |
| 251 | | | M9 | | | | 660 | | |
| 252 | | | M10 | | | | 660 | | |
| 253 | | | M11 | | | | 700 | | |
| 254 | | | M12 | | | | 280 | | |
| 255 | 0.8 | C | M1 | Atmospheric air | Not | Room temperature | 430 | 15 | 20 |
| 256 | | | M2 | | | | 430 | | |
| 257 | | | M3 | | | | 430 | | |
| 258 | | | M4 | | | | 430 | | |
| 259 | | | M5 | | | | 450 | | |
| 260 | | | M6 | | | | 450 | | |
| 261 | | | M7 | | | | 470 | | |
| 262 | | | M8 | | | | 660 | | |
| 263 | | | M9 | | | | 660 | | |
| 264 | | | M10 | | | | 660 | | |
| 265 | | | M11 | | | | 700 | | |
| 266 | | | M12 | | | | 280 | | |
| 267 | 0.8 | D | M1 | Atmospheric air | Not | Room temperature | 430 | 15 | 20 |
| 268 | | | M2 | | | | 430 | | |
| 269 | | | M3 | | | | 430 | | |
| 270 | | | M4 | | | | 430 | | |
| 271 | | | M5 | | | | 450 | | |
| 272 | | | M6 | | | | 450 | | |
| 273 | | | M7 | | | | 470 | | |
| 274 | | | M8 | | | | 660 | | |
| 275 | | | M9 | | | | 660 | | |
| 276 | | | M10 | | | | 660 | | |
| 277 | | | M11 | | | | 700 | | |
| 278 | | | M12 | | | | 280 | | |
| 279 | 0.8 | E | M1 | Atmospheric air | Not | Room temperature | 430 | 15 | 20 |
| 280 | | | M2 | | | | 430 | | |
| 281 | | | M3 | | | | 430 | | |
| 282 | | | M4 | | | | 430 | | |
| 283 | | | M5 | | | | 450 | | |
| 284 | | | M6 | | | | 450 | | |
| 285 | | | M7 | | | | 470 | | |
| 286 | | | M8 | | | | 660 | | |
| 287 | | | M9 | | | | 660 | | |
| 288 | | | M10 | | | | 660 | | |
| 289 | | | M11 | | | | 700 | | |
| 290 | | | M12 | | | | 280 | | |
| 291 | 0.8 | F | M1 | Atmospheric air | Not | Room temperature | 430 | 15 | 20 |
| 292 | | | M2 | | | | 430 | | |
| 293 | | | M3 | | | | 430 | | |
| 294 | | | M4 | | | | 430 | | |
| 295 | | | M5 | | | | 450 | | |
| 296 | | | M6 | | | | 450 | | |
| 297 | | | M7 | | | | 470 | | |
| 298 | | | M8 | | | | 660 | | |
| 299 | | | M9 | | | | 660 | | |
| 300 | | | M10 | | | | 660 | | |
| 301 | | | M11 | | | | 700 | | |
| 302 | | | M12 | | | | 280 | | |
| 303 | 0.8 | A | M1 | Atmospheric air | Not | Room temperature | 430 | No vibration application | |
| 304 | | | M2 | | | | 430 | | |
| 305 | | | M3 | | | | 430 | | |
| 306 | | | M4 | | | | 430 | | |
| 307 | | | M5 | | | | 450 | | |
| 308 | | | M6 | | | | 450 | | |
| 309 | | | M7 | | | | 470 | | |
| 310 | | | M8 | | | | 660 | | |
| 311 | | | M9 | | | | 660 | | |
| 312 | | | M10 | | | | 660 | | |
| 313 | | | M11 | | | | 700 | | |
| 314 | | | M12 | | | | 280 | | |

TABLE 5-continued

| No. | Acoustic spectrum in bath: Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
|---|---|---|---|---|---|
| 231 | 55.2 | 54.3 | 0.98 | Excellent | Examples |
| 232 | 54.9 | 53.3 | 0.97 | Excellent | |
| 233 | 56.3 | 54.9 | 0.98 | Excellent | |
| 234 | 53.2 | 52.8 | 0.99 | Excellent | |
| 235 | 54.5 | 54.0 | 0.99 | Excellent | |
| 236 | 57.8 | 56.9 | 0.98 | Excellent | |
| 237 | 56.2 | 54.9 | 0.98 | Excellent | |
| 238 | 56.3 | 54.8 | 0.97 | Excellent | |
| 239 | 56.3 | 54.5 | 0.97 | Excellent | |
| 240 | 56.1 | 54.0 | 0.96 | Excellent | |
| 241 | 57.7 | 56.8 | 0.98 | Excellent | |
| 242 | 57.8 | 56.1 | 0.97 | Excellent | |
| 243 | 55.1 | 54.4 | 0.99 | Excellent | |
| 244 | 54.8 | 53.4 | 0.97 | Excellent | |
| 245 | 56.5 | 54.6 | 0.97 | Excellent | |
| 246 | 53.4 | 52.9 | 0.99 | Excellent | |
| 247 | 54.6 | 54.1 | 0.99 | Excellent | |
| 248 | 57.7 | 56.8 | 0.98 | Excellent | |
| 249 | 56.0 | 54.7 | 0.98 | Excellent | |
| 250 | 56.2 | 54.6 | 0.97 | Excellent | |
| 251 | 56.5 | 54.6 | 0.97 | Excellent | |
| 252 | 56.3 | 54.2 | 0.96 | Excellent | |
| 253 | 53.4 | 52.9 | 0.99 | Excellent | |
| 254 | 57.9 | 56.3 | 0.97 | Excellent | |
| 255 | 54.9 | 54.5 | 0.99 | Excellent | |
| 256 | 54.7 | 53.4 | 0.98 | Excellent | |
| 257 | 56.6 | 54.7 | 0.97 | Excellent | |
| 258 | 53.4 | 52.4 | 0.98 | Excellent | |
| 259 | 54.5 | 54.2 | 0.99 | Excellent | |
| 260 | 57.7 | 56.8 | 0.98 | Excellent | |
| 261 | 56.1 | 54.8 | 0.98 | Excellent | |
| 262 | 56.2 | 54.6 | 0.97 | Excellent | |
| 263 | 56.6 | 54.6 | 0.96 | Excellent | |
| 264 | 56.2 | 54.3 | 0.97 | Excellent | |
| 265 | 56.1 | 54.8 | 0.98 | Excellent | |
| 266 | 57.8 | 56.0 | 0.97 | Excellent | |
| 267 | 55.2 | 54.3 | 0.98 | Excellent | |
| 268 | 53.4 | 52.9 | 0.99 | Excellent | |
| 269 | 54.5 | 54.2 | 0.99 | Excellent | |
| 270 | 53.2 | 52.7 | 0.99 | Excellent | |
| 271 | 56.2 | 54.6 | 0.97 | Excellent | |
| 272 | 56.6 | 54.6 | 0.96 | Excellent | |
| 273 | 56.2 | 54.9 | 0.98 | Excellent | |
| 274 | 54.6 | 53.4 | 0.98 | Excellent | |
| 275 | 57.7 | 56.6 | 0.98 | Excellent | |
| 276 | 56.1 | 54.1 | 0.96 | Excellent | |
| 277 | 54.6 | 54.1 | 0.99 | Excellent | |
| 278 | 57.8 | 56.1 | 0.97 | Excellent | |
| 279 | 55.2 | 54.3 | 0.98 | Excellent | |
| 280 | 54.9 | 53.3 | 0.97 | Excellent | |
| 281 | 54.6 | 54.1 | 0.99 | Excellent | |
| 282 | 56.5 | 54.6 | 0.97 | Excellent | |
| 283 | 53.4 | 52.9 | 0.99 | Excellent | |
| 284 | 54.6 | 54.1 | 0.99 | Excellent | |
| 285 | 56.2 | 54.6 | 0.97 | Excellent | |
| 286 | 56.6 | 54.6 | 0.96 | Excellent | |
| 287 | 56.3 | 54.5 | 0.97 | Excellent | |
| 288 | 56.1 | 54.1 | 0.96 | Excellent | |
| 289 | 56.6 | 54.6 | 0.96 | Excellent | |
| 290 | 57.8 | 56.1 | 0.97 | Excellent | |
| 291 | 56.5 | 54.6 | 0.97 | Excellent | |
| 292 | 56.3 | 54.5 | 0.97 | Excellent | |
| 293 | 56.1 | 54.1 | 0.96 | Excellent | |
| 294 | 57.7 | 56.8 | 0.98 | Excellent | |
| 295 | 56.1 | 54.8 | 0.98 | Excellent | |
| 296 | 56.2 | 54.6 | 0.97 | Excellent | |
| 297 | 56.2 | 54.9 | 0.98 | Excellent | |
| 298 | 56.5 | 54.6 | 0.97 | Excellent | |
| 299 | 53.4 | 52.9 | 0.99 | Excellent | |
| 300 | 56.1 | 54.1 | 0.96 | Excellent | |
| 301 | 53.4 | 52.9 | 0.99 | Excellent | |

TABLE 5-continued

| | | | | | |
|---|---|---|---|---|---|
| 302 | 57.8 | 56.1 | 0.97 | Excellent | |
| 303 | — | — | — | Very poor | Comparative |
| 304 | — | — | — | Very poor | Examples |
| 305 | — | — | — | Very poor | |
| 306 | — | — | — | Very poor | |
| 307 | — | — | — | Very poor | |
| 308 | — | — | — | Very poor | |
| 309 | — | — | — | Very poor | |
| 310 | — | — | — | Very poor | |
| 311 | — | — | — | Very poor | |
| 312 | — | — | — | Very poor | |
| 313 | — | — | — | Very poor | |
| 314 | — | — | — | Very poor | |

As shown in Nos. 231 to 302 of Table 5, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was 0%.

In contrast, in cases where hot-dip plating was carried out without applying vibration to the interior portion of the hot-dip plating bath, the holiday rate of the plated product was 80% or more as shown in Nos. 303 to 314 of Table 5.

Embodiment 2

The following description will discuss another embodiment of the present invention. For convenience of description, members having functions identical to those described in Embodiment are assigned identical referential numerals and their descriptions are omitted.

For the hot-dip plating apparatus 1 in accordance with Embodiment 1 (see FIG. 1), the acoustic spectrum was measured under the conditions in which the distance L1 between the tip of the waveguide probe 31 and the surface of the steel sheet 2 in the hot-clip plating bath 20 was fixed at 10 mm. A further study carried out by the inventors of the present invention showed that the characteristic intensity ratio of the acoustic spectrum can change as the position at which the acoustic spectrum is measured changes.

In view of the above, an acoustic spectrum was measured under the conditions in which the distance L1 was varied from 1 mm to 80 mm and the power of the ultrasonic transducer 11 was varied from 0.1 W to 20 W. The results are shown in (a) to (e) of FIG. 7. (a) to (e) of FIG. 7 are charts of acoustic spectra measured while varying the ultrasonic transducer 11 at each distance L1. (a) of FIG. 7 shows a case in which the distance L1 is 1 mm, (b) of FIG. 7 shows a case in which the distance L1 is 5 mm, (c) of FIG. 7 shows a case in which the distance 1 is 10 mm, (d) of FIG. 7 shows a case in which the distance L1 is 30 mm, and (e) of FIG. 7 shows a case in which the distance L1 is 80 mm.

FIG. 8 is a chart showing the relationship between the distance L1 and the characteristic intensity ratio. As shown in FIG. 8, there is a tendency that the characteristic intensity ratio decreases as the distance L1 increases. This tendency is especially noticeable in cases where the power is weak (specifically, 0.1 W, 0.5 W). This indicates that it is preferable that, for example, when the power is 0.1 W or 0.5 W, the distance L1 be not more than 10 mm in order to sense the acoustic spectrum.

Furthermore, as shown in (a) to (e) of FIG. 7, there may be cases where, when the distance L1 is too large, the signal intensity of the acoustic spectrum becomes small and less than the noise level, making it difficult to detect the signal. There may be cases where this makes it difficult to accurately evaluate the vibrational state in the hot-dip plating bath 20. It is therefore preferable that, in the present hot-dip plating method, the power be not less than 0.5 W and the distance L1 be not more than 10 mm.

Embodiment 3

The following description will discuss a further embodiment of the present invention. For convenience of description, members having functions identical to those described in Embodiments 1 and 2 are assigned identical referential numerals and their descriptions are omitted.

In Embodiments 1 and 2, vibration is applied to the steel sheet 2 with use of the ultrasonic horn 10 under the conditions in which the steel sheet 2 is attached to the tip of the ultrasonic horn 10. In contrast, Embodiment 3 is different from Embodiments 1 and 2 in that vibration is applied to a vibrating plate with use of the ultrasonic horn 10 under the conditions in which the vibrating plate is attached to the tip of the ultrasonic horn 10 and the vibration is indirectly applied to the steel sheet 2 through the hot-dip plating bath 20.

(Hot-Dip Plating Apparatus)

The following description will discuss a hot-dip plating apparatus 60 which carries out a hot-dip plating method in accordance with Embodiment 3, with reference to FIG. 9. Note that the hot-dip plating apparatus 60 is an example, and an apparatus that carries out the present hot-dip plating method is not particularly limited. FIG. 9 schematically illustrates the hot-dip plating apparatus 60 which carries out the hot-dip plating method in accordance with Embodiment 3.

As illustrated in FIG. 9, the hot-dip plating apparatus 60 includes a gaseous reduction heating zone 61, a hot-dip plating section 62, an ultrasonic horn 10, and a measuring unit 50 that measures an acoustic spectrum. The gaseous reduction heating zone 61 includes an atmospheric gas introducing section 61*a* and a heating section 61*b*, and is capable of carrying out a heat treatment with respect to a steel sheet 2 in a desired atmosphere.

In the hot-dip plating section 62, the space above the crucible furnace 41 is shut out from the atmospheric air with a port flange 64 and an O-ring 65. The port flange 64 has an atmospheric gas introducing section 66 in a part thereof, and is configured such that the atmosphere in the hot-dip plating section 62 can be controlled.

A gate valve 63 is provided between the gaseous reduction heating zone 61 and the hot-dip plating section 62. The steel sheet 2 treated in the gaseous reduction heating zone 61 is transferred to the hot-dip plating section 62 without being exposed to the atmospheric air, by opening the gate valve 63. The steel sheet 2 is subjected to pre-treatments such as atmosphere control and a heat treatment in the gaseous reduction heating zone 61 above the gate valve 63, and then advances into the plating bath 21.

Furthermore, in the hot-dip plating apparatus 60 in accordance with Embodiment 3, a vibrating plate 70, instead of the steel sheet is fixed to the tip of the ultrasonic horn 10. This vibrating plate 70 used here is a sheet made of common steel (which is of the same steel type as the steel sheet A in Table 1) and measuring 150 rum (length)×50 mm (width)× 0.8 mm (thickness). The vibration of the vibrating plate 70 is used to apply vibration to the hot-clip plating bath metal 21. This applies vibration to the steel sheet 2 through the hot-dip plating bath metal 21. That is, the hot-dip plating apparatus 60 is configured to apply vibration indirectly to the steel sheet 2. Note that the material for the vibrating plate 70 is not limited to the mentioned above. The vibrating plate 70 is preferably made of a material that is highly corrosion resistant when dipped in the hot-dip plating bath and that is poor in wettability against the hot-dip plating bath. The material can be, for example, a ceramic material.

The configurations of the other members such as the measuring unit 50 are the same as those of the foregoing hot-dip plating apparatus 40 (see FIG. 5), and therefore detailed descriptions therefor are omitted.

The hot-dip plating apparatus 60 like that described above can be applied to a continuous hot-dip plating method. Specifically, although it is difficult to directly apply vibration to a steel sheet in a continuous hot-dip plating method, it is possible to indirectly apply vibration to the steel sheet 2 like the hot-dip plating apparatus 60 does. Therefore, the results demonstrated using the hot-dip plating apparatus 60 like that described above can be applied to a continuous hot-dip plating method. An example of the hot-dip plating apparatus 60 applied to a continuous hot-dip plating method will be specifically described later.

Example 2

The following description will discuss an example of a hot-dip plating method in accordance with Embodiment 3 of the present invention. In Example 2, the foregoing hot-dip plating apparatus 60 illustrated in FIG. 9 was used.

Similarly to the foregoing Example 1, steel sheets A to F (see Tables 1 and 2) were used, and a Zn—Al—Mg-based hot-dip plating bath or a Al-9mass % Si-2mass % Fe-based plating bath was used to carry out hot-dip plating under various conditions.

Example 2-1: Heat Treatment in Gaseous Reduction Heating Zone 61 was not Carried Out The steel sheets were each subjected to alkaline degreasing as a pre-treatment. The Zn—Al—Mg-based plating bath in Example 1-1 of Example 1 and the Al-9% Si-based plating bath of Example 1-2 of Example 1 were used as hot-dip plating baths. The atmosphere in the hot-dip plating section 62 was changed to air atmosphere, nitrogen atmosphere, 3% hydrogen-nitrogen atmosphere, or 30% hydrogen-nitrogen atmosphere. The atmosphere control or heat treatment was not carried out in the gaseous reduction heating zone 61. The time for which the steel sheet was dipped in the hot-dip plating bath was 12 seconds, and, in cases where the vibration was applied to the interior portion of the hot-dip plating bath by causing the vibrating plate 70 to vibrate with use of the ultrasonic horn 10, the application of vibration was started 10 seconds after the start of dipping of the steel sheet in the hot-dip plating bath, and the application of vibration was continued for 2 seconds. In cases where the vibrating plate 70 was caused to vibrate, the vibration was applied to the interior portion of the hot-clip plating bath under the conditions in which the fundamental frequency and the power of the ultrasonic transducer 11 were constant, i.e., the fundamental frequency was set to 15 kHz and the power of the ultrasonic transducer 11 was set to 30 W.

The arrangement of the steel sheet and the vibrating plate in the hot-dip plating bath was adjusted so that the distance (gap) between the vibrating plate and the steel sheet would be 5 mm. The distance between the steel sheet and the tip of the waveguide probe was 5 mm.

As Comparative Examples, a steel sheet was subjected to dip plating using the hot-dip plating apparatus 60 without applying vibration to the interior portion of the hot-dip plating bath. The results of the test are collectively shown in Table 6.

TABLE 6

| No. | Thickness of sheet (mm) | Substrate | Plating bath type | Plating bath temperature (° C.) | Plating bath atmosphere | Whether substrate was heated or not | Substrate heating atmosphere | Inlet temperature | Conditions under which vibration was applied: Thickness of sheet (mm) | Conditions under which vibration was applied: Vibrating plate |
|---|---|---|---|---|---|---|---|---|---|---|
| 61 | 0.8 | A | Zn—Al—Mg base | 450 | Atmospheric air | Not | — | Room temperature | 0.8 | A |
| 62 | 1.4 | B | | | | | — | | | |
| 63 | 0.8 | C | | | | | — | | | |
| 64 | 1.0 | D | | | | | — | | | |
| 65 | 1.0 | E | | | | | — | | | |
| 66 | 1.1 | F | | | | | — | | | |
| 67 | 0.8 | A | Al—9%Si base | 660 | | | — | | | |
| 68 | 1.4 | B | | | | | — | | | |
| 69 | 0.8 | C | | | | | — | | | |
| 70 | 1.0 | D | | | | | — | | | |
| 71 | 1.0 | E | | | | | — | | | |
| 72 | 1.1 | F | | | | | — | | | |
| 73 | 0.8 | A | Zn—Al—Mg base | 450 | $N_2$ | Not | — | Room temperature | 0.8 | A |
| 74 | 1.4 | B | | | $N_2$ | | — | | | |
| 75 | 0.8 | C | | | $N_2$ | | — | | | |
| 76 | 1.0 | D | | | $N_2$ | | — | | | |
| 77 | 1.0 | E | | | $N_2$ | | — | | | |

TABLE 6-continued

| | | | | | | | | | | |
|---|---|---|---|---|---|---|---|---|---|---|
| 78 | 1.1 | F | | | $N_2$ | | — | | | |
| 79 | 0.8 | A | Al—9%Si | 660 | $N_2$ | | — | | | |
| 80 | 1.4 | B | base | | $N_2$ | | — | | | |
| 81 | 0.8 | C | | | $N_2$ | | — | | | |
| 82 | 1.0 | D | | | $N_2$ | | — | | | |
| 83 | 1.0 | E | | | $N_2$ | | — | | | |
| 84 | 1.1 | F | | | $N_2$ | | — | | | |
| 85 | 0.8 | A | Zn—Al—Mg | 450 | 3%$H_2$—$N_2$ | Not | — | Room | 0.8 | A |
| 86 | 1.4 | B | base | | | | — | temperature | | |
| 87 | 0.8 | C | | | | | — | | | |
| 88 | 1.0 | D | | | | | — | | | |
| 89 | 1.0 | E | | | | | — | | | |
| 90 | 1.1 | F | | | | | — | | | |
| 91 | 0.8 | A | Al—9%Si | 660 | | | — | | | |
| 92 | 1.4 | B | base | | | | — | | | |
| 93 | 0.8 | C | | | | | — | | | |
| 94 | 1.0 | D | | | | | — | | | |
| 95 | 1.0 | E | | | | | — | | | |
| 96 | 1.1 | F | | | | | — | | | |
| 97 | 0.8 | A | Zn—Al—Mg | 450 | 30%$H_2$—$N_2$ | Not | — | Room | 0.8 | A |
| 98 | 1.4 | B | base | | | | — | temperature | | |
| 99 | 0.8 | C | | | | | — | | | |
| 100 | 1.0 | D | | | | | — | | | |
| 101 | 1.0 | E | | | | | — | | | |
| 102 | 1.1 | F | | | | | — | | | |
| 103 | 0.8 | A | Al—9%Si | 660 | | | — | | | |
| 104 | 1.4 | B | base | | | | — | | | |
| 105 | 0.8 | C | | | | | — | | | |
| 106 | 1.0 | D | | | | | — | | | |
| 107 | 1.0 | E | | | | | — | | | |
| 108 | 1.1 | F | | | | | — | | | |
| 109 | 0.8 | A | Zn—Al—Mg base | 450 | Atmospheric air | Not | — | Room temperature | No vibration application | |
| 110 | 0.8 | A | Al—9%Si base | 660 | Atmospheric air | | — | | | |
| 111 | 0.8 | A | Zn—Al—Mg base | 450 | $N_2$ | | — | | | |
| 112 | 0.8 | A | Al—9%Si base | 660 | $N_2$ | | — | | | |
| 113 | 0.8 | A | Zn—Al—Mg base | 450 | 3%$H_2$—$N_2$ | | — | | | |
| 114 | 0.8 | A | Al—9%Si base | 660 | 3%$H_2$—$N_2$ | | — | | | |
| 115 | 0.8 | A | Zn—Al—Mg base | 450 | 30%$H_2$—$N_2$ | | — | | | |
| 116 | 0.8 | A | Al—9%Si base | 660 | 30%$H_2$—$N_2$ | | — | | | |
| 117 | 0.8 | C | Zn—Al—Mg base | 450 | Atmospheric air | | — | | | |
| 118 | 0.8 | C | Al—9%Si base | 660 | Atmospheric air | | — | | | |
| 119 | 0.8 | C | Zn—Al—Mg base | 450 | $N_2$ | | — | | | |
| 120 | 0.8 | C | Al—9%Si base | 660 | $N_2$ | | — | | | |
| 121 | 0.8 | C | Zn—Al—Mg base | 450 | 3%$H_2$—$N_2$ | | — | | | |
| 122 | 0.8 | C | Al—9%Si base | 660 | 3%$H_2$—$N_2$ | | — | | | |
| 123 | 0.8 | C | Zn—Al—Mg base | 450 | 30%$H_2$—$N_2$ | | — | | | |
| 124 | 0.8 | C | Al—9%Si base | 660 | 30%$H_2$—$N_2$ | | — | | | |

| | Conditions under which vibration was applied | | Gap between vibrating plate and | Acoustic spectrum in bath | | | | |
|---|---|---|---|---|---|---|---|---|
| No. | Frequency (kHz) | Power (W) | substrate (mm) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 61 | 15 | 30 | 5 | 64.3 | 63.4 | 0.99 | Excellent | Examples |
| 62 | | | | 64.2 | 62.1 | 0.97 | Excellent | |
| 63 | | | | 63.2 | 62.0 | 0.98 | Excellent | |
| 64 | | | | 64.6 | 63.1 | 0.98 | Excellent | |
| 65 | | | | 65.5 | 64.5 | 0.98 | Excellent | |
| 66 | | | | 65.2 | 64.8 | 0.99 | Excellent | |

TABLE 6-continued

| | | | | | | | | |
|---|---|---|---|---|---|---|---|---|
| 67 | | | | 39.5 | 30.2 | 0.76 | Excellent | |
| 68 | | | | 39.2 | 30.1 | 0.77 | Excellent | |
| 69 | | | | 38.9 | 29.9 | 0.77 | Excellent | |
| 70 | | | | 38.8 | 30.2 | 0.78 | Excellent | |
| 71 | | | | 39.5 | 31.1 | 0.79 | Excellent | |
| 72 | | | | 39.4 | 30.9 | 0.78 | Excellent | |
| 73 | 15 | 30 | 5 | 64.1 | 63.1 | 0.98 | Excellent | Examples |
| 74 | | | | 64.3 | 62.2 | 0.97 | Excellent | |
| 75 | | | | 63.1 | 62.4 | 0.99 | Excellent | |
| 76 | | | | 63.2 | 62.0 | 0.98 | Excellent | |
| 77 | | | | 65.2 | 64.6 | 0.99 | Excellent | |
| 78 | | | | 64.9 | 64.1 | 0.99 | Excellent | |
| 79 | | | | 39.6 | 30.5 | 0.77 | Excellent | |
| 80 | | | | 39.3 | 30.2 | 0.77 | Excellent | |
| 81 | | | | 39.0 | 30.3 | 0.78 | Excellent | |
| 82 | | | | 39.9 | 30.2 | 0.76 | Excellent | |
| 83 | | | | 39.5 | 30.9 | 0.78 | Excellent | |
| 84 | | | | 38.9 | 31.0 | 0.80 | Excellent | |
| 85 | 15 | 30 | 5 | 63.2 | 62.2 | 0.98 | Excellent | Examples |
| 86 | | | | 63.4 | 62.3 | 0.98 | Excellent | |
| 87 | | | | 64.2 | 63.1 | 0.98 | Excellent | |
| 88 | | | | 64.1 | 62.1 | 0.97 | Excellent | |
| 89 | | | | 65.1 | 64.5 | 0.99 | Excellent | |
| 90 | | | | 64.3 | 62.1 | 0.97 | Excellent | |
| 91 | | | | 39.3 | 30.1 | 0.77 | Excellent | |
| 92 | | | | 39.1 | 30.1 | 0.77 | Excellent | |
| 93 | | | | 39.1 | 30.7 | 0.79 | Excellent | |
| 94 | | | | 38.8 | 30.5 | 0.79 | Excellent | |
| 95 | | | | 38.6 | 30.1 | 0.78 | Excellent | |
| 96 | | | | 38.1 | 29.9 | 0.78 | Excellent | |
| 97 | 15 | 30 | 5 | 64.1 | 63.4 | 0.99 | Excellent | Examples |
| 98 | | | | 64.3 | 63.1 | 0.98 | Excellent | |
| 99 | | | | 63.1 | 62.2 | 0.99 | Excellent | |
| 100 | | | | 64.1 | 63.3 | 0.99 | Excellent | |
| 101 | | | | 65.1 | 63.3 | 0.97 | Excellent | |
| 102 | | | | 64.9 | 63.9 | 0.98 | Excellent | |
| 103 | | | | 39.1 | 30.3 | 0.77 | Excellent | |
| 104 | | | | 38.3 | 30.2 | 0.79 | Excellent | |
| 105 | | | | 39.1 | 30.9 | 0.79 | Excellent | |
| 106 | | | | 38.4 | 29.9 | 0.78 | Excellent | |
| 107 | | | | 39.4 | 31.2 | 0.79 | Excellent | |
| 108 | | | | 38.9 | 30.9 | 0.79 | Excellent | |
| 109 | | No vibration | | — | — | — | Very poor | Comparative |
| 110 | | application | | — | — | — | Very poor | Examples |
| 111 | | | | — | — | — | Very poor | |
| 112 | | | | — | — | — | Very poor | |
| 113 | | | | — | — | — | Very poor | |
| 114 | | | | — | — | — | Very poor | |
| 115 | | | | — | — | — | Very poor | |
| 116 | | | | — | — | — | Very poor | |
| 117 | | | | — | — | — | Very poor | |
| 118 | | | | — | — | — | Very poor | |
| 119 | | | | — | — | — | Very poor | |
| 120 | | | | — | — | — | Very poor | |
| 121 | | | | — | — | — | Very poor | |
| 122 | | | | — | — | — | Very poor | |
| 123 | | | | — | — | — | Very poor | |
| 124 | | | | — | — | — | Very poor | |

As shown in Nos. 61 to 108 of Table 6, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was 0% in all conditions.

In contrast, in cases where hot-dip plating was carried out without applying vibration to the interior portion of the hot-dip plating bath, the holiday rate of the plated product was 80% or more in all conditions, as shown in Nos. 109 to 124 of Table 6.

Example 2-2: Heat Treatment in Gaseous Reduction Heating Zone 61 was Carried Out Hot-dip plating was carried out in the same manner as described in Example 2-1, except that the atmosphere control and heat treatment were carried out in the gaseous reduction heating zone 61 and that the application of vibration was started 2 seconds after the start of dipping application of vibration was continued for 2 seconds. The results of the test are collectively shown in Table 7.

TABLE 7

| No. | Thickness of sheet (mm) | Substrate | Plating bath type | Plating bath temperature (° C.) | Plating bath atmosphere | Substrate heating temperature (° C.) | Substrate heating atmosphere | Inlet temperature (° C.) | Conditions under which vibration was applied: Thickness of sheet (mm) | Conditions under which vibration was applied: Vibrating plate |
|---|---|---|---|---|---|---|---|---|---|---|
| 130 | 0.8 | A | Zn—Al—Mg base | 450 | Atmospheric air | 500 | Atmospheric air | 460 | 0.8 | A |
| 131 | 1.4 | B | | | | | | | | |
| 132 | 0.8 | C | | | | | | | | |
| 133 | 1.0 | D | | | | | | | | |
| 134 | 1.0 | E | | | | | | | | |
| 135 | 1.1 | F | | | | | | | | |
| 136 | 0.8 | A | Al—9%Si base | 660 | | 680 | | 650 | | |
| 137 | 1.4 | B | | | | | | | | |
| 138 | 0.8 | C | | | | | | | | |
| 139 | 1.0 | D | | | | | | | | |
| 140 | 1.0 | E | | | | | | | | |
| 141 | 1.1 | F | | | | | | | | |
| 142 | 0.8 | A | Zn—Al—Mg base | 450 | $N_2$ | 500 | $N_2$ | 460 | 0.8 | A |
| 143 | 1.4 | B | | | | | | | | |
| 144 | 0.8 | C | | | | | | | | |
| 145 | 1.0 | D | | | | | | | | |
| 146 | 1.0 | E | | | | | | | | |
| 147 | 1.1 | F | | | | | | | | |
| 148 | 0.8 | A | Al—9%Si base | 660 | | 680 | | 650 | | |
| 149 | 1.4 | B | | | | | | | | |
| 150 | 0.8 | C | | | | | | | | |
| 151 | 1.0 | D | | | | | | | | |
| 152 | 1.0 | E | | | | | | | | |
| 153 | 1.1 | F | | | | | | | | |
| 154 | 0.8 | A | Zn—Al—Mg base | 450 | 3%$H_2$—$N_2$ | 500 | 3%$H_2$—$N_2$ | 460 | 0.8 | A |
| 155 | 1.4 | B | | | | | | | | |
| 156 | 0.8 | C | | | | | | | | |
| 157 | 1.0 | D | | | | | | | | |
| 158 | 1.0 | E | | | | | | | | |
| 159 | 1.1 | F | | | | | | | | |
| 160 | 0.8 | A | Al—9%Si base | 660 | | 680 | | 650 | | |
| 161 | 1.4 | B | | | | | | | | |
| 162 | 0.8 | C | | | | | | | | |
| 163 | 1.0 | D | | | | | | | | |
| 164 | 1.0 | E | | | | | | | | |
| 165 | 1.1 | F | | | | | | | | |
| 166 | 0.8 | A | Zn—Al—Mg base | 450 | 30%$H_2$—$N_2$ | 500 | 30%$H_2$—$N_2$ | 460 | 0.8 | A |
| 167 | 1.4 | B | | | | | | | | |
| 168 | 0.8 | C | | | | | | | | |
| 169 | 1.0 | D | | | | | | | | |
| 170 | 1.0 | E | | | | | | | | |
| 171 | 1.1 | F | | | | | | | | |
| 172 | 0.8 | A | Al—9%Si base | 660 | | 680 | | 650 | | |
| 173 | 1.4 | B | | | | | | | | |
| 174 | 0.8 | C | | | | | | | | |
| 175 | 1.0 | D | | | | | | | | |
| 176 | 1.0 | E | | | | | | | | |
| 177 | 1.1 | F | | | | | | | | |
| 178 | 0.8 | A | Zn—Al—Mg base | 450 | Atmospheric air | 500 | Atmospheric air | 460 | No vibration application | |
| 179 | 0.8 | A | Al—9%Si base | 660 | Atmospheric air | 680 | Atmospheric air | 650 | | |
| 180 | 0.8 | A | Zn—Al—Mg base | 450 | $N_2$ | 500 | $N_2$ | 460 | | |
| 181 | 0.8 | A | Al—9%Si base | 660 | $N_2$ | 680 | $N_2$ | 650 | | |
| 182 | 0.8 | A | Zn—Al—Mg base | 450 | 3%$H_2$—$N_2$ | 500 | 3%$H_2$—$N_2$ | 460 | | |
| 183 | 0.8 | A | Al—9%Si base | 660 | 3%$H_2$—$N_2$ | 680 | 3%$H_2$—$N_2$ | 650 | | |
| 184 | 0.8 | A | Zn—Al—Mg base | 450 | 30%$H_2$—$N_2$ | 500 | 30%$H_2$—$N_2$ | 460 | | |
| 185 | 0.8 | A | Al—9%Si base | 660 | 30%$H_2$—$N_2$ | 680 | 30%$H_2$—$N_2$ | 650 | | |
| 186 | 0.8 | C | Zn—Al—Mg base | 450 | Atmospheric air | 500 | Atmospheric air | 460 | | |
| 187 | 0.8 | C | Al—9%Si base | 660 | Atmospheric air | 680 | Atmospheric air | 650 | | |
| 188 | 0.8 | C | Zn—Al—Mg base | 450 | $N_2$ | 500 | $N_2$ | 460 | | |
| 189 | 0.8 | C | Al—9%Si base | 660 | $N_2$ | 680 | $N_2$ | 650 | | |

TABLE 7-continued

| | | | | | | | | |
|---|---|---|---|---|---|---|---|---|
| 190 | 0.8 | C | Zn—Al—Mg base | 450 | 3%$H_2$—$N_2$ | 500 | 3%$H_2$—$N_2$ | 460 |
| 191 | 0.8 | C | Al—9%Si base | 660 | 3%$H_2$—$N_2$ | 680 | 3%$H_2$—$N_2$ | 650 |
| 192 | 0.8 | C | Zn—Al—Mg base | 450 | 30%$H_2$—$N_2$ | 500 | 30%$H_2$—$N_2$ | 460 |
| 193 | 0.8 | C | Al—9%Si base | 660 | 30%$H_2$—$N_2$ | 680 | 30%$H_2$—$N_2$ | 650 |

| | Conditions under which vibration was applied | | Gap between vibrating plate and | Acoustic spectrum in bath | | | | |
|---|---|---|---|---|---|---|---|---|
| No. | Frequency (kHz) | Power (W) | substrate (mm) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 130 | 15 | 30 | 5 | 64.2 | 62.9 | 0.98 | Good | Examples |
| 131 | | | | 64.4 | 61.9 | 0.96 | Good | |
| 132 | | | | 63.3 | 61.8 | 0.98 | Good | |
| 133 | | | | 63.4 | 61.4 | 0.97 | Good | |
| 134 | | | | 66.2 | 64.3 | 0.97 | Good | |
| 135 | | | | 63.2 | 62.1 | 0.98 | Good | |
| 136 | | | | 39.3 | 30.6 | 0.78 | Good | |
| 137 | | | | 39.3 | 30.3 | 0.77 | Good | |
| 138 | | | | 39.2 | 30.4 | 0.78 | Good | |
| 139 | | | | 39.2 | 30.7 | 0.78 | Good | |
| 140 | | | | 39.4 | 30.1 | 0.76 | Good | |
| 141 | | | | 38.9 | 29.9 | 0.77 | Good | |
| 142 | 15 | 30 | 5 | 64.3 | 63.2 | 0.98 | Excellent | Examples |
| 143 | | | | 64.1 | 62.3 | 0.97 | Excellent | |
| 144 | | | | 64.9 | 63.3 | 0.98 | Excellent | |
| 145 | | | | 63.8 | 62.4 | 0.98 | Excellent | |
| 146 | | | | 64.9 | 64.0 | 0.99 | Excellent | |
| 147 | | | | 62.9 | 62.1 | 0.99 | Excellent | |
| 148 | | | | 38.9 | 29.9 | 0.77 | Excellent | |
| 149 | | | | 38.7 | 29.8 | 0.77 | Excellent | |
| 150 | | | | 39.1 | 30.7 | 0.79 | Excellent | |
| 151 | | | | 39.4 | 31.1 | 0.79 | Excellent | |
| 152 | | | | 39.1 | 29.9 | 0.76 | Excellent | |
| 153 | | | | 38.3 | 30.3 | 0.79 | Excellent | |
| 154 | 15 | 30 | 5 | 64.3 | 63.1 | 0.98 | Excellent | Examples |
| 155 | | | | 64.1 | 63.1 | 0.98 | Excellent | |
| 156 | | | | 63.1 | 61.1 | 0.97 | Excellent | |
| 157 | | | | 62.2 | 61.2 | 0.98 | Excellent | |
| 158 | | | | 64.4 | 63.3 | 0.98 | Excellent | |
| 159 | | | | 63.9 | 62.1 | 0.97 | Excellent | |
| 160 | | | | 38.9 | 30.3 | 0.78 | Excellent | |
| 161 | | | | 38.3 | 30.2 | 0.79 | Excellent | |
| 162 | | | | 39.3 | 30.9 | 0.79 | Excellent | |
| 163 | | | | 38.3 | 29.9 | 0.78 | Excellent | |
| 164 | | | | 38.9 | 31.2 | 0.80 | Excellent | |
| 165 | | | | 39.9 | 30.9 | 0.77 | Excellent | |
| 166 | 15 | 30 | 5 | 63.8 | 62.3 | 0.98 | Excellent | Examples |
| 167 | | | | 64.1 | 63.1 | 0.98 | Excellent | |
| 168 | | | | 63.3 | 61.1 | 0.97 | Excellent | |
| 169 | | | | 64.5 | 61.2 | 0.95 | Excellent | |
| 170 | | | | 64.9 | 62.2 | 0.96 | Excellent | |
| 171 | | | | 65.1 | 62.3 | 0.96 | Excellent | |
| 172 | | | | 38.8 | 30.3 | 0.78 | Excellent | |
| 173 | | | | 38.3 | 30.4 | 0.79 | Excellent | |
| 174 | | | | 39.3 | 30.7 | 0.78 | Excellent | |
| 175 | | | | 39.2 | 30.2 | 0.77 | Excellent | |
| 176 | | | | 39.4 | 30.9 | 0.78 | Excellent | |
| 177 | | | | 39.1 | 30.4 | 0.78 | Excellent | |
| 178 | | No vibration application | | — | — | — | Very poor | Comparative Examples |
| 179 | | | | — | — | — | Very poor | |
| 180 | | | | — | — | — | Poor | |
| 181 | | | | — | — | — | Poor | |
| 182 | | | | — | — | — | Poor | |
| 183 | | | | — | — | — | Poor | |
| 184 | | | | — | — | — | Excellent | |
| 185 | | | | — | — | — | Excellent | |
| 186 | | | | — | — | — | Very poor | |
| 187 | | | | — | — | — | Very poor | |
| 188 | | | | — | — | — | Poor | |
| 189 | | | | — | — | — | Poor | |
| 190 | | | | — | — | — | Poor | |

TABLE 7-continued

| | | | | |
|---|---|---|---|---|
| 191 | — | — | — | Poor |
| 192 | — | — | — | Poor |
| 193 | — | — | — | Poor |

As shown in Nos. 130 to 141 of FIG. 7, even in cases where the steel sheet was heated in an air atmosphere and then caused to advance into the hot-dip plating bath (even in cases where the steel sheet has a relatively thick oxide film on its surface), the holiday rate of the plated product was less than 1% because vibration was applied under the conditions in which an acoustic spectrum within the scope of the present invention was measured in the hot-dip plating bath.

Furthermore, as shown in Nos. 142 to 177 of Table 7, in cases where the heating atmosphere in the gaseous reduction heating zone 61 and the atmosphere of the hot-dip plating bath were non-oxidizing atmospheres, the holiday rate of the plated product was 0% even when the heated steel sheet was caused to advance into the hot-dip plating bath, because vibration was applied under the conditions in which an acoustic spectrum within the scope of the present invention was measured in the hot-dip plating bath.

In contrast, in cases where the steel sheet was heated in an air atmosphere and then subjected to hot-dip plating without applying vibration to the interior portion of the hot-dip plating bath, the holiday rate of the plated product was 80% or more, as shown in Nos. 178, 179, 186, and 187 of Table 7.

Furthermore, as shown in Nos. 180 to 183 and 188 to 193 of Table 7, in cases where hot-dip plating was carried out under the conditions in which the heating atmosphere in the gaseous reduction heating zone 61 and the atmosphere of the hot-dip plating bath were non-oxidizing atmosphere and in which no vibration was applied to the interior portion of the hot-dip plating bath, the holiday rate of the plated product was not less than 10% and less than 80%.

Note that, in cases where the steel sheet was subjected to a reduction/heating treatment and then subjected to hot-dip plating in a reducing atmosphere in the same manner as conventional techniques, the holiday rate of the plated product was 0% as shown in Nos. 184 and 185 of Table 7.

Example 2-3: Heat Treatment in Gaseous Reduction Heating Zone 61 was not Carried Out, Various Plating Baths were Used Hot-dip plating was carried out in the same manner as described in Example 2-1, except that a hot-dip plating bath having any of the compositions shown in Tables 8 and 9 below was used and that the atmosphere in the hot-dip plating section 62 was 3% hydrogen-nitrogen atmosphere. The plating bath type M11 is an Al-2mass % Fe-based plating bath, and the temperature of the bath is 700° C. (plating bath type M11 is different from the Al-9mass % Si-2mass % Fe-based plating bath used in the test shown in Table 4 in that the plating bath M11 does not have Si added thereto). The results of the test are collectively shown in Table 10.

TABLE 8

| Plating bath type | Plating bath composition (mass %) Al | Mg | Si | Note | Plating bath temperature (° C.) |
|---|---|---|---|---|---|
| M1 | 0.2 | — | — | Balance: Zn | 430 |
| M2 | 1.5 | 1.5 | — | Balance: Zn | 430 |
| M3 | 2.5 | 3.0 | — | Balance: Zn | 430 |
| M4 | 2.5 | 3.0 | 0.04 | Balance: Zn | 430 |
| M5 | 11.0 | 3.0 | — | Balance: Zn | 450 |
| M6 | 11.0 | 3.0 | 0.20 | Balance: Zn | 450 |
| M7 | 18.0 | 8.0 | — | Balance: Zn | 470 |
| M8 | 55.0 | 2.0 | 0.5 | Balance: Zn | 660 |
| M9 | 55.0 | 2.0 | 0.3 | Balance: Zn | 660 |
| M10 | 55.0 | — | 1.6 | Balance: Zn | 660 |

TABLE 9

| Plating bath type | Plating bath composition (mass %) Zn | Note | Plating bath temperature (° C.) |
|---|---|---|---|
| M12 | 8.5 | Balance: Sn | 280 |

TABLE 10

| No. | Thickness of sheet (mm) | Substrate | Plating bath type | Plating bath atmosphere | Whether substrate was heated or not | Substrate heating atmosphere | Inlet temperature | Conditions under which vibration was applied: Thickness of sheet (mm) | Vibrating plate | Frequency (kHz) |
|---|---|---|---|---|---|---|---|---|---|---|
| 201 | 0.8 | A | M1 | 3%$H_2$—$N_2$ | Not | — | Room temperature | 0.8 | A | 15 |
| 202 | | | | | | | | | No vibration application | |
| 203 | | | M2 | | | | | 0.8 | A | 15 |
| 204 | | | | | | | | | No vibration application | |
| 205 | | | M3 | | | | | 0.8 | A | 15 |
| 206 | | | | | | | | | No vibration application | |
| 207 | | | M4 | | | | | 0.8 | A | 15 |
| 208 | | | | | | | | | No vibration application | |

TABLE 10-continued

| | | | | | |
|---|---|---|---|---|---|
| 209 | M5 | 0.8 | A | 15 |
| 210 | | | No vibration application | |
| 211 | M6 | 0.8 | A | 15 |
| 212 | | | No vibration application | |
| 213 | M7 | 0.8 | A | 15 |
| 214 | | | No vibration application | |
| 215 | M8 | 0.8 | A | 15 |
| 216 | | | No vibration application | |
| 217 | M9 | 0.8 | A | 15 |
| 218 | | | No vibration application | |
| 219 | M10 | 0.8 | A | 15 |
| 220 | | | No vibration application | |
| 221 | M11 | 0.8 | A | 15 |
| 222 | | | No vibration application | |
| 223 | M12 | 0.8 | A | 15 |
| 224 | | | No vibration application | |

| | | | Acoustic spectrum in bath | | | | |
|---|---|---|---|---|---|---|---|
| No. | Conditions under which vibration was applied Power (W) | Gap between vibrating plate and substrate (mm) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 201 | 30 | 5 | 63.2 | 62.2 | 0.98 | Excellent | Example |
| 202 | No vibration application | | — | — | — | Poor | Comparative Example |
| 203 | 30 | 5 | 64.6 | 63.1 | 0.98 | Excellent | Examples |
| 204 | No vibration application | | — | — | — | Poor | Comparative Example |
| 205 | 30 | 5 | 64.1 | 62.8 | 0.98 | Excellent | Example |
| 206 | No vibration application | | — | — | — | Poor | Comparative Example |
| 207 | 30 | 5 | 65.1 | 63.3 | 0.97 | Excellent | Example |
| 208 | No vibration application | | — | — | — | Poor | Comparative Example |
| 209 | 30 | 5 | 64.9 | 63.2 | 0.97 | Excellent | Example |
| 210 | No vibration application | | — | — | — | Poor | Comparative Example |
| 211 | 30 | 5 | 63.7 | 61.2 | 0.96 | Excellent | Example |
| 212 | No vibration application | | — | — | — | Poor | Comparative Example |
| 213 | 30 | 5 | 64.6 | 62.9 | 0.97 | Excellent | Example |
| 214 | No vibration application | | — | — | — | Poor | Comparative Example |
| 215 | 30 | 5 | 44.3 | 35.5 | 0.80 | Excellent | Example |
| 216 | No vibration application | | — | — | — | Poor | Comparative Example |
| 217 | 30 | 5 | 42.1 | 33.4 | 0.79 | Excellent | Example |
| 218 | No vibration application | | — | — | — | Peer | Comparative Example |
| 219 | 30 | 5 | 43.2 | 34.2 | 0.79 | Excellent | Example |
| 220 | No vibration application | | — | — | — | Poor | Comparative Example |
| 221 | 30 | 5 | 39.3 | 30.1 | 0.77 | Excellent | Example |
| 222 | No vibration application | | — | — | — | Poor | Comparative Example |
| 223 | 30 | 5 | 38.7 | 29.2 | 0.77 | Excellent | Example |
| 224 | No vibration application | | — | — | — | Poor | Comparative Example |

As shown in Nos. 201, 203, 205, 207, 209, 211, 213, 215, 217, 219, 221, and 223 of Table 10, in cases where the steel sheet was subjected to dip plating while vibration was applied to the interior portion of the hot-dip plating bath under the conditions in which an acoustic spectrum within the scope of the present invention was measured in the hot-dip plating bath, the platability for the steel sheet improved, and the holiday rate of the plated product was 0%.

In contrast, in cases where the hot-dip plating was carried out without applying vibration to the interior portion of the hot-dip plating bath, the holiday rate of the plated product was 10% or more, as shown in Nos, 202, 204, 206, 208, 210, 212, 214, 216, 218, 220, 222, and 224 of Table 10.

Embodiment 4

A hot-dip plated steel sheet produced by a hot-dip plating method of the present invention may have, on the surface of the plating, a chemical conversion coating film which is a substrate film to be coated and which achieves improvements in corrosion resistance and coating adhesiveness (hereinafter "chemical conversion coating film"). The chemical conversion coating film is preferably an inorganic film. More specifically, the chemical conversion coating film is preferably a film that contains an oxide or a hydroxide of a valve metal and a fluoride of a valve metal. As used herein, the "valve metal" is a metal which, when oxidized, shows high insulation resistance. The valve metal element is preferably one or two or more selected from Ti, Zr, Hf, V, Nb, Ta, Mo, and W. The chemical conversion coating film may contain a soluble or insoluble metal phosphate or compound phosphate. The chemical conversion coating film may contain an organic wax (e.g., fluorine-based, polyethylene-based, or styrene-based wax, or the like) or an inorganic lubricant such as silica, molybdenum disulfide, or talc. The chemical conversion coating film may be an organic film such as a urethane resin-based film, an acrylic resin-based film, an epoxy resin-based film, an olefin resin-based film, a polyester resin-based film, or the like.

A hot-dip plated steel sheet produced by a hot-dip plating method of the present invention can have, on the surface of the plating, resin-based paint such as polyester-based, acrylic resin-based, fluororesin-based, vinyl chloride resin-based, urethane resin-based, or epoxy resin-based paint or the like paint applied by, for example, roll painting, spray painting, curtain flow painting, dip painting, or the like. The hot-dip plated steel sheet can be used as a base of a film laminate when plastic films such as acrylic resin films are stacked to form the laminate.

Embodiment 5

The following description will discuss another embodiment of the present invention. For convenience of description, members having functions identical to those described in Embodiments 1 to 4 are assigned identical referential numerals and their descriptions are omitted.

In a hot-dip plating method in accordance with Embodiment 5, a part of an ultrasonic horn is dipped in a hot-dip plating bath, and vibration is applied to the hot-dip plating bath from the tip of the ultrasonic horn. With this, the vibration is indirectly transferred from the tip of the ultrasonic horn to a steel sheet through the hot-dip plating bath, and thereby the steel sheet is subjected to dip plating.

(Hot-Dip Plating Apparatus)

The following description will discuss a hot-dip plating apparatus 80 which carries out a hot-dip plating method in accordance with Embodiment 5, with reference to FIG. 10. Note that the hot-dip plating apparatus 80 is an example, and an apparatus that carries out the present hot-dip plating method is not particularly limited. FIG. 10 schematically illustrates the hot-dip plating apparatus 80 which carries out the hot-dip plating method in accordance with Embodiment 5.

As illustrated in FIG. 10, the hot-dip plating apparatus 80 includes a lifting and lowering device 81, an ultrasonic horn 10A, a measuring unit 50 that measures an acoustic spectrum, and a carbon crucible 42 in which a hot-dip plating bath metal 21 is contained. In the hot-dip plating apparatus 80, a steel sheet 2 is dipped in the hot-dip plating bath 20 in the atmospheric air without being heated.

The lifting and lowering device 81 is a device that makes it possible to (i) allow the steel sheet 2 to be dipped in the hot-dip plating bath 20 while holding the steel sheet 2 and (ii) withdraw the steel sheet 2 from the hot-dip plating bath 20. The lifting and lowering device 81 may be a known device, and detailed descriptions therefor are omitted.

The ultrasonic horn 10A includes an ultrasonic transducer 11, a distal part 17, and a joint part 16 that connects the ultrasonic transducer 11 and the distal part 17. The ultrasonic transducer 11 is fixed on a transducer fixation stage 19. The joint part 16 has a length that easily resonates corresponding to the frequency of vibration generated at the ultrasonic transducer 11. The joint part 16 may be a simple adaptor or may be a booster that amplifies the amplitude generated at the ultrasonic transducer 11 and transfers it to the distal part 17.

Under the conditions in which at least part of the distal part 17 of the ultrasonic horn 10A is dipped in the hot-dip plating bath 20, the ultrasonic transducer 11 receives an ultrasonic signal transmitted from an ultrasonic power supply apparatus D1 to carry out ultrasonic vibration. The ultrasonic vibration is transferred to the distal part 17 through the joint part 16, and the vibration is applied to the interior portion of the hot-dip plating bath 20 by the distal part 17.

In a case where the steel sheet 2 is dipped in the hot-dip plating bath 20 with the lifting and lowering device 81, the steel sheet 2 is disposed in front of the distal part 17. The distal part 17 has a vibrating surface 17A at its end more distant from the joint part 16 than the other end along the longitudinal direction such that a cross section of the end is an isosceles triangle. The vibrating surface 17A faces toward a surface of the steel sheet 2 dipped in the hot-dip plating bath 20.

The distal part 17 is preferably made of a ceramic material. This is to reduce the deterioration of the distal part 17 that would result from the ultrasonic vibration of the distal part 17 in the hot-dip plating bath 20.

Note that the hot-dip plating apparatus 80 may use a single-component ultrasonic horn instead of the ultrasonic horn 10A. In such a case, it is only necessary that the distal portion of the ultrasonic horn be made of a ceramic material.

The distance L2 between the vibrating surface 17A of the distal part 17 and the surface of the steel sheet 2 may be 0 mm, and may be more than 0 mm and not more than 50 mm. A distance L2 of 0 mm means that the vibrating surface 17A and the surface of the steel sheet 2 are in contact with each other at the point in time in which the ultrasonic horn 10A is not performing ultrasonic vibration yet (i.e., at the point in time in which the ultrasonic horn 10A is set). For example, the lifting and lowering device 81 is capable of causing the steel sheet 2 to move horizontally, and the distance L2 can be adjusted by causing the steel sheet 2 to move horizontally with use of the lifting and lowering device 81. The distance L2 is preferably more than 0 mm and not more than 5 mm.

The frequency, power, and the like of the vibration applied to the interior portion of the hot-dip plating bath 20 with use of the ultrasonic horn 10A in the hot-dip plating apparatus 80 are the same as those described earlier in Embodiment 1.

Example 3

The following description will discuss an Example of the hot-dip plating method in accordance with Embodiment 5 of the present invention. The foregoing hot-dip plating apparatus 80 illustrated in FIG. 10 was used in Example 3.

Specifically, pieces of equipment used in the hot-dip plating apparatus 80 in accordance with Example 3 are as follows.

(Ultrasonic Vibration Supply System)

Ultrasonic transducer 11: 20 kHz transducer manufactured by hielscher

Joint part 16 (booster): Material is <Ti>, amplification factor is 2.2, 1/2 wavelength type, length is 126 mm Distal part 17: Material is <Ti>, 1/2 wavelength type, length is 250 mm Ultrasonic power supply apparatus D1: 20 kHz, 2 kW power source manufactured by hielscher (Ultrasonic Vibration Measuring System)

Waveguide probe 51: Material is <SUS430>, φ6 mm×300 mm

AE sensor 52: AE-900M manufactured by N F Corporation

Measuring section 53

Amplifier: AE9922 manufactured by N F Corporation

Spectrum analyzer: E4408B manufactured by Agilent Technologies Japan, Ltd.

Example 3-1: Zn—Al—Mg-Based Hot-Dip Plating Bath Type was Used

Similarly to the foregoing Example 1, steel sheets A to F (see Tables 1 and 2) were used, and the Zn—Al—Mg-based hot-dip plating bath of Example 1-1 was used as a hot-dip plating bath to carry out hot-dip plating under various conditions.

In cases where vibration was applied to the interior portion of the hot-dip plating bath with use of the ultrasonic horn 10A, the distance L2 was 0 mm to 50 mm and the fundamental frequency was 20 kHz.

The ultrasonic transducer 11 contains an amplitude sensor to monitor the amplitude of the ultrasonic transducer 11. A display apparatus was used to receive the output from the amplitude sensor and display the output with a 5 V full-scale output. The output displayed by the display apparatus reflects the magnitude of the amplitude of the ultrasonic transducer 11; therefore, in the following descriptions, the full-scale output, i.e., 5 V, was regarded as 100% by output, and the magnitude of the amplitude of the ultrasonic transducer 11 was indicated using the "% by output" as the indicator.

It is noted here that, for a method by which a steel sheet is directly vibrated (direct method), the load for an ultrasonic source is considered the steel sheet itself. On the contrary, in a case of a method by which a steel sheet is indirectly vibrated through a hot-dip plating bath (indirect method), the load for the ultrasonic source consists of the steel sheet and the hot-dip plating bath. Therefore, the conditions under which vibration is applied are indicated in using the "% by output", which is an indicator of the amplitude of the ultrasonic transducer during resonance, instead of using the power (W) of the ultrasonic source as-is.

In cases where vibration was applied to the interior portion of the hot-dip plating bath with use of the ultrasonic horn 10A, the application of vibration was started 10 seconds after the start of dipping of the steel sheet 2 in the hot-dip plating bath, and the application of vibration was continued for 2 to 60 seconds.

As Comparative Examples, each sample material was subjected to dip plating using the hot-clip plating apparatus 80 without applying vibration to the interior portion of the hot-dip plating bath. Except for the above, Comparative Examples were carried out in the same manner as the foregoing Example 1-1. The results of the test are collectively shown in Table 11.

TABLE 11

| No. | Thickness of sheet (mm) | Substrate | Plating bath type | Plating bath atmosphere | Whether substrate was heated or not | Inlet temperature | Plating bath temperature (° C.) | Conditions under which vibration was applied: Frequency (kHz) | Conditions under which vibration was applied: Power (%) |
|---|---|---|---|---|---|---|---|---|---|
| 321 | 0.8 | A | Zn—Al—Mg base | Atmospheric air | Not | Room temperature | 380 | 20 | 100 |
| 322 | 0.8 | A | | | | | 400 | 20 | 100 |
| 323 | 0.8 | A | | | | | 450 | 20 | 100 |
| 324 | 0.8 | A | | | | | 500 | 20 | 100 |
| 325 | 0.8 | A | | | | | 550 | 20 | 100 |
| 326 | 0.8 | A | | | | | 450 | 20 | 100 |
| 327 | 0.8 | A | | | | | | 20 | 100 |
| 328 | 0.8 | A | | | | | | 20 | 100 |
| 329 | 0.8 | A | | | | | | 20 | 100 |
| 330 | 0.8 | A | | | | | | 20 | 100 |
| 331 | 0.8 | A | | | | | | 20 | 100 |
| 332 | 0.8 | A | | | | | | 20 | 100 |
| 333 | 0.8 | A | | | | | | 20 | 100 |
| 334 | 0.8 | A | | | | | | 20 | 100 |
| 335 | 0.8 | A | | | | | | 20 | 100 |
| 336 | 0.8 | A | | | | | | 20 | 60 |
| 337 | 0.8 | A | | | | | | 20 | 60 |
| 338 | 0.8 | A | | | | | | 20 | 60 |
| 339 | 0.8 | A | | | | | | 20 | 20 |
| 340 | 0.8 | A | | | | | | 20 | 20 |
| 341 | 0.8 | A | | | | | | 20 | 20 |

TABLE 11-continued

| | | | | | | | | | |
|---|---|---|---|---|---|---|---|---|---|
| 342 | 1.4 | A | | | | | | 20 | 100 |
| 343 | 1.4 | B | | | | | | 20 | 100 |
| 344 | 0.8 | C | | | | | | 20 | 100 |
| 345 | 1.0 | D | | | | | | 20 | 100 |
| 346 | 1.0 | E | | | | | | 20 | 100 |
| 347 | 1.1 | F | | | | | | 20 | 100 |
| 348 | 0.8 | A | Zn—Al—Mg base | Atmospheric air | Not | Room temperature | 450 | No vibration application | |
| 349 | 1.4 | B | | | | | | | |
| 350 | 0.8 | C | | | | | | | |
| 351 | 1.0 | D | | | | | | | |
| 352 | 1.0 | E | | | | | | | |
| 353 | 1.1 | E | | | | | | | |

| | Conditions under which vibration was applied | | Acoustic spectrum in bath | | | | |
|---|---|---|---|---|---|---|---|
| No. | Distance between horn and sheet (mm) | Time for which supersonic vibration was applied (sec) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 321 | 0 | 2 | 35.8 | 31.6 | 0.88 | Excellent | Examples |
| 322 | 0 | 2 | 36.2 | 32.2 | 0.89 | Excellent | |
| 323 | 0 | 2 | 36.3 | 31.9 | 0.88 | Excellent | |
| 324 | 0 | 2 | 36.5 | 32.5 | 0.89 | Excellent | |
| 325 | 0 | 2 | 35.5 | 32.3 | 0.91 | Excellent | |
| 326 | 2 | 2 | 35.2 | 31.2 | 0.89 | Excellent | |
| 327 | 5 | 2 | 36.3 | 31.8 | 0.88 | Good | |
| 328 | 5 | 5 | 34.9 | 32.1 | 0.92 | Excellent | |
| 329 | 10 | 2 | 36.2 | 32.1 | 0.89 | Good | |
| 330 | 10 | 5 | 35.5 | 32.2 | 0.91 | Good | |
| 331 | 10 | 10 | 35.2 | 31.5 | 0.89 | Good | |
| 332 | 10 | 20 | 34.9 | 31.6 | 0.91 | Excellent | |
| 333 | 20 | 20 | 34.6 | 31.2 | 0.90 | Fair | |
| 334 | 20 | 60 | 35.9 | 32.1 | 0.89 | Excellent | |
| 335 | 50 | 60 | 34.5 | 31.4 | 0.91 | Fair | |
| 336 | 2 | 2 | 38.5 | 34.1 | 0.89 | Excellent | |
| 337 | 5 | 2 | 38.7 | 34.2 | 0.88 | Excellent | |
| 338 | 10 | 2 | 38.6 | 34.3 | 0.89 | Good | |
| 339 | 2 | 2 | 42.1 | 40.3 | 0.96 | Excellent | |
| 340 | 5 | 2 | 41.2 | 39.9 | 0.97 | Excellent | |
| 341 | 10 | 2 | 42.3 | 40.1 | 0.95 | Good | |
| 342 | 0 | 2 | 36.2 | 31.8 | 0.88 | Excellent | |
| 343 | 0 | 2 | 35.4 | 32.4 | 0.92 | Excellent | |
| 344 | 0 | 2 | 35.1 | 32.1 | 0.91 | Excellent | |
| 345 | 0 | 2 | 35.3 | 31.3 | 0.89 | Excellent | |
| 346 | 0 | 2 | 36.2 | 32.2 | 0.89 | Excellent | |
| 347 | 0 | 2 | 36.1 | 30.9 | 0.86 | Excellent | |
| 348 | — | — | — | — | — | Very poor | Comparative |
| 349 | | | | | | Very poor | Examples |
| 350 | | | | | | Very poor | |
| 351 | | | | | | Very poor | |
| 352 | | | | | | Very poor | |
| 353 | | | | | | Very poor | |

As shown in Nos. 321 to 347 of Table 11, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was less than 10% in all conditions in which plating was carried out.

In contrast, in cases where hot-dip plating was carried out without applying vibration to the interior portion of the hot-dip plating bath, the holiday rate of the plated product was 80% or more, as shown in Nos. 348 to 353 of Table 11.

Example 3-2: Al—Si-Based Hot-Dip Plating Bath Type was Used

Similarly to the foregoing Example 1, steel sheets A to F (see Tables 1 and 2) were used, and the an Al-9mass % Si-2mass % Fe-based plating bath used in Example 1-2 of the foregoing Example 1 was used as a hot-dip plating bath to carry out hot-dip plating under various conditions.

In cases where vibration was applied to the interior portion of the hot-dip plating bath with use of the ultrasonic horn 10A, the distance L2 was 0 mm to 5 mm and the fundamental frequency was 20 kHz. In cases where vibration was applied to the interior portion of the hot-dip plating bath with use of the ultrasonic horn 10A, the application of vibration was started 10 seconds after the start of dipping of the steel sheet 2 in the hot-dip plating bath, and the application of vibration was continued for 2 seconds. Except for those described above, Example 3-2 was carried out in the same manner as Example 1-2. The results of the test are collectively shown in Table 12.

TABLE 12

| No. | Thickness of sheet (mm) | Substrate | Plating bath type | Plating bath atmosphere | Whether substrate was heated or not | Inlet temperature | Plating bath temperature (° C.) | Frequency (kHz) | Power (W) |
|---|---|---|---|---|---|---|---|---|---|
| 361 | 0.8 | A | Al—9%Si base | Atmospheric air | Not | Room temperature | 630 | 20 | 100 |
| 362 | 0.8 | A | | | | | 660 | 20 | 100 |
| 363 | 0.8 | A | | | | | 700 | 20 | 100 |
| 364 | 0.8 | A | | | | | 660 | 20 | 100 |
| 365 | 0.8 | A | | | | | | 20 | 100 |
| 366 | 1.4 | B | | | | | | 20 | 100 |
| 367 | 0.8 | C | | | | | | 20 | 100 |
| 368 | 1.0 | D | | | | | | 20 | 100 |
| 369 | 1.0 | E | | | | | | 20 | 100 |
| 370 | 1.1 | F | | | | | | 20 | 100 |
| 371 | 0.8 | A | Al—9%Si base | Atmospheric air | Not | Room temperature | 660 | No vibration application | |
| 372 | 1.4 | B | | | | | | | |
| 373 | 0.8 | C | | | | | | | |
| 374 | 1.0 | D | | | | | | | |
| 375 | 1.0 | E | | | | | | | |
| 376 | 1.1 | F | | | | | | | |

| No. | Distance between horn and sheet (mm) | Time for which supersonic vibration was applied (sec) | Acoustic spectrum in bath: Acoustic intensity (IA-NA) (dBm) | Acoustic spectrum in bath: Average intensity over ranges each lying between integer multiple harmonics (IB-NB) (dBm) | Acoustic spectrum in bath: Ratio of average intensity over ranges each between integer multiple harmonics to acoustic intensity (IB-NB)/(IA-NA) | Plating wettability | Evaluation |
|---|---|---|---|---|---|---|---|
| 361 | 0 | 2 | 36.6 | 32.4 | 0.89 | Excellent | Examples |
| 362 | 0 | 2 | 35.5 | 32.1 | 0.90 | Excellent | |
| 363 | 0 | 2 | 34.5 | 31.3 | 0.91 | Excellent | |
| 364 | 2 | 2 | 36.4 | 32.1 | 0.88 | Excellent | |
| 365 | 5 | 2 | 35.2 | 31.2 | 0.89 | Excellent | |
| 366 | 0 | 2 | 36.3 | 31.8 | 0.88 | Excellent | |
| 367 | 0 | 2 | 34.9 | 31.1 | 0.89 | Excellent | |
| 368 | 0 | 2 | 36.4 | 32.2 | 0.88 | Excellent | |
| 369 | 0 | 2 | 35.9 | 32.6 | 0.91 | Excellent | |
| 370 | 0 | 2 | 35.2 | 31.2 | 0.89 | Excellent | |
| 371 | — | — | — | — | — | Very poor | Comparative |
| 372 | | | — | — | — | Very poor | Examples |
| 373 | | | — | — | — | Very poor | |
| 374 | | | — | — | — | Very poor | |
| 375 | | | — | — | — | Very poor | |
| 376 | | | — | — | — | Very poor | |

As shown in Nos. 361 to 370 of Table 12, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was 0%.

In contrast, in cases where hot-dip plating was carried out without applying vibration to the interior portion of the hot-dip plating bath, the holiday rate of the plated product was 80% or more as shown in Nos. 371 to 376 of Table 12.

Example 3-3: Various Hot-Dip Plating Bath Types were Used

Similarly to the foregoing Example 1, steel sheets A to F (see Tables 1 and 2) were used, and various hot-dip plating baths shown in Example 2 (Example 2-3) of Embodiment 3 were each used as a hot-dip plating bath to carry out hot-dip plating under various conditions.

In cases where vibration was applied to the internal portion of the hot-dip plating bath with use of the ultrasonic horn 10A, the distance L2 was 0 mm and the fundamental frequency was 20 kHz. Except for the above, Example 3-3 was carried out in the same manner as Example 1-3. The results of the test are collectively shown in Table 13.

TABLE 13

| No. | Thickness of sheet (mm) | Substrate | Plating bath type | Plating bath atmosphere | Whether substrate was heated or not | Inlet temperature | Plating bath temperature (° C.) | Conditions under which vibration was applied: Frequency (kHz) | Conditions under which vibration was applied: Power (%) |
|---|---|---|---|---|---|---|---|---|---|
| 381 | 0.8 | A | M1 | Atmospheric air | Not | Room temperature | 430 | 20 | 100 |
| 382 | | | M2 | | | | 430 | | |
| 383 | | | M3 | | | | 430 | | |
| 384 | | | M4 | | | | 430 | | |
| 385 | | | M5 | | | | 450 | | |
| 386 | | | M6 | | | | 450 | | |
| 387 | | | M7 | | | | 470 | | |
| 388 | | | M8 | | | | 660 | | |
| 389 | | | M9 | | | | 660 | | |
| 390 | | | M10 | | | | 660 | | |
| 391 | | | M11 | | | | 700 | | |
| 392 | | | M12 | | | | 280 | | |
| 393 | 0.8 | B | M1 | Atmospheric air | Not | Room temperature | 430 | 20 | 100 |
| 394 | | | M2 | | | | 430 | | |
| 395 | | | M3 | | | | 430 | | |
| 396 | | | M4 | | | | 430 | | |
| 397 | | | M5 | | | | 450 | | |
| 398 | | | M6 | | | | 450 | | |
| 399 | | | M7 | | | | 470 | | |
| 400 | | | M8 | | | | 660 | | |
| 401 | | | M9 | | | | 660 | | |
| 402 | | | M10 | | | | 660 | | |
| 403 | | | M11 | | | | 700 | | |
| 404 | | | M12 | | | | 280 | | |
| 405 | 0.8 | C | M1 | Atmospheric air | Not | Room temperature | 430 | 20 | 100 |
| 406 | | | M2 | | | | 430 | | |
| 407 | | | M3 | | | | 430 | | |
| 408 | | | M4 | | | | 430 | | |
| 409 | | | M5 | | | | 450 | | |
| 410 | | | M6 | | | | 450 | | |
| 411 | | | M7 | | | | 470 | | |
| 412 | | | M8 | | | | 660 | | |
| 413 | | | M9 | | | | 660 | | |
| 414 | | | M10 | | | | 660 | | |
| 415 | | | M11 | | | | 700 | | |
| 416 | | | M12 | | | | 280 | | |
| 417 | 0.8 | D | M1 | Atmospheric air | Not | Room temperature | 430 | 20 | 100 |
| 418 | | | M2 | | | | 430 | | |
| 419 | | | M3 | | | | 430 | | |
| 420 | | | M4 | | | | 430 | | |
| 421 | | | M5 | | | | 450 | | |
| 422 | | | M6 | | | | 450 | | |
| 423 | | | M7 | | | | 470 | | |
| 424 | | | M8 | | | | 660 | | |
| 425 | | | M9 | | | | 660 | | |
| 426 | | | M10 | | | | 660 | | |
| 427 | | | M11 | | | | 700 | | |
| 428 | | | M12 | | | | 280 | | |
| 429 | 0.8 | E | M1 | Atmospheric air | Not | Room temperature | 430 | 20 | 100 |
| 430 | | | M2 | | | | 430 | | |
| 431 | | | M3 | | | | 430 | | |
| 432 | | | M4 | | | | 430 | | |
| 433 | | | M5 | | | | 450 | | |
| 434 | | | M6 | | | | 450 | | |
| 435 | | | M7 | | | | 470 | | |
| 436 | | | M8 | | | | 660 | | |
| 437 | | | M9 | | | | 660 | | |
| 438 | | | M10 | | | | 660 | | |
| 439 | | | M11 | | | | 700 | | |
| 440 | | | M12 | | | | 280 | | |
| 441 | 0.8 | F | M1 | Atmospheric air | Not | Room temperature | 430 | 20 | 100 |
| 442 | | | M2 | | | | 430 | | |
| 443 | | | M3 | | | | 430 | | |
| 444 | | | M4 | | | | 430 | | |
| 445 | | | M5 | | | | 450 | | |
| 446 | | | M6 | | | | 450 | | |
| 447 | | | M7 | | | | 470 | | |
| 448 | | | M8 | | | | 660 | | |
| 449 | | | M9 | | | | 660 | | |
| 450 | | | M10 | | | | 660 | | |
| 451 | | | M11 | | | | 700 | | |
| 452 | | | M12 | | | | 280 | | |
| 453 | 0.8 | A | M1 | Atmospheric air | Not | Room temperature | 430 | No vibration application | |
| 454 | | | M2 | | | | 430 | | |

TABLE 13-continued

| | | |
|---|---|---|
| 455 | M3 | 430 |
| 456 | M4 | 430 |
| 457 | M5 | 450 |
| 458 | M6 | 450 |
| 459 | M7 | 470 |
| 460 | M8 | 660 |
| 461 | M9 | 660 |
| 462 | M10 | 660 |
| 463 | M11 | 700 |
| 464 | M12 | 280 |

| | Conditions under which vibration was applied | | Acoustic spectrum in bath | | | | |
|---|---|---|---|---|---|---|---|
| No. | Distance between horn and sheet (mm) | Time for which supersonic vibration was applied (sec) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 381 | 0 | 2 | 34.9 | 31.1 | 0.89 | Excellent | Examples |
| 382 | | | 36.2 | 31.9 | 0.88 | Excellent | |
| 383 | | | 35.5 | 32.2 | 0.91 | Excellent | |
| 384 | | | 36.2 | 30.1 | 0.83 | Excellent | |
| 385 | | | 36.2 | 32.1 | 0.89 | Excellent | |
| 386 | | | 36.5 | 31.5 | 0.86 | Excellent | |
| 387 | | | 36.2 | 32.1 | 0.89 | Excellent | |
| 388 | | | 36.2 | 31.9 | 0.83 | Excellent | |
| 389 | | | 36.2 | 32.1 | 0.89 | Excellent | |
| 390 | | | 36.6 | 32.2 | 0.88 | Excellent | |
| 391 | | | 36.5 | 32.1 | 0.88 | Excellent | |
| 392 | | | 36.2 | 31.9 | 0.88 | Excellent | |
| 393 | 0 | 2 | 34.5 | 31.2 | 0.90 | Excellent | |
| 394 | | | 36.6 | 32.2 | 0.88 | Excellent | |
| 395 | | | 36.5 | 32.1 | 0.88 | Excellent | |
| 396 | | | 36.2 | 31.9 | 0.88 | Excellent | |
| 397 | | | 36.2 | 32.1 | 0.89 | Excellent | |
| 398 | | | 36.5 | 31.5 | 0.86 | Excellent | |
| 399 | | | 36.5 | 31.4 | 0.86 | Excellent | |
| 400 | | | 36.3 | 31.9 | 0.88 | Excellent | |
| 401 | | | 36.5 | 30.9 | 0.85 | Excellent | |
| 402 | | | 36.2 | 31.9 | 0.88 | Excellent | |
| 403 | | | 36.2 | 32.1 | 0.89 | Excellent | |
| 404 | | | 36.5 | 31.5 | 0.86 | Excellent | |
| 405 | 0 | 2 | 36.2 | 31.1 | 0.86 | Excellent | |
| 406 | | | 36.2 | 32.1 | 0.89 | Excellent | |
| 407 | | | 34.5 | 30.9 | 0.90 | Excellent | |
| 408 | | | 36.4 | 32.1 | 0.88 | Excellent | |
| 409 | | | 36.2 | 32.3 | 0.89 | Excellent | |
| 410 | | | 36.5 | 31.5 | 0.86 | Excellent | |
| 411 | | | 34.9 | 32.1 | 0.92 | Excellent | |
| 412 | | | 36.5 | 31.4 | 0.86 | Excellent | |
| 413 | | | 36.3 | 31.9 | 0.88 | Excellent | |
| 414 | | | 36.5 | 32.1 | 0.88 | Excellent | |
| 415 | | | 36.2 | 31.9 | 0.88 | Excellent | |
| 416 | | | 36.2 | 32.1 | 0.89 | Excellent | |
| 417 | 0 | 2 | 36.5 | 31.5 | 0.86 | Excellent | |
| 418 | | | 36.3 | 31.9 | 0.88 | Excellent | |
| 419 | | | 36.5 | 32.1 | 0.88 | Excellent | |
| 420 | | | 36.2 | 32.1 | 0.89 | Excellent | |
| 421 | | | 36.5 | 32.5 | 0.89 | Excellent | |
| 422 | | | 35.5 | 32.1 | 0.90 | Excellent | |
| 423 | | | 35.2 | 31.2 | 0.89 | Excellent | |
| 424 | | | 36.3 | 31.8 | 0.88 | Excellent | |
| 425 | | | 34.9 | 31.1 | 0.89 | Excellent | |
| 426 | | | 36.2 | 32.1 | 0.89 | Excellent | |
| 427 | | | 34.9 | 31.8 | 0.91 | Excellent | |
| 428 | | | 36.4 | 32.1 | 0.88 | Excellent | |
| 429 | 0 | 2 | 36.2 | 32.5 | 0.90 | Excellent | |
| 430 | | | 35.5 | 32.1 | 0.90 | Excellent | |
| 431 | | | 35.2 | 31.2 | 0.89 | Excellent | |
| 432 | | | 36.3 | 31.8 | 0.88 | Excellent | |
| 433 | | | 34.9 | 31.1 | 0.89 | Excellent | |
| 434 | | | 36.2 | 32.1 | 0.89 | Excellent | |
| 435 | | | 35.5 | 32.2 | 0.91 | Excellent | |
| 436 | | | 35.7 | 32.2 | 0.90 | Excellent | |
| 437 | | | 36.6 | 32.1 | 0.88 | Excellent | |
| 438 | | | 36.3 | 31.8 | 0.88 | Excellent | |
| 439 | | | 34.9 | 31.1 | 0.89 | Excellent | |

TABLE 13-continued

| | | | | | | | |
|---|---|---|---|---|---|---|---|
| 440 | | | 35.7 | 32.2 | 0.90 | Excellent | |
| 441 | 0 | 2 | 36.6 | 32.1 | 0.88 | Excellent | |
| 442 | | | 35.5 | 32.1 | 0.90 | Excellent | |
| 443 | | | 36.5 | 31.9 | 0.87 | Excellent | |
| 444 | | | 36.4 | 32.1 | 0.88 | Excellent | |
| 445 | | | 36.2 | 32.4 | 0.90 | Excellent | |
| 446 | | | 36.2 | 32.1 | 0.89 | Excellent | |
| 447 | | | 35.5 | 32.2 | 0.91 | Excellent | |
| 448 | | | 35.9 | 32.4 | 0.90 | Excellent | |
| 449 | | | 36.6 | 32.1 | 0.88 | Excellent | |
| 450 | | | 36.3 | 31.8 | 0.88 | Excellent | |
| 451 | | | 34.9 | 31.1 | 0.89 | Excellent | |
| 452 | | | 37.8 | 32.1 | 0.85 | Excellent | |
| 453 | — | — | — | — | — | Very poor | Comparative |
| 454 | | | | | | Very poor | Examples |
| 455 | | | | | | Very poor | |
| 456 | | | | | | Very poor | |
| 457 | | | | | | Very poor | |
| 458 | | | | | | Very poor | |
| 459 | | | | | | Very poor | |
| 460 | | | | | | Very poor | |
| 461 | | | | | | Very poor | |
| 462 | | | | | | Very poor | |
| 463 | | | | | | Very poor | |
| 464 | | | | | | Very poor | |

As shown in Nos. 381 to 452 of Table 13, in cases where a steel sheet was subjected to dip plating while vibration was applied to the interior portion of the hot-dip plating bath under the conditions in which an acoustic spectrum within the scope of the present invention was measured in the hot-dip plating bath, platability for the steel sheet improved, and the holiday rate of the plated product was 0%.

In contrast, in cases where hot-dip plating was carried out without applying vibration to the interior portion of the hot-dip plating bath, the holiday rate of the plated product was 80% or more as shown in Nos. 453 to 464 of Table 13.

Embodiment 6

The following description will discuss another embodiment of the present invention. For convenience of description, members having functions identical to those described in the foregoing embodiments are assigned identical referential numerals and their descriptions are omitted.

In a hot-dip plating method in accordance with Embodiment 6, continuous hot-dip plating equipment in which a steel strip is continuously passed through a hot-dip plating bath is used, and a part of an ultrasonic horn is dipped in the hot-clip plating bath so that the tip of the ultrasonic horn is located near the steel strip. The steel strip is continuously subjected to hot-dip plating while vibration is applied to the hot-dip plating bath or the steel strip from the tip of the ultrasonic horn.

(Hot-Dip Plating Equipment)

The following description will discuss hot-dip plating equipment 90A which carries out a hot-dip plating method in accordance with Embodiment 6, with reference to FIG. 11. Note that the hot-dip plating apparatus 90A is an example, and an apparatus that carries out the present hot-dip plating method is not particularly limited. FIG. 11 schematically illustrates an example of the hot-dip plating equipment 90A which carries out the hot-dip plating method in accordance with Embodiment 6.

As illustrated in FIG. 1.1, the hot-clip plating equipment 90A has a configuration that is different from typical continuous hot-dip plating equipment in that the hot-dip plating equipment 90A additionally includes an ultrasonic horn 10B and a measuring unit 50. A steel strip 2A is dipped in a hot-dip plating bath 20 through a snout 91. The steel strip 2A is passed through the hot-dip plating bath 20 by a guide roll 92 and support rolls 93, and then withdrawn from the hot-dip plating bath 20 and the amount of adhering plating is adjusted by, for example, gas spraying.

The steel strip 2A may be subjected to, for example, a pickling treatment as a pre-treatment prior to a plating step, thereby removing an iron oxide layer from the surface of the steel strip 2A. The hot-dip plating equipment 90A may be configured such that the steel strip 2A is heated to a temperature suitable for hot-dip plating with a heating apparatus (not illustrated) provided upstream of the snout 91.

Note here that, unlike typical continuous hot-dip plating equipment, the hot-dip plating equipment 90A does not need to include a reducing/heating apparatus upstream of the snout 91. In the hot-dip plating equipment 90A, ultrasonic vibration is applied to the interior portion of the hot-dip plating bath 20 with use of the ultrasonic horn 10B; therefore, even if the surface of the steel strip 2A is not subjected to a reduction treatment, the plating wettability for the steel strip 2A can be improved.

The ultrasonic horn 10B in accordance with Embodiment 6 is a single-component device including an ultrasonic transducer 11, a distal part (portion) 17, and a joint part (portion) 16 of the ultrasonic horn 10A described earlier in Embodiment 5. Note that the hot-dip plating equipment 90A may include the ultrasonic horn 10A instead of the ultrasonic horn 10B.

The hot-dip plating equipment 90A is configured such that: the ultrasonic horn 10B is disposed such that the tip of the ultrasonic horn 10B is dipped in the hot-dip plating bath 20 and is located near the steel strip 2A in the vicinity of the exit of the snout 91.

The ultrasonic horn 10B preferably has its end, which is closer to the steel strip 2A along the longitudinal direction than the other end, chamfered to have a vibrating surface 17A. The vibrating surface 17A faces a surface of the steel strip 2A passing through the hot-dip plating bath 20. This makes it possible to make the distance between the vibrating surface 17A and the surface of the steel strip 2A constant in accordance with the direction of advancement of the steel strip 2A, and possible to efficiently transmit vibration from the ultrasonic horn 10B to the steel strip 2A.

Furthermore, the hot-dip plating equipment 90A is configured such that the tip of a waveguide probe 51 is disposed in the vicinity of a second surface of the steel strip 2A opposite a first surface that faces the vibrating surface 17A in the hot-dip plating bath 20. The waveguide probe 51 is preferably disposed parallel to the direction of advancement of the steel strip 2A. The waveguide probe 51 may be provided with, for example, a protecting tube that covers a portion of the waveguide probe 51 present in the hot-dip plating bath 20 except for the tip of the waveguide probe 51, in order to reduce, for example, noise in an acoustic spectrum.

The distance L3 between the vibrating surface 17A and the surface of the steel sheet 2A may be 0 mm, and may be more than 0 mm and not more than 50 mm. A distance L3 of 0 mm means that the vibrating surface 17A and the surface of the steel sheet 2A are in contact with each other at the point in time in which the ultrasonic horn 10B is not performing ultrasonic vibration yet (i.e., at the point in time in which the ultrasonic horn 10B is set).

Although ultrasonic vibration is applied from the ultrasonic horn 10B to one surface of the steel strip 2A, the steel strip 2A can be caused to vibrate at the same fundamental frequency as that of the ultrasonic horn 10B, provided that the distance L3 is small enough. As a result, it is possible to improve plating wettability not only for the first surface of the steel strip 2A but also for the second surface of the steel strip 2A.

The frequency, power, and the like of the vibration applied to the interior portion of the hot-dip plating bath 20 with use of the ultrasonic horn 10B in the hot-dip plating equipment 90A are the same as those described earlier in Embodiment 1.

(Variations of Hot-Dip Plating Equipment)

FIG. 12 schematically illustrates hot-dip plating equipment 90B and hot-dip plating equipment 90C, which are variations.

The hot-dip plating equipment 90B and hot-dip plating equipment 90C differ from the foregoing hot-dip plating equipment 90A in that the ultrasonic horn 10B is disposed in the vicinity of a support roll 93. In the hot-dip plating equipment 90B and the hot-dip plating equipment 90C, the ultrasonic horn 10B is disposed downstream of a point where the steel strip 2A passes over the support roll 93 in the dip plating bath 20. Even in cases where the ultrasonic horn 10B is disposed as such, the plating wettability for the steel strip 2A can be improved by applying ultrasonic vibration from the ultrasonic horn 10B to the hot-dip plating bath 20 or the steel strip 2A.

Note that the following configuration may be employed: the ultrasonic horns 10B disposed in the same manner as those of the hot-dip plating equipment 90A to the hot-dip plating equipment 90C are used in combination; and such a plurality of ultrasonic horns 10B are used to apply ultrasonic vibration to the hot-dip plating bath 20 or the steel strip 2A. It is only necessary to appropriately select a configuration in which good platability for the steel strip 2A is achieved.

In the hot-dip plating equipment 90A to hot-dip plating equipment 90C, it is only necessary to appropriately adjust the speed of advancement of the steel strip 2A so that good platability for the steel strip 2A is achieved, instead of specifying the time for which ultrasonic vibration is applied to the steel strip 2A.

Example 4

The following description will discuss an Example of a hot-dip plating method in accordance with Embodiment 6 of the present invention. In Example 4, the foregoing hot-dip plating equipment 90A illustrated in FIG. 11 was used.

Specifically, pieces of equipment used in the hot-dip plating equipment 90A in accordance with Example 4 are as follows.

(Ultrasonic Vibration Supply System)

Ultrasonic transducer 11: 20 kHz transducer manufactured by hielscher

Joint part 16 (adaptor): Material is <Ti>, 1/2 wavelength type, length is 126 mm Distal part (portion) 17: Material is <Super Sialon>, double wavelength type, length is 500 mm Ultrasonic power supply apparatus D1: 20 kHz, 2 kW power source manufactured by hielscher (Ultrasonic Vibration Measuring System)

Waveguide probe 51: Material is <SUS430>, φ6 mm×300 mm

AE sensor 52: AE-900M manufactured by N F Corporation

Measuring section 53

Amplifier: AE9922 manufactured by N F Corporation

Spectrum analyzer: E4408B manufactured by Agilent Technologies Japan, Ltd.

Example 4-1: Heat Treatment Preceding Hot-Dip Plating Step was not Carried Out Similarly to the foregoing Example 1, steel sheets A to F (see Tables 1 and 2) were used, and a Zn—Al—Mg-based hot-dip plating bath or a Al-9mass % Si-2mass % Fe-based plating bath was used to carry out hot-dip plating under various conditions.

The atmosphere in the snout was changed to air atmosphere, nitrogen atmosphere, 3% hydrogen-nitrogen atmosphere, or 30% hydrogen-nitrogen atmosphere.

In cases where vibration was applied to the interior portion of the hot-dip plating bath with use of the ultrasonic horn 10B, the distance L3 was 0 mm and the fundamental frequency was 20 kHz. The speed of advancement of the steel strip through the hot-dip plating bath was 20 m/min.

As Comparative Examples, the steel strip 2A was subjected to continuous hot-dip plating using the hot-dip plating equipment 90A without applying vibration to the interior portion of the hot-dip plating bath. The results of the test are collectively shown in Table 14.

TABLE 14

| | Thickness | | | Plating bath | | Whether substrate | Substrate | | Conditions under which vibration was applied | |
|---|---|---|---|---|---|---|---|---|---|---|
| No. | of sheet (mm) | Substrate | Plating bath type | temperature (° C.) | Plating bath atmosphere | was heated or not | heating atmosphere | Inlet temperature | Frequency (kHz) | Power (%) |
| 471 | 0.8 | A | Zn—Al—Mg base | 450 | Atmospheric air | Not | — | Room temperature | 20 | 100 |
| 472 | 1.4 | B | | | | | | | | |
| 473 | 0.8 | C | | | | | | | | |
| 474 | 1.0 | D | | | | | | | | |

TABLE 14-continued

| | | | | | | | | | | |
|---|---|---|---|---|---|---|---|---|---|---|
| 475 | 1.0 | E | | | | | | | | |
| 476 | 1.1 | F | | | | | | | | |
| 477 | 0.8 | A | Al—9%Si base | 660 | | | | | | |
| 478 | 1.4 | B | | | | | | | | |
| 479 | 0.8 | C | | | | | | | | |
| 480 | 1.0 | D | | | | | | | | |
| 481 | 1.0 | E | | | | | | | | |
| 482 | 1.1 | F | | | | | | | | |
| 483 | 0.8 | A | Zn—Al—Mg base | 450 | $N_2$ | Not | — | Room temperature | 20 | 100 |
| 484 | 1.4 | B | | | | | | | | |
| 485 | 0.8 | C | | | | | | | | |
| 486 | 1.0 | D | | | | | | | | |
| 487 | 1.0 | E | | | | | | | | |
| 488 | 1.1 | F | | | | | | | | |
| 489 | 0.8 | A | Al—9%Si base | 660 | | | | | | |
| 490 | 1.4 | B | | | | | | | | |
| 491 | 0.8 | C | | | | | | | | |
| 492 | 1.0 | D | | | | | | | | |
| 493 | 1.0 | E | | | | | | | | |
| 494 | 1.1 | F | | | | | | | | |
| 495 | 0.8 | A | Zn—Al—Mg base | 450 | 3%$H_2$— $N_2$ | Not | — | Room temperature | 20 | 100 |
| 496 | 1.4 | B | | | | | | | | |
| 497 | 0.8 | C | | | | | | | | |
| 498 | 1.0 | D | | | | | | | | |
| 499 | 1.0 | E | | | | | | | | |
| 500 | 1.1 | F | | | | | | | | |
| 501 | 0.8 | A | Al—9%Si base | 660 | | | | | | |
| 502 | 1.4 | B | | | | | | | | |
| 503 | 0.8 | C | | | | | | | | |
| 504 | 1.0 | D | | | | | | | | |
| 505 | 1.0 | E | | | | | | | | |
| 506 | 1.1 | F | | | | | | | | |
| 507 | 0.8 | A | Zn—Al—Mg base | 450 | 30%$H_2$—$N_2$ | Not | — | Room temperature | 20 | 100 |
| 508 | 1.4 | B | | | | | | | | |
| 509 | 0.8 | C | | | | | | | | |
| 510 | 1.0 | D | | | | | | | | |
| 511 | 1.0 | E | | | | | | | | |
| 512 | 1.1 | F | | | | | | | | |
| 513 | 0.8 | A | Al—9%Si base | 660 | | | | | | |
| 514 | 1.4 | B | | | | | | | | |
| 515 | 0.8 | C | | | | | | | | |
| 516 | 1.0 | D | | | | | | | | |
| 517 | 1.0 | E | | | | | | | | |
| 518 | 1.1 | F | | | | | | | | |
| 519 | 0.8 | A | Zn—Al—Mg base | 450 | Atmospheric air | Not | — | Room temperature | No vibration application | |
| 520 | 0.8 | A | Al—9%Si base | 660 | Atmospheric air | | | | | |
| 521 | 0.8 | A | Zn—Al—Mg base | 450 | $N_2$ | | | | | |
| 522 | 0.8 | A | Al—9%Si base | 660 | $N_2$ | | | | | |
| 523 | 0.8 | A | Zn—Al—Mg base | 450 | 3%$H_2$—$N_2$ | | | | | |
| 524 | 0.8 | A | Al—9%Si base | 660 | 3%$H_2$—$N_2$ | | | | | |
| 525 | 0.8 | A | Zn—Al—Mg base | 450 | 30%$H_2$—$N_2$ | | | | | |
| 526 | 0.8 | A | Al—9%Si base | 660 | 30%$H_2$—$N_2$ | | | | | |
| 527 | 0.8 | C | Zn—Al—Mg base | 450 | Atmospheric air | | | | | |
| 528 | 0.8 | C | Al—9%Si base | 660 | Atmospheric air | | | | | |
| 529 | 0.8 | C | Zn—Al—Mg base | 450 | $N_2$ | | | | | |
| 530 | 0.8 | C | Al—9%Si base | 660 | $N_2$ | | | | | |
| 531 | 0.8 | C | Zn—Al—Mg base | 450 | 3%$H_2$—$N_2$ | | | | | |
| 532 | 0.8 | C | Al—9%Si base | 660 | 3%$H_2$—$N_2$ | | | | | |
| 533 | 0.8 | C | Zn—Al—Mg base | 450 | 30%$H_2$—$N_2$ | | | | | |
| 534 | 0.8 | C | Al—9%Si base | 660 | 30%$H_2$—$N_2$ | | | | | |

TABLE 14-continued

| No. | Conditions under which vibration was applied Distance between horn and sheet (mm) | Acoustic spectrum in bath: Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
|---|---|---|---|---|---|---|
| 471 | 0 | 36.5 | 32.5 | 0.89 | Excellent | Examples |
| 472 | | 35.5 | 32.1 | 0.90 | Excellent | |
| 473 | | 35.2 | 31.2 | 0.89 | Excellent | |
| 474 | | 36.3 | 31.8 | 0.88 | Excellent | |
| 475 | | 34.9 | 31.1 | 0.89 | Excellent | |
| 476 | | 36.2 | 32.3 | 0.89 | Excellent | |
| 477 | | 35.5 | 32.2 | 0.91 | Excellent | |
| 478 | | 36.2 | 30.1 | 0.83 | Excellent | |
| 479 | | 36.9 | 32.2 | 0.87 | Excellent | |
| 480 | | 36.8 | 31.6 | 0.86 | Excellent | |
| 481 | | 36.5 | 31.5 | 0.86 | Excellent | |
| 482 | | 36.4 | 32.1 | 0.88 | Excellent | |
| 483 | 0 | 35.1 | 31.2 | 0.89 | Excellent | Examples |
| 484 | | 36.2 | 32.2 | 0.89 | Excellent | |
| 485 | | 36.2 | 32.3 | 0.89 | Excellent | |
| 486 | | 36.4 | 32.1 | 0.88 | Excellent | |
| 487 | | 36.2 | 32.3 | 0.89 | Excellent | |
| 488 | | 36.2 | 32.1 | 0.89 | Excellent | |
| 489 | | 36.6 | 31.2 | 0.85 | Excellent | |
| 490 | | 36.7 | 32.1 | 0.87 | Excellent | |
| 491 | | 35.7 | 32.2 | 0.90 | Excellent | |
| 492 | | 36.6 | 32.1 | 0.83 | Excellent | |
| 493 | | 36.5 | 32.2 | 0.88 | Excellent | |
| 494 | | 36.0 | 31.1 | 0.86 | Excellent | |
| 495 | 0 | 36.7 | 32.2 | 0.88 | Excellent | Examples |
| 496 | | 35.7 | 32.4 | 0.91 | Excellent | |
| 497 | | 36.6 | 32.2 | 0.88 | Excellent | |
| 498 | | 36.5 | 32.1 | 0.83 | Excellent | |
| 499 | | 36.2 | 31.9 | 0.88 | Excellent | |
| 500 | | 34.5 | 31.2 | 0.90 | Excellent | |
| 501 | | 36.4 | 32.3 | 0.89 | Excellent | |
| 502 | | 35.2 | 31.4 | 0.89 | Excellent | |
| 503 | | 36.3 | 31.9 | 0.83 | Excellent | |
| 504 | | 34.9 | 31.0 | 0.89 | Excellent | |
| 505 | | 36.2 | 32.2 | 0.89 | Excellent | |
| 506 | | 36.1 | 32.2 | 0.89 | Excellent | |
| 507 | 0 | 35.2 | 31.2 | 0.89 | Excellent | Examples |
| 508 | | 36.3 | 31.8 | 0.88 | Excellent | |
| 509 | | 34.9 | 32.1 | 0.92 | Excellent | |
| 510 | | 36.5 | 31.4 | 0.86 | Excellent | |
| 511 | | 36.3 | 31.9 | 0.88 | Excellent | |
| 512 | | 36.2 | 32.3 | 0.89 | Excellent | |
| 513 | | 36.2 | 32.1 | 0.89 | Excellent | |
| 514 | | 36.5 | 31.4 | 0.86 | Excellent | |
| 515 | | 36.2 | 32.1 | 0.89 | Excellent | |
| 516 | | 36.5 | 31.5 | 0.86 | Excellent | |
| 517 | | 36.2 | 31.1 | 0.86 | Excellent | |
| 518 | | 35.9 | 31.9 | 0.89 | Excellent | |
| 519 | No vibration application | — | — | — | Very poor | Comparative Examples |
| 520 | | | | | Very poor | |
| 521 | | | | | Very poor | |
| 522 | | | | | Very poor | |
| 523 | | | | | Very poor | |
| 524 | | | | | Very poor | |
| 525 | | | | | Very poor | |
| 526 | | | | | Very poor | |
| 527 | | | | | Very poor | |
| 528 | | | | | Very poor | |
| 529 | | | | | Very poor | |
| 530 | | | | | Very poor | |
| 531 | | | | | Very poor | |
| 532 | | | | | Very poor | |
| 533 | | | | | Very poor | |
| 534 | | | | | Very poor | |

As shown in Nos. 471 to 518 of Table 14, in cases where a steel strip was subjected to hot-dip plating while vibration was applied to the interior portion of the hot-dip plating bath under the conditions in which an acoustic spectrum within the scope of the present invention was measured in the hot-dip plating bath, platability for the steel strip improved, and the holiday rate of the plated product was 0% in all conditions.

In contrast, in cases where hot-dip plating was carried out without applying vibration to the interior portion of the hot-dip plating bath, the holiday rate of the plated product was 80% or more in all conditions, as shown in Nos. 519 to 534 of Table 14.

Example 4-2: Heat Treatment Preceding Hot-Dip Plating Step was Carried Out

Continuous hot-dip plating was carried out in the same manner as described in Example 4-1, except that the steel strip was subjected to a heat treatment in an air atmosphere, a nitrogen atmosphere, a 3% hydrogen-nitrogen atmosphere, or a 30% hydrogen-nitrogen atmosphere, at a point upstream of the snout. The results of the test are collectively shown in Table 15.

TABLE 15

| No. | Thickness of sheet (mm) | Substrate | Plating bath type | Plating bath temperature (° C.) | Plating bath atmosphere | Substrate heating temperature (° C.) | Substrate heating atmosphere | Inlet temperature (° C.) | Conditions under which vibration was applied: Frequency (kHz) | Conditions under which vibration was applied: Power (%) |
|---|---|---|---|---|---|---|---|---|---|---|
| 541 | 0.8 | A | Zn—Al—Mg base | 450 | Atmospheric air | 500 | Atmospheric air | 460 | 20 | 100 |
| 542 | 1.4 | B | | | | | | | | |
| 543 | 0.8 | C | | | | | | | | |
| 544 | 1.0 | D | | | | | | | | |
| 545 | 1.0 | E | | | | | | | | |
| 546 | 1.1 | F | | | | | | | | |
| 547 | 0.8 | A | Al—9%Si base | 660 | | 680 | | 650 | | |
| 548 | 1.4 | B | | | | | | | | |
| 549 | 0.8 | C | | | | | | | | |
| 550 | 1.0 | D | | | | | | | | |
| 551 | 1.0 | E | | | | | | | | |
| 552 | 1.1 | F | | | | | | | | |
| 553 | 0.8 | A | Zn—Al—Mg base | 450 | $N_2$ | 500 | $N_2$ | 460 | 20 | 100 |
| 554 | 1.4 | B | | | | | | | | |
| 555 | 0.8 | C | | | | | | | | |
| 556 | 1.0 | D | | | | | | | | |
| 557 | 1.0 | E | | | | | | | | |
| 558 | 1.1 | F | | | | | | | | |
| 559 | 0.8 | A | Al—9%Si base | 660 | | 680 | | 650 | | |
| 560 | 1.4 | B | | | | | | | | |
| 561 | 0.8 | C | | | | | | | | |
| 562 | 1.0 | D | | | | | | | | |
| 563 | 1.0 | E | | | | | | | | |
| 564 | 1.1 | F | | | | | | | | |
| 565 | 0.8 | A | Zn—Al—Mg base | 450 | 3%$H_2$—$N_2$ | 500 | 3%$H_2$—$N_2$ | 460 | 20 | 100 |
| 566 | 1.4 | B | | | | | | | | |
| 567 | 0.8 | C | | | | | | | | |
| 568 | 1.0 | D | | | | | | | | |
| 569 | 1.0 | E | | | | | | | | |
| 570 | 1.1 | F | | | | | | | | |
| 571 | 0.8 | A | Al—9%Si base | 660 | | 680 | | 650 | | |
| 572 | 1.4 | B | | | | | | | | |
| 573 | 0.8 | C | | | | | | | | |
| 574 | 1.0 | D | | | | | | | | |
| 575 | 1.0 | E | | | | | | | | |
| 576 | 1.1 | F | | | | | | | | |
| 577 | 0.8 | A | Zn—Al—Mg base | 450 | 30%$H_2$—$N_2$ | 500 | 30%$H_2$—$N_2$ | 460 | 20 | 100 |
| 578 | 1.4 | B | | | | | | | | |
| 579 | 0.8 | C | | | | | | | | |
| 580 | 1.0 | D | | | | | | | | |
| 581 | 1.0 | E | | | | | | | | |
| 582 | 1.1 | F | | | | | | | | |
| 583 | 0.8 | A | Al—9%Si base | 660 | | 680 | | 650 | | |
| 584 | 1.4 | B | | | | | | | | |
| 585 | 0.8 | C | | | | | | | | |
| 586 | 1.0 | D | | | | | | | | |
| 587 | 1.0 | E | | | | | | | | |
| 588 | 1.1 | F | | | | | | | | |
| 589 | 0.8 | A | Zn—Al—Mg base | 450 | Atmospheric air | 500 | Atmospheric air | 460 | No vibration application | |
| 590 | 0.8 | A | Al—9%Si base | 660 | Atmospheric air | 680 | Atmospheric air | 650 | | |
| 591 | 0.8 | A | Zn—Al—Mg base | 450 | $N_2$ | 500 | $N_2$ | 460 | | |
| 592 | 0.8 | A | Al—9%Si base | 660 | $N_2$ | 680 | $N_2$ | 650 | | |

TABLE 15-continued

| | | | | | | | | |
|---|---|---|---|---|---|---|---|---|
| 593 | 0.8 | A | Zn—Al—Mg base | 450 | 3%$H_2$—$N_2$ | 500 | 3%$H_2$—$N_2$ | 460 |
| 594 | 0.8 | A | Al—9%Si base | 660 | 3%$H_2$—$N_2$ | 680 | 3%$H_2$—$N_2$ | 650 |
| 595 | 0.8 | A | Zn—Al—Mg base | 450 | 30%$H_2$—$N_2$ | 500 | 30%$H_2$—$N_2$ | 460 |
| 596 | 0.8 | A | Al—9%Si base | 660 | 30%$H_2$—$N_2$ | 680 | 30%$H_2$—$N_2$ | 650 |
| 597 | 0.8 | C | Zn—Al—Mg base | 450 | Atmospheric air | 500 | — | 460 |
| 598 | 0.8 | C | Al—9%Si base | 660 | Atmospheric air | 680 | — | 650 |
| 599 | 0.8 | C | Zn—Al—Mg base | 450 | $N_2$ | 500 | $N_2$ | 460 |
| 600 | 0.8 | C | Al—9%Si base | 660 | $N_2$ | 680 | $N_2$ | 650 |
| 601 | 0.8 | C | Zn—Al—Mg base | 450 | 3%$H_2$—$N_2$ | 500 | 3%$H_2$—$N_2$ | 460 |
| 602 | 0.8 | C | Al—9%Si base | 660 | 3%$H_2$—$N_2$ | 680 | 3%$H_2$—$N_2$ | 650 |
| 603 | 0.8 | C | Zn—Al—Mg base | 450 | 30%$H_2$—$N_2$ | 500 | 30%$H_2$—$N_2$ | 460 |
| 604 | 0.8 | C | Al—9%Si base | 660 | 30%$H_2$—$N_2$ | 680 | 30%$H_2$—$N_2$ | 650 |

| | | Acoustic spectrum in bath | | | | |
|---|---|---|---|---|---|---|
| No. | Conditions under which vibration was applied Distance between horn and sheet (mm) | Acoustic intensity (IA-NA) (dBm) | Average intensity over ranges each lying between integer multiple harmonics (IB-NB) (dBm) | Ratio of average intensity over ranges each between integer multiple harmonics to acoustic intensity (IB-NB)/(IA-NA) | Plating wettability | Evaluation |
| 541 | 0 | 35.5 | 32.1 | 0.90 | Good | Examples |
| 542 | | 35.2 | 31.2 | 0.89 | Good | |
| 543 | | 36.8 | 31.6 | 0.86 | Good | |
| 544 | | 36.5 | 31.5 | 0.86 | Good | |
| 545 | | 36.2 | 32.3 | 0.89 | Good | |
| 546 | | 36.2 | 30.1 | 0.83 | Good | |
| 547 | | 36.9 | 32.2 | 0.87 | Good | |
| 548 | | 36.8 | 31.6 | 0.86 | Good | |
| 549 | | 36.2 | 32.3 | 0.89 | Good | |
| 550 | | 36.2 | 32.1 | 0.89 | Good | |
| 551 | | 36.1 | 32.2 | 0.89 | Good | |
| 552 | | 36.5 | 32.3 | 0.88 | Good | |
| 553 | 0 | 36.5 | 32.1 | 0.88 | Excellent | Examples |
| 554 | | 36.6 | 32.4 | 0.89 | Excellent | |
| 555 | | 36.4 | 32.1 | 0.88 | Excellent | |
| 556 | | 36.2 | 32.3 | 0.89 | Excellent | |
| 557 | | 36.2 | 32.1 | 0.89 | Excellent | |
| 558 | | 36.2 | 30.1 | 0.83 | Excellent | |
| 559 | | 36.9 | 32.2 | 0.87 | Excellent | |
| 560 | | 36.8 | 31.6 | 0.86 | Excellent | |
| 561 | | 36.4 | 32.1 | 0.88 | Excellent | |
| 562 | | 36.2 | 32.3 | 0.89 | Excellent | |
| 563 | | 36.2 | 32.1 | 0.89 | Excellent | |
| 564 | | 36.9 | 33.2 | 0.90 | Excellent | |
| 565 | 0 | 36.6 | 33.1 | 0.90 | Excellent | Examples |
| 566 | | 36.2 | 32.3 | 0.89 | Excellent | |
| 567 | | 36.4 | 32.1 | 0.88 | Excellent | |
| 568 | | 38.3 | 33.3 | 0.87 | Excellent | |
| 569 | | 35.5 | 32.1 | 0.90 | Excellent | |
| 570 | | 35.2 | 31.2 | 0.89 | Excellent | |
| 571 | | 36.3 | 31.8 | 0.88 | Excellent | |
| 572 | | 36.8 | 31.6 | 0.86 | Excellent | |
| 573 | | 36.5 | 31.5 | 0.86 | Excellent | |
| 574 | | 36.4 | 32.1 | 0.88 | Excellent | |
| 575 | | 36.2 | 32.3 | 0.89 | Excellent | |
| 576 | | 36.2 | 32.1 | 0.89 | Excellent | |
| 577 | 0 | 38.1 | 32.3 | 0.85 | Excellent | Examples |
| 578 | | 36.2 | 32.3 | 0.89 | Excellent | |
| 579 | | 36.4 | 32.1 | 0.88 | Excellent | |
| 580 | | 37.6 | 32.9 | 0.88 | Excellent | |
| 581 | | 35.5 | 32.1 | 0.90 | Excellent | |
| 582 | | 35.2 | 31.2 | 0.89 | Excellent | |
| 583 | | 36.3 | 31.8 | 0.88 | Excellent | |
| 584 | | 36.6 | 33.1 | 0.90 | Excellent | |
| 585 | | 36.8 | 31.6 | 0.86 | Excellent | |
| 586 | | 36.5 | 31.5 | 0.86 | Excellent | |

TABLE 15-continued

| | | | | | | |
|---|---|---|---|---|---|---|
| 587 | | 36.6 | 32.2 | 0.88 | Excellent | |
| 588 | | 36.9 | 33.1 | 0.90 | Excellent | |
| 589 | No vibration application | — | — | — | Very poor | Comparative Examples |
| 590 | | | | | Very poor | |
| 591 | | | | | Poor | |
| 592 | | | | | Poor | |
| 593 | | | | | Fair | |
| 594 | | | | | Fair | |
| 595 | | | | | Excellent | |
| 596 | | | | | Excellent | |
| 597 | | | | | Very poor | |
| 598 | | | | | Very poor | |
| 599 | | | | | Poor | |
| 600 | | | | | Poor | |
| 601 | | | | | Poor | |
| 602 | | | | | Poor | |
| 603 | | | | | Poor | |
| 604 | | | | | Poor | |

As shown in Nos. 541 to 552 of FIG. 15, even in cases where the steel strip was heated in an air atmosphere and then caused to advance into the hot-dip plating bath (even in cases where the steel strip has a relatively thick oxide film on its surface), the holiday rate of the plated product was less than 1% because vibration was applied under the conditions in which an acoustic spectrum within the scope of the present invention was measured in the hot-dip plating bath.

Furthermore, as shown in Nos. 553 to 588 of Table 15, in cases where the heating atmosphere at a point upstream of the snout and the atmosphere in the snout were non-oxidizing atmospheres, the holiday rate of the plated product was 0% even when the heated steel strip was caused to advance into the hot-dip plating bath, because vibration was applied under the conditions in which an acoustic spectrum within the scope of the present invention was measured in the hot-dip plating bath.

In contrast, in cases where the steel strip was heated in an air atmosphere and then subjected to hot-dip plating without applying vibration to the interior portion of the hot-dip plating bath, the holiday rate of the plated product was 80% or more, as shown in Nos. 589, 590, 597, and 598 of Table 15.

Furthermore, in cases where the heating atmosphere at a point upstream of the snout and the atmosphere in the snout were non-oxidizing atmospheres and the steel strip was subjected to hot-dip plating without applying vibration to the interior portion of the hot-dip plating bath, the holiday rate of the plated product was 1% or more, as shown in Nos. 591 to 594 and 599 to 604 of Table 15.

Note that, in cases where the steel strip was subjected to a reduction/heating treatment and then subjected to hot-dip plating in a reducing atmosphere in the same manner as conventional techniques, the holiday rate of the plated product was 0% as shown in Nos. 595 and 596 of Table 15.

Remarks

The present invention is not limited to the embodiments, but can be altered by a skilled person in the art within the scope of the claims. The present invention also encompasses, in its technical scope, any embodiment derived by combining technical means disclosed in differing embodiments.

REFERENCE SIGNS LIST

2 steel sheet (metal material)
2A steel strip (metal material)
20 hot-dip plating bath (plating bath)

The invention claimed is:

1. A hot-dip plating method comprising a plating step, the plating step comprising causing a metal material to advance into a plating bath which is a molten metal and allowing the metal material to be coated with the molten metal while applying vibration to the plating bath while the metal material is in contact with the molten metal, wherein a frequency of the vibration applied to the plating bath is a fundamental frequency, in the plating step, the vibration is applied, on the basis of a result obtained by measuring an acoustic spectrum in the plating bath with use of an acoustic measuring instrument dipped in the plating bath, such that the acoustic spectrum measured in the plating bath satisfies a relationship represented by the following expression (1):

$$(IB-NB)/(IA-NA)>0.2,$$

where

IA is an average sound pressure level over an entire measured frequency range,

IB is an average sound pressure level over specific frequency ranges including (i) a range lying between a sound pressure peak at the fundamental frequency and a sound pressure peak at a second-harmonic frequency and (ii) each range lying between sound pressure peaks at adjacent ones of a plurality of harmonic frequencies, NA is an average sound pressure level over the entire measured frequency range when the vibration is not applied, and NB is an average sound pressure level over the specific frequency ranges defined for the IB when the vibration is not applied, and a power of the vibration is not less than 0.5 W and not more than 30 W.

2. The hot-dip plating method as set forth in claim 1, comprising subjecting the metal material to a degreasing treatment or a pickling treatment as one or more pretreatments prior to the plating step.

3. The hot-dip plating method as set forth in claim 1, wherein, in the plating step, a distance between (i) a location where the acoustic spectrum is measured with use of the acoustic measuring instrument in the plating bath and (ii) a surface of the metal material is not more than 10 mm.

4. A hot-dip plating method comprising a plating step, the plating step comprising causing a metal material to advance into a plating bath which is a molten metal and allowing the metal material to be coated with the molten metal while applying vibration to the plating bath while the metal material is in contact with the molten metal, wherein a frequency of the vibration applied to the plating bath is a fundamental frequency, in the plating step, the vibration is applied, on the basis of a result obtained by measuring an acoustic spectrum in the plating bath with use of an acoustic measuring instrument dipped in the plating bath, such that the acoustic spectrum measured in the plating bath satisfies a relationship represented by the following expression (1):

$$(IB-NB)/(IA-NA)>0.2,$$

where

IA is an average sound pressure level over an entire measured frequency range,

IB is an average sound pressure level over specific frequency ranges including (i) a range lying between a sound pressure peak at the fundamental frequency and a sound pressure peak at a second-harmonic frequency and (ii) each range lying between sound pressure peaks at adjacent ones of a plurality of harmonic frequencies, NA is an average sound pressure level over the entire measured frequency range when the vibration is not applied, and NB is an average sound pressure level over the specific frequency ranges defined for the IB when the vibration is not applied, and the entire measured frequency range is 10 kHz to 90 kHz.

5. The hot-dip plating method as set forth in claim 4, comprising subjecting the metal material to a degreasing treatment or a pickling treatment as one or more pretreatments prior to the plating step.

6. The hot-dip plating method as set forth in claim 4, wherein, in the plating step, a distance between (i) a location where the acoustic spectrum is measured with use of the acoustic measuring instrument in the plating bath and (ii) a surface of the metal material is not more than 10 mm.

* * * * *